US011064781B2

(12) United States Patent
Elliott

(10) Patent No.: US 11,064,781 B2
(45) **Date of Patent: *Jul. 20, 2021**

(54) HAIR COLORING VARIEGATION DEVICE AND METHOD OF USE

(71) Applicant: EB TECHNOLOGIES, LLC, State College, PA (US)

(72) Inventor: Franklin Elliott, State College, PA (US)

(73) Assignee: F. G. Elliott LLC, State College, PA (US)

( * ) Notice: Subject to any disclaimer, the term of this patent is extended or adjusted under 35 U.S.C. 154(b) by 1087 days.

This patent is subject to a terminal disclaimer.

(21) Appl. No.: 15/313,565

(22) PCT Filed: May 26, 2015

(86) PCT No.: PCT/US2015/032383

§ 371 (c)(1),
(2) Date: Nov. 23, 2016

(87) PCT Pub. No.: WO2015/179856

PCT Pub. Date: Nov. 26, 2015

(65) Prior Publication Data

US 2017/0196334 A1 Jul. 13, 2017

Related U.S. Application Data

(60) Provisional application No. 62/002,313, filed on May 23, 2014, provisional application No. 62/112,735, filed on Feb. 6, 2015.

(51) Int. Cl.
*A45D 19/02* (2006.01)
*A45D 19/00* (2006.01)

(52) U.S. Cl.
CPC ..... *A45D 19/02* (2013.01); *A45D 19/012* (2021.01); *A45D 19/0066* (2021.01)

(58) Field of Classification Search
CPC ..... A45D 19/02; A45D 19/0008; A45D 2019/025; A45D 2019/0066; A45D 2019/0091
See application file for complete search history.

(56) References Cited

U.S. PATENT DOCUMENTS

| | | | |
|---|---|---|---|
| 3,349,781 | A | 10/1967 | Poole et al. |
| 4,114,632 | A | 9/1978 | Morganroth |
| 4,166,754 | A | 8/1979 | Di Pasqua |
| 4,325,393 | A | 4/1982 | Thomas |
| 5,024,243 | A | 6/1991 | Snyder |

(Continued)

FOREIGN PATENT DOCUMENTS

| | | |
|---|---|---|
| WO | 2015/179856 | 11/2015 |

*Primary Examiner* — Edward Moran
(74) *Attorney, Agent, or Firm* — Clark & Brody LP

(57) ABSTRACT

A method and device for selectively entraining hair strands from the scalp having at least one hooking applicator, the at least one hooking applicator employing a hook that rotates to entrain the hair strands, a hair color container having hair color therein and a way to apply the hair color to the entrained hair stands includes a hooking applicator, hair color container, and trigger mechanism. The trigger mechanism operates to entrain hair using the hooking application and apply hair color to the hair from the hair color container.

24 Claims, 30 Drawing Sheets

(56) References Cited

U.S. PATENT DOCUMENTS

| | | | | |
|---|---|---|---|---|
| 5,152,306 | A | 10/1992 | Stephan | |
| 5,303,722 | A | 4/1994 | Godfrey et al. | |
| 5,337,765 | A | 8/1994 | Wong | |
| 5,562,111 | A | 10/1996 | Torres | |
| 6,053,177 | A * | 4/2000 | Sofer | B05C 17/00596 132/112 |
| 6,062,231 | A | 5/2000 | Laforcade | |
| 6,237,608 | B1 | 5/2001 | Kari | |
| 6,568,404 | B2 | 5/2003 | Mitchem | |
| 6,675,812 | B1 * | 1/2004 | Wiley | A45D 19/02 132/108 |
| 7,156,885 | B2 | 1/2007 | Kennedy et al. | |
| 7,530,358 | B2 | 5/2009 | Elliott | |
| 7,568,486 | B2 | 8/2009 | Vrus | |
| 8,479,748 | B1 * | 7/2013 | Satir | A45D 24/10 132/108 |
| 2003/0024544 | A1 | 2/2003 | Thiebaut | |
| 2005/0028835 | A1 | 2/2005 | Husband et al. | |
| 2005/0063914 | A1 * | 3/2005 | Ma | A45D 19/02 424/47 |
| 2006/0042643 | A1 | 3/2006 | Delan | |
| 2007/0215170 | A1 | 9/2007 | Kennedy et al. | |
| 2010/0186762 | A1 * | 7/2010 | Spagnuolo | A45D 19/0008 132/115 |
| 2011/0005546 | A1 * | 1/2011 | Muller-Grunow | A45D 19/0008 132/270 |
| 2012/0006350 | A1 * | 1/2012 | Geuther | A45D 19/0008 132/270 |
| 2014/0332026 | A1 | 11/2014 | Peters et al. | |
| 2016/0029765 | A1 | 2/2016 | Cetinkaya | |

* cited by examiner

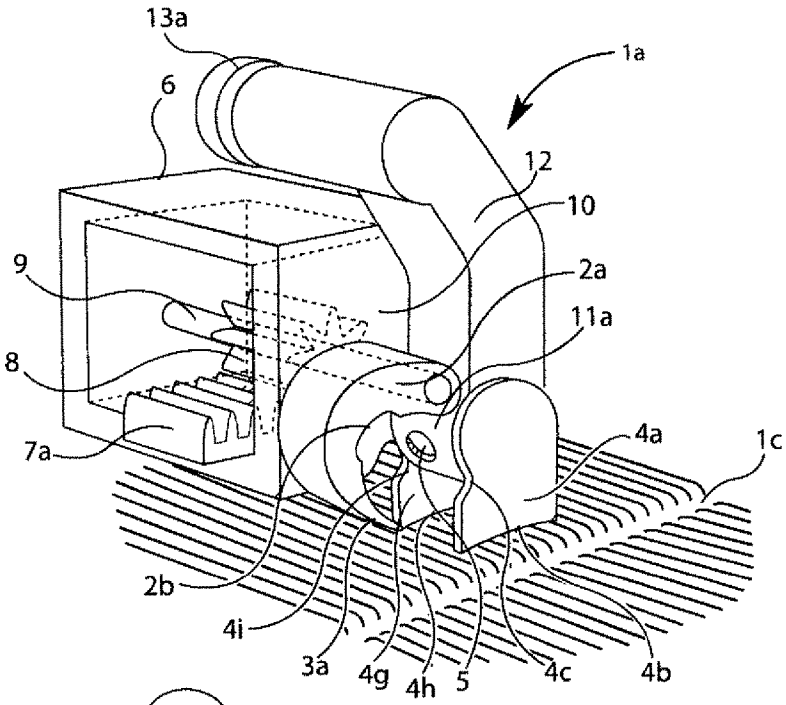
FIG. 1A
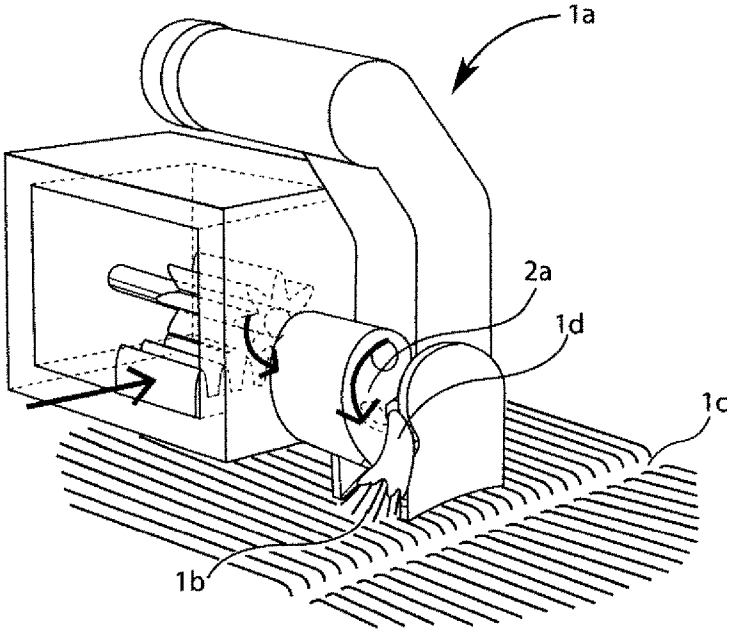
FIG. 1B
FIG. 1C
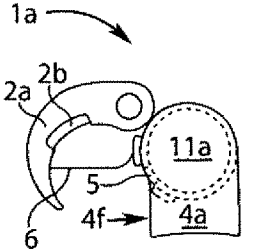
FIG. 1D
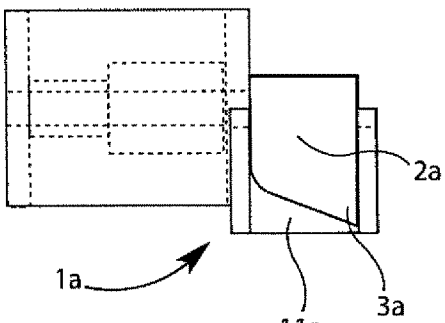
FIG. 2A
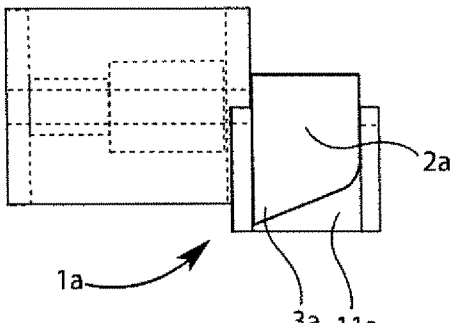
FIG. 2B
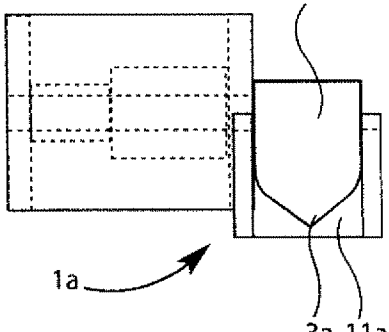
FIG. 2C 78a
78c
78e
78g
78d
80a
17
80b
78f
79
78b
20a 78a
20b
17
18
14a
78
20c 16a
15
78a
20b
80a
80b
79
17
18
14a
78a
20c 16a
15

HAIR COLORING VARIEGATION DEVICE AND METHOD OF USE

BACKGROUND OF THE INVENTION

Field of the Invention

The present invention relates generally to the coloring of human hair, and more particularly, to an improved method and device for quickly and effectively coloring human hair.

Background Art

Hair color variegation is a popular service performed by the professional beauty industry. The process involves the segregation of one or more sections of human hair followed by the treatment of the segregated hair with a hair coloring method or chemical. The technical skill required to separate particular sections of a person's hair from the remainder has kept this procedure mostly in the purview of hair salons.

A previously popular method for highlighting hair is described in U.S. Pat. No. 5,562,111. The method disclosed therein involves a cap tightly fitted over a scalp of combed-back hair. Strands of hair are then pulled through holes in the cap with a crochet hook and the exposed hair is colored to create the effect of variegation. Although this method can be somewhat successful both at keeping the chemical hair coloring from bleeding onto the hair not intended for treatment and creating a generally variegated look, the necessity of drawing hairs through individual holes in the cap makes it difficult for the technician to consistently draw out a section of hair from the desired area without unintentionally entraining undesired sections of hair from areas surrounding the hole. The end result is unpredictable and, sometimes, very undesirable. Moreover, the available variegation pattern is dictated by the location and distribution of the holes in the cap. Additional disadvantages to this method include the inability to effectively color hair roots, the inability to consistently prevent the bleeding of color to adjacent sections of unselected hair, and the pain experienced by the recipient due to the repeated pulling of her hair through small holes. U.S. Pat. No. 4,165,754 is another example of a hair highlighting method employing a cap over the scalp. This method has the identical drawbacks of the '111 patent.

Alternatively, there are various combing methods used to apply hair color in a variegated manner. A general method involves dipping a comb into a liquid hair color and pulling the comb through the hair to be treated. Only relatively large sections of hair can be treated in this manner and it is difficult for the operator to avoid color bleeding onto hair not intended for treatment. U.S. Pat. No. 3,349,781 describes a method wherein a hair stylist parts hair into sections and uses a brush with a series of spaced tufts to brush streaks onto random strands. The tufts of the brush are dipped into a hair color composition and retain the composition until the brush is drawn across the strands to be colored, thus depositing the colorant thereon. This method utilizes protective sheets placed under and over the streak-treated partings before and after treatment to avoid color bleeding to adjacent hair. However, using this brush method makes it difficult to choose which strands of hair will be treated. Hence, there is minimal control over the placement of the hair treatment. Therefore, larger sections of hair are treated, resulting in a more unnatural hair coloring effect.

U.S. Pat. No. 5,337,765 describes a modular brush for applying hair color compositions with a brush body and detachable bristle modules so that the brush can be configured to achieve a user-defined variegated pattern. However, this arrangement presents the same limitations as described above for the '781 patent.

A more commonly used technique by those skilled in the art involves selecting hair through weaving with a conventional tail comb and then placing the selected sections onto aluminum foil (or some other sheet of barrier material) and then painting sections with a hair color composition. A dispensing device for metallic foil that may be used in this process is disclosed in U.S. Pat. No. 6,237,608. The foil method allows for smaller, more independent, more consistently variegated sections to be treated closer to the scalp, resulting in a more naturally variegated final appearance. When using this method, the potential for color bleeding onto surrounding hair is reduced. But even with these advantages over other hair color variegation techniques, the foil method is very time consuming and expensive. For an average client, approximately 30 to 50 minutes is required to complete this method of hair coloration.

Hair color variegation techniques that involve color treated sections that have been woven away and placed inside a barrier material for processing produce natural and attractive variegated appearance. It follows then that advancement in the field of hair color variegation involves weaving, color treatment and barrier material. Reference will now be made to technology that attempts to advance on one or more of these three general systematic elements.

U.S. Patent Application No. 2005/0028835 discloses "A Device for Dispensing a Barrier Material to a Lock of Hair." This device (although some of the embodiments vary greatly) is comprised of two tape dispensers that are hinged at the roll end. The tape dispenser end (distal to the roll end) opens and closes in such a way as to cause the faces of the two tapes to touch. A section of hair can be chosen and encapsulated between the two tapes. The face of one or both of the tapes is treated with one or both of the chemical hair color components. The embodiments also include means within the device to apply hair color just before the hair is encapsulated within the tape. This method, although saving time and product, still lacks the ability to automatically, quickly and accurately weave away a plurality of selected hair sections for variegation purposes.

U.S. Pat. No. 5,152,306 discloses a hair-weaving comb that has regular teeth and inwardly barbed teeth attached alternately across the spine of the comb. In practice, a thin section of hair is parted away from the scalp. The teeth of the comb are then pushed into the parting and drawn back out. The barbed teeth pick up sections of hair while the straight teeth do not. An operator grabs the hooked hair, pulls the comb away and lets the non-hooked hair fall. This device allows for a faster and more consistent weave than the manual hair weaving method. However, it does not offer any device or method to apply color or barrier material. In addition, the device does not effectively pick up sections of hair in a predictable manner, nor does it pick up hair against a curved scalp surface.

U.S. Pat. No. 5,024,243 discloses a comb/color applicator combination. The device discloses a comb with a hollow spine that screws onto a container filled with chemical color composition. When the container is squeezed, the chemical composition fills the hollow spine of the comb and exits the spine through small holes positioned in between the teeth of the comb. Although this device will yield a variegated hair color appearance, there is a substantial risk of color bleeding because the variegated hair is not woven away from the rest, and the device fails to provide the technician with a high degree of control or accuracy.

U.S. Pat. No. 5,303,722 describes a hair lightening method involving the use of an optical photosensitizer and a compound capable of providing a hydrogen radical (ethanol is preferred) in a solution. The solution is applied to the hair and then left to saturate for 5 to 60 minutes. Low intensity ultraviolet light (typically provided by a comb or hood) is then applied to the hair causing a hydrogen to be exchanged between the two components in the solution, thereby creating hydrogen peroxide inside the hair shaft. The peroxide is excited by the light causing some of the hair pigment (melanin) to be destroyed. As a result, the hair subjected to the process is lightened. Using this same photochemical reaction, the '722 patent describes a method whereby the entire head of hair is saturated with the photosensitive solution followed by the segregation of small sections of hair by manual weaving. The non-segregated hair is masked with an opaque material so that only the segregated hair is exposed to the low intensity ultraviolet light. The result is "highlight" effect among the segregated hair strands. The techniques described in the '722 patent involve considerable time and manual labor.

U.S. Pat. No. 4,325,393 discloses a hooking mechanism for hair coloration. The implement has a plurality of equidistantly spaced, accurate hook members movable between open and closed positions with respect to the bottom surface of the body of the implement by an operating slide member at its top. After thus hooking and engaging spaced groups of hair strands for treatment, the implement is lifted from the scalp to isolate the strand groups for bleach or dye treatment. This implement does not offer the operator nearly the degree of control that is inherent in the instant invention. Although the bottom surface of the device is curved, it does not flexibly conform to the curve of the head. This prohibits the device from uniformly selecting portions of hair.

Furthermore, the '393 patent offers no means by which the hooked hair can have a comfortable tension applied to it when the hooks are in the closed position. Hair may be hooked away from the scalp, but it cannot be held against tension—it will simply slide through hooks when the operator pulls the device away from the head. Finally, the '393 patent does not include any means by which it can apply color compositions nor any means to assure a safe and controlled contact with the scalp by the swinging hooks.

U.S. Patent Application No. 2006/0042643 discloses a hair highlighting tool. However, the disclosed invention does not address the multiple problems overcome with the instant invention. In fact, it may exacerbate some of the problems regarding the regulation and control of hair coloration.

U.S. Pat. No. 7,530,358 overcomes many of the problems identified above but does not address the problem of applying color of higher viscosity. The '358' patent does not provide means for expelling high viscosity liquid hair color from a color container onto entrained sections of hair in a controlled manner as does the present invention. The '358' patent discloses a hook that is only useful for entraining hair against an applicator that distributes low viscosity hair color onto the entrained section by way of a 'wicking' action. The present invention features a hook and applicator arrangement that, when in the closed position, channels high viscosity liquid hair color onto entrained sections in a controlled manner. Also, the '358' hooking mechanism is prohibitively complicated and relies on a mechanism that raises the hook and entrained section of hair up to the applicator. The present invention eliminates the need for this mechanism without losing function. Furthermore, the '358' patent describes a mechanical means responsible for confining the hooks to a light controlled contact with the scalp. This mechanical means consists two feet separated into four scalp contact points; two contact points in front of the hook and two contact points in back of the hook creating a hook channel that extends flush with the rotation of the hook toward the scalp. The present invention involves an arrangement that likewise confines the hooks to a light, controlled contact with the scalp also employing two 'feet' with two scalp contact points positioned in front of as well as in back of the hook. The present preferred embodiment of the device entrains and gathers the entrained section of hair differently employing a 'scissor action' by gathering the hair as it approaches the closed position between the inside of the hook and the side edges of the scalp contact points or 'feet'. Considering there are feet that only occupy the width of the applicator nozzle, this leaves the entire pivot of the hook toward the nozzle in full view of the operator. This more open hook arrangement allows the operator a better view of the entraining of the hair as well as a better view of the application of color onto the entrained section than is allowed in the '358' patent. Finally, unlike the '358' patent, the present invention keeps the color components separated as it dispenses and mixes them just before the color comes into contact with the entrained sections.

All of the above-cited prior art addresses certain needs. However, none solves the time, consistency and control problems that are encountered when performing the manual hair color variegation technique presently most popular in the purview of the hair salon. In addition, none have successfully combined mechanical elements into a single device to give it the ability to do all that is mentioned in the present disclosure. Accordingly, there is a need for a hair coloration device that safely, accurately, predictably, and quickly applies low and high viscosity colorant to uniformly selected and entrained portions of hair.

SUMMARY OF THE INVENTION

The present embodiment of the hair color variegation device features a pre-loaded color container that slides into the front of the handle as well as hair entraining and color dispensing mechanisms that are engaged in sequence by a single squeeze of the handle. The device is used in one hand by drawing a parting of hair across the scalp with a rod-like member extending away from the rear of the device. This member is called the parting stem. The device is then turned so that the head of the device is facing and in line with the parting of hair. The head of the device is placed along the parting so that the parting is visible 1/16 " to 1/4" or farther above the line of the contact points of the head of the device. The head of the device is now urged against the parting, at which point the head of the device will conform to the curve of the scalp. In this conformed placement, each hook is now in the correct position to accurately lift hair against each applicator nozzle. While holding the device lightly conformed to the scalp, the operator slowly squeezes the handle. As the operator slowly squeezes the handle, the hooks pivot simultaneously across the scalp, painlessly entraining sections of hair against the applicator nozzles. As the operator continues to slowly squeeze the handle, the hooks remain engaged while the squeeze plate begins to put pressure on the color container. This allows the operator to hold and slide the entrained sections of hair without applying the hair color. Continuing to squeeze the handle, the pressure of the squeeze plate onto the color container causes the liquid color to move out of the color container and therefore out of the applicator nozzle and onto the entrained hair. Now, the operator may carefully pull the device away from the scalp while maintaining a controlled pressure on the handle. In this manner, hair color is evenly deposited onto the entrained sections of hair. At this point the operator may stop applying squeeze pressure while continuing to holding the entrained sections of hair. While the hair is still entrained in one hand and no color is being deposited, the operator may place barrier material over the color treated sections with the free hand or simply let the color treated hair drop back into the rest of the hair. This application process may be repeated many times in one variegated hair color service.

Variations of the device may employ a single hooking applicator as well as any number of hooking applicators up to six or more hooking applicators. Certain variations of the device that employ one and perhaps up to three hooking applicators will not need a curvature conformation feature.

Hooking applicators vary in size allowing embodiments of the device to entrain individual sections of hair of varying size.

Other embodiments of the device feature a variety of detachable head units. This allows a single device handle to accommodate a variety of head units each featuring different numbers and sizes of hooking applicators.

Still other embodiments allow the operator to restrict the flow of hair color to some of the hooking applicators while allowing color to flow through others while the device is in use, while other embodiments provide a mechanical alternative to the rack and pinion gear drive that pivots the hook/hooks in the form of a lever system.

BRIEF DESCRIPTION OF DRAWINGS

Note: The following Brief Description of Drawings as well as the Detailed Description of Drawings that follows repeatedly refer to the following terms: open position and closed position. Open position refers to the hook 2*a* as it appears having pivoted away from the applicator nozzle 11*a* (see FIG. 1A). The closed position refers to the hook 2*a* as it appears having pivoted into contact with the applicator nozzle 11*a* (see FIG. 1B).

FIG. 1A is a front perspective view of a single hooking applicator 1*a* of the preferred embodiment. This figure depicts the hooking applicator as it appears with the hook 2*a* in the open position.

FIG. 1B is a front perspective view of a single hooking applicator of the preferred embodiment. This figure depicts the hooking applicator as it appears with the hook 2*a* in the closed position.

FIG. 1C is a front view of the front of an applicator nozzle 11*a* and a foot 4*a*. This figure depicts the preferred location of the scissors edge 4*f* of the foot 4*a*.

FIG. 1D is a front view of a hooking applicator 1*a* and depicts a relocation of the scissors edge 4*f* of the foot 4*a*.

FIG. 2A is a bottom view of a single hooking applicator of the preferred embodiment, each depicting the hook point in the closed position with the hook point positioned in the front of the hook.

FIG. 2B is a bottom view of a single hooking applicator of the preferred embodiment, each depicting the hook point in the closed position with the hook point positioned in the back of the hook.

FIG. 2C is a bottom view of a single hooking applicator of the preferred embodiment, each depicting the hook point in the closed position with the hook point positioned in the middle of the hook.

In addition to the option of having multiple hair color variegation devices, each with a fixed head of a different hooking applicator orientation, the operator may also be given the opportunity to have one of said device body along with several different detachable heads.

FIG. 20A depicts a head and manifold of said device that detaches by disengaging the roller couplings from the head mounts as well as the rack gear from the rack slide and shows a side view of this arrangement in the attached position.

FIG. 20B shows the device of FIG. 20A in a detached position.

DETAILED DESCRIPTION OF DRAWINGS

The present invention is a squeeze operated, hand held device that is used to selectively entrain and color human hair. The invention addresses separate and distinct technical needs of professional hair colorists and individuals desiring a controlled method of selectively coloring their hair.

The central mechanical aspect of the present invention consists of a hook that pivots along a scalp of hair and entrains a section of hair against a color applicator nozzle. This being the case, it is therefore fitting to begin the detailed description with an explanation of the hook and applicator nozzle as well as the various mechanical interactions thereof in respect to the section of hair that is entrained.

Relating to the hook and applicator nozzle, the open position' and closed position' will be referred to many times. For the sake of minimizing redundancy (see FIGS. 1A and 1B), the term "open position" always refers to the hook 2*a* as having pivoted to the farthest position away from the applicator nozzle 11*a*. The term "closed position" always refers to the hollow of the hook 2*a* as having pivoted into contact with the applicator nozzle 11*a* having entrained a section of hair 1*b* between.

FIGS. 1A and 1B depict hooking applicators 1*a* in the open and closed positions respectively. The hook 2*a* in each figure is fixed to an axle 9; and, the axle 9 pivots in a gear box 6.

The hook 2*a* consists of a short length of longitudinally halved tube laterally pivotal on one straight edge and longitudinally tapered on the opposite edge forming the hook point 3*a*.

Each of FIGS. 2A, 2B and 2C depicts a bottom view of the hooking applicator 1*a* in the closed position; however, FIG. 2A depicts the hook point 3*a* at the front of the hook 2*a*, FIG. 2B depicts the hook point 3*a* at the back of the hook 2*a* and FIG. 2C depicts the hook point 3*a* at the middle of the hook 2*a*. The location of the hook point 3*a* presents a difference in the way the hook 2*a* entrains a section of hair 1*b*: with both types of hooks 2*a* pivoting along a parting of hair 1*c* from the same position relative to the part 1*c*, a hook 2*a* that is pointed on the front 3*a* will entrain less hair than a hook 2*a* that is pointed on the back 3*a*.

Figure 3B:
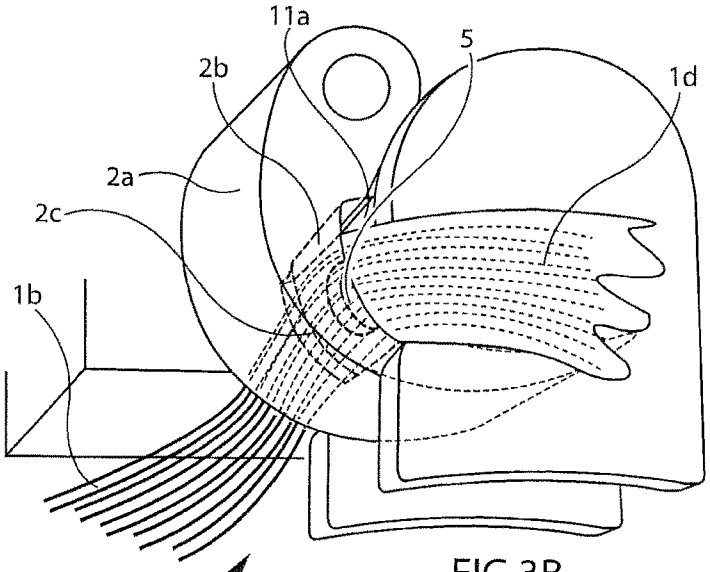
FIG. 3B is a magnified front perspective view of the preferred embodiment depicting the hook 2*a*, nozzle 11*a* and feet 4*a* in the closed position with a section of hair entrained therein.
Figure 3D:
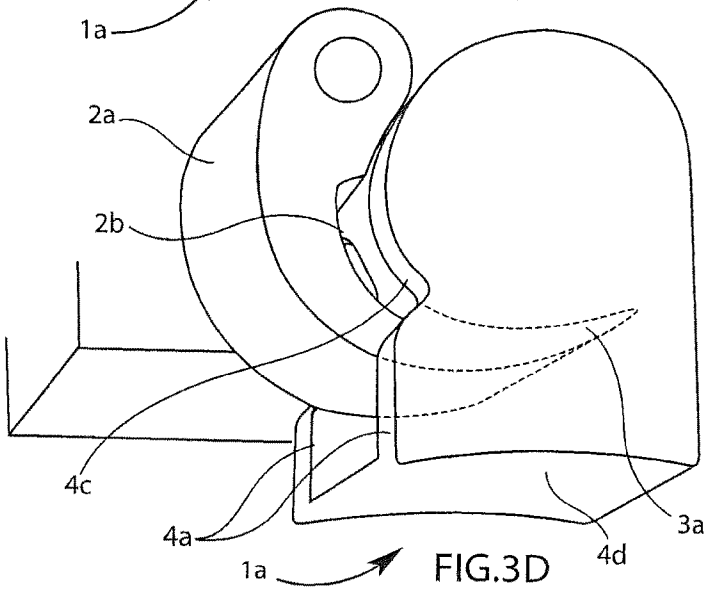
FIG. 3D is a magnified front perspective view of the preferred embodiment illustrating the hook 2*a*, nozzle 11*a* and feet 4*a* in the closed position and shows an alternative embodiment of the feet 4*a*.
Figure 3A:
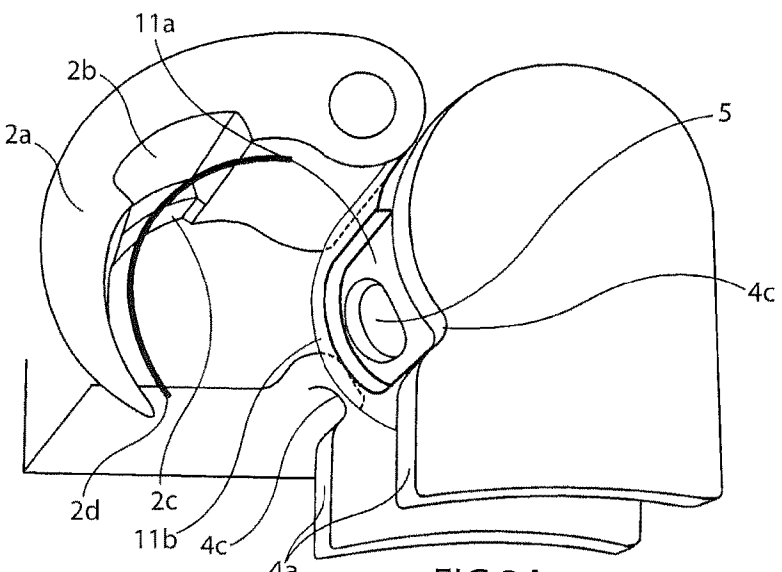
FIG. 3A is a magnified front perspective view of the preferred embodiment depicting the hook 2*a*, nozzle 11*a* and feet 4*a* in the open position and provides a detailed depiction of the geometry of each.
Figure 3C:
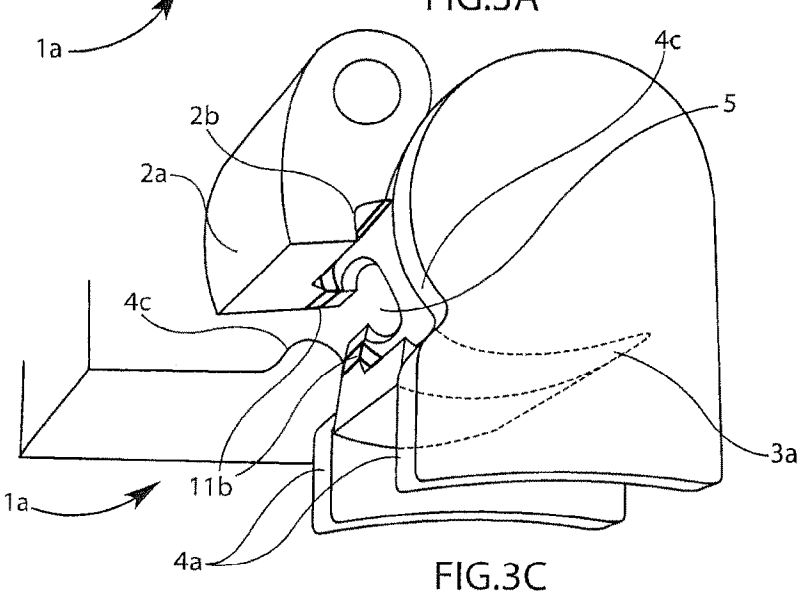
FIG. 3C is a magnified front perspective view of the preferred embodiment depicting the hook 2*a*, nozzle 11*a* and feet 4*a* in the closed position and provides a detailed sectional depiction of the geometry of each.

FIG. 3A depicts the hooking applicator in the open position; more specifically, it outlines the hollow 2*d* (depicted by a bold black line) of the hook 2*a* and depicts the nozzle 11*a* as being partially covered by a layer of viscoelastic foam 11*b* (or any other applicable flexible material). FIG. 3B illustrates the hollow 2*d* of the hook 2*a* and the cylinder of the applicator nozzle 11*a* are an accurate fit while in the closed position. FIG. 3C is a sectional view of the closed position and illustrates how this accurate fit becomes a seal as the hollow of the hook 2*a* presses into the layer of viscoelastic foam 11*b* that surrounds the aperture 5 on three sides. The nozzle seal 11*b* prevents leaking of the liquid hair color around the back and sides of the hook 2*a* while in the closed position.

Referring to FIGS. 1A and 1B, notice one foot 4*a* fixed to the front of the applicator nozzle 11*a* and one foot 4*g* fixed to the back of the applicator nozzle 11*a* with the hook 2*a* positioned between. A comfortable contact of the pivoting hook 2*a* with the scalp 1*c* is assured as the hook 2*a* is confined to travel a precise pivotal path between the front foot 4*a* and rear foot 4*g*, and, as the hook point 3*a* is confined to pivot generally flush with the front foot contact point 4*b* and rear foot contact point 4*h*. This mechanical arrangement, therefore, utilizes the front foot contact point 4*b* and rear foot contact point 4*h* as means to allow the hook 2*a* to entrain a section of hair 1*b* while preventing the hook point 3*a* from making forceful contact with the scalp.

FIGS. 4A-4D bottom views depict another mechanical relationship between the hook 2*a*, front foot 4*a* and rear foot 4*g*, namely, how the hook 2*a*, front foot 4*a*, and rear foot 4*g* function to separate the entrained section of hair 1*b* from the surrounding hair at the scalp as well as to center the entrained section of hair 1*b* within the hollow of the hook 2*a* and maintain the centered position of the section of hair 1*b* through the color coating process. This separation and centering of the entrained section of hair 1*b* occurs as the front contact surface 2*e* and rear contact surface 2*f* of the hook 2*a* slide against the front hook contact surface 4*e* of the front foot 4*a* and rear hook contact surface 4*j* of the rear foot 4*g*, as per a scissor action, while moving from the open to closed position.

Figures 4A, 4B, 4C, 4D:
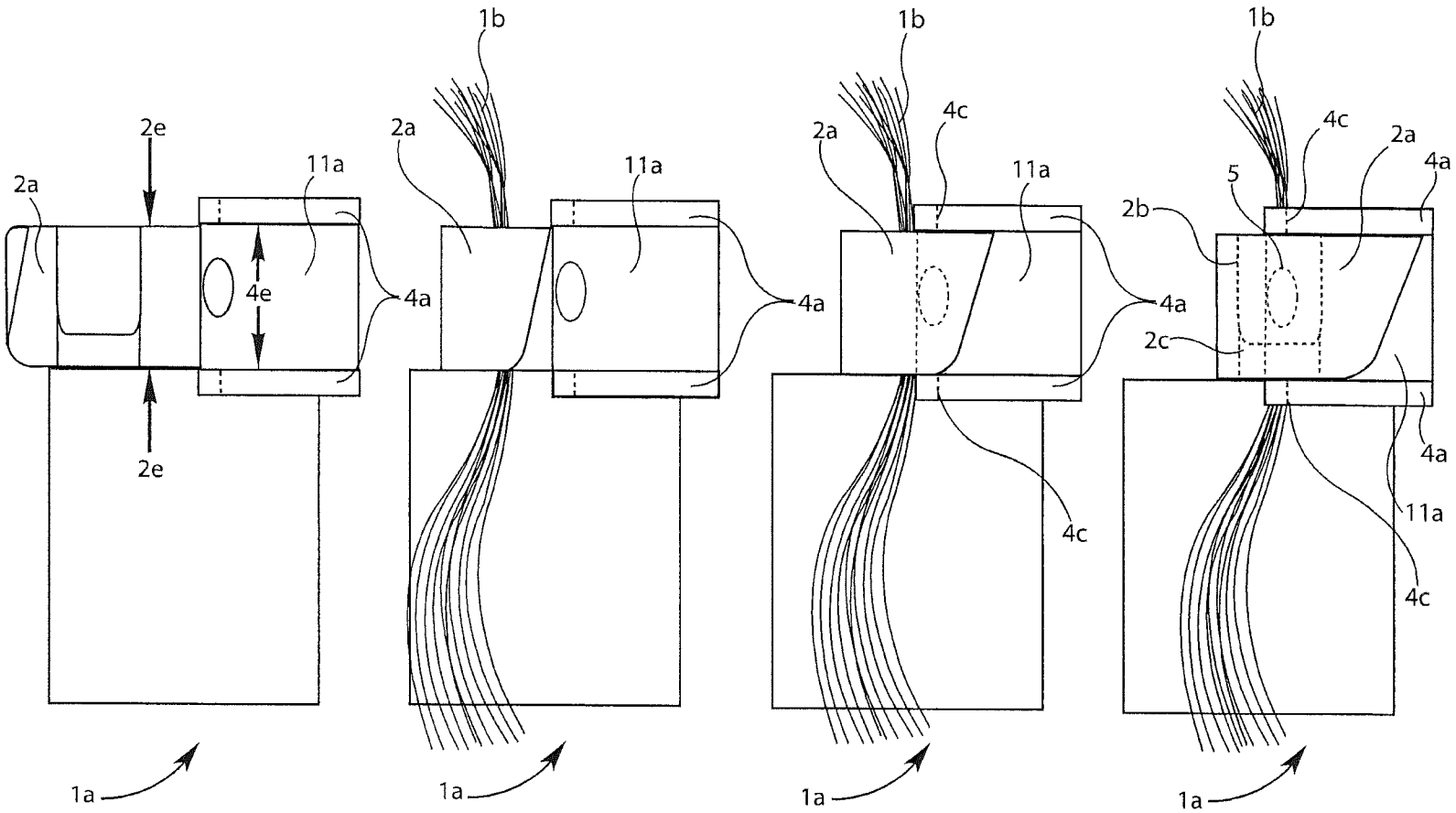
FIG. 4A is a magnified bottom view of the preferred embodiment of hooking applicator together providing a serial depiction of a first step of the mechanical process of hair section entrainment.
FIG. 4B is a magnified bottom view of the preferred embodiment of hooking applicator together providing a serial depiction of a second step of the mechanical process of hair section entrainment.
FIG. 4C is a magnified bottom view of the preferred embodiment of hooking applicator together providing a serial depiction of a third step of the mechanical process of hair section entrainment.
FIG. 4D is a magnified bottom view of the preferred embodiment of hooking applicator together providing a serial depiction of a fourth step of the mechanical process of hair section entrainment.

FIG. 4A depicts the hook 2*a* and applicator nozzle 11*a* in the open position. FIG. 4B depicts same hooking applicator 1*a* as the hook 2*a* has pivoted toward the closed position enough to have entrained a section of hair 4*b*. FIG. 4C illustrates the hooking applicator 1*a* as the hook 2*a* has pivoted with the entrained section of hair 1*b* to a point where the hook 2*a* has not quite reached the closed position and the entrained section of hair 1*b* has been pulled in by the hook 2*a* close enough to the applicator nozzle 11*a* for the entrained section 1*b* to have encountered the front foot scissors edge 4*f* and the rear foot scissors edge 4*k*. FIG. 4D depicts the hooking applicator 1*a* in the closed position with the section of hair 1*b* centered over the aperture 5 of the applicator nozzle 11*a* as well as being centered over the color channel 2*b* and hair channel 2*c* of the hook 2*a*. Also, the entrained section of hair is occupying the front foot channel 4*c* and rear foot channel 4*i*.

FIG. 1C depicts a front view of the front foot 4*a* and points to the preferred location of the front scissors edge 4*f* of the foot front 4*a*. As stated above, this scissors edge 4*f* of the front foot 4*a* pushes an entrained section of hair functionally into the closed position. FIG. 1D depicts this front scissors edge 4*f* located closer to the center of the front foot 4*a* than the preferred location depicted in FIG. 1C. Relocating this front scissors edge 4*f* relative to the center of the front foot 4*a*, along with relocating the aperture 5, color channel 2*b* and hair channel 2*c*, so that the said features intersect functionally with the top of the front scissors edge 4*f* in the closed position, changes the amount of hair that is entrained by the individual hooking applicator 1*a* as well as changing the closeness to the scalp of the initial application of color onto the entrained section of hair. Furthermore, if the rotation of the hook 2*a* is not on a particular degree of upswing relative to the bottom of the front scissor edge 4*f*, a portion of the entrained section of hair will be brought against the bottom of the corner of the front foot 4*a* rather than the front scissors edge 4*f* causing strands of hair to become lodged between the hook 2*a* and front foot 4*a*. This will cause the entrained section of hair to become snagged. This front scissors edge 4*f* may occupy various positions relative to the center of the front foot 4*a* and may even be somewhat angled rather than the perpendicular orientation it occupies presently in relation to the bottom of the gear box 6. In addition to this, the length of the front foot 4*a* may be adjusted in order to change the amount of hair that is entrained. (Note: All of the preceding description of FIGS. 1C and 1D also applies to the rear foot which is not visible in said figures. Simply replace the term 'front' with the term rear and this will provide the same description of the rear foot.)

FIG. 3D is another variation of the feet arrangement featuring a foot bridge 4*d*. This foot bridge 4*d* connects the front foot 4*a* and rear foot 4*g* along the bottom creating one wide foot that surrounds the tip of the hook 3*a* in the closed position. This foot bridge 4*d* creates a further scissor action along the bottom of the hook 2*a*. Furthermore, the hook point 3*a* may be but not necessarily closed on five sides creating a box that is open only to the hook point 3*a* as it pivots toward and establishes the closed position. This foot bridge 4*d* variation is optional.

View FIG. 3A-3C during the following description of the process by which the entrained section of hair becomes coated with liquid hair color. FIG. 3A is a front perspective view of the hooking applicator 1*a* showing the hook 2*a* and nozzle 11*a* in the open position with the color channel 2*b* and hair channel 2*c* forming one continuous indentation approximately centered front to back across the hollow 2*d* of the hook 2*a*. FIG. 3B is a front perspective view of the hooking applicator 1*a* showing the hook 2*a* and nozzle 11*a* in the closed position over a section of hair 1*b* with the color channel 2*b* and hair channel 2*c* positioned approximately centered over the nozzle aperture 5. FIG. 3C is a sectional front perspective view of the hooking applicator 1*a*. Said figure shows that the portion of the hollow 2*d* of the hook 2*a* that comes into contact with the applicator nozzle 11*a*, while in the closed position, has flattened the nozzle seal 11*b* that is directly under said portion of the hook 2*a*; however, the color channel 2*b* remains open and, the area of the nozzle seal 11*b* within the hair channel 2*c*, remains raised and fills the hair channel 2*c*. This is because the nozzle seal 11*b* is at least as thick as the hair channel 2*c* is deep. As seen in FIG. 3B, with a section of hair 1*b* entrained in the closed position, the entrained section 1*b* is occupying the color channel 2*b* as well as the hair channel 2*c*; furthermore, said hair channel 2*c* is also occupied by a portion of the nozzle seal 11*b* as said portion remains expanded in the hair channel against the entrained section of hair. The portion of the nozzle seal 11*b* that fills the hair channel 2*c* does apply a slight pressure to the section of hair 1*b* entrained therein; however, this pressure is not enough to restrict movement of the entrained section 1*b* through the closed position; the pressure is only enough to prevent the liquid color flowing into the color channel 2*b* from leaking to the outside of the closed position through the hair channel 2*c*. Also, the pressure exerted onto the section of hair 1*b* located within the hair channel 2*c* is such that a desirable amount of tension is maintained on the entrained section 1*b*. This tension allows the device to maintain comfortable control over the entrained sections 1*b* throughout the process.

While viewing FIG. 3B, consider a section of hair 1*b* is entrained in the closed position and liquid hair color is exiting the aperture 5, the liquid fills the color channel 2*b*, thereby surrounding the portion of the entrained section 1*b* that is occupying the color channel 2*b*. As the liquid color continues to exit the aperture 5, the liquid is prevented by the nozzle seal 11*b* from expanding out from the sides of the hook 2*a* as well as from the back of the hook 2*a* through the hair channel 2*c*. This mechanical arrangement causes the entrained section of hair 1*b* to become coated with liquid hair color 1*d* as well as allows the coated entrained section 1*d* to remain coated as the coated section of hair 1*d* passes through and exits the color channel 2*b*.

FIG. 3A depicts a front foot channel 4*c* formed into the side of the front foot 4*a* and rear foot channel 4*i* formed into the side of the rear foot 4*g*. The purpose of each of these indentations is to allow clearance for the entrained section 1*b* of hair to slide through the closed position without getting pinched. As seen in FIG. 3B, the front foot channel 4*c* has the added benefit of allowing the color coated entrained section 1*d* to pass from the closed position without the color being scraped away from the color coated section of hair 1*d*.

Figure 5B:
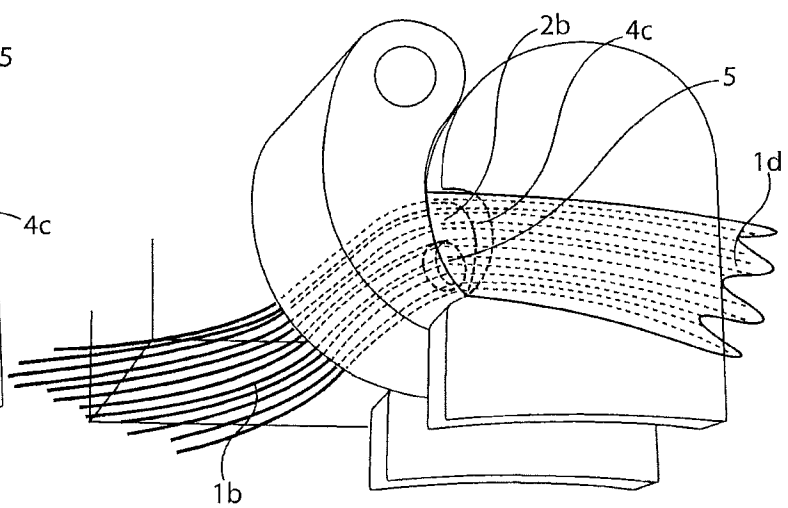
FIG. 5B is a magnified front perspective view of an alternative embodiment of the hook 2*a*, nozzle 11*a* and feet 4*a* in the closed position. This figure depicts the alternative arrangement of the hair channel 2*b* and color channel 2*c* shown in FIG. 5A with a section of hair entrained within.
Figure 5A:
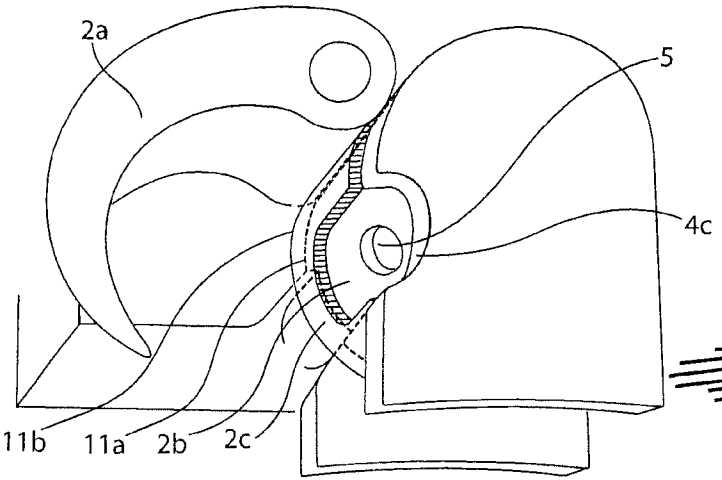
FIG. 5A is a magnified front perspective view of an alternative embodiment of the hook 2*a*, nozzle 11*a* and feet 4*a* in the open position and depicts an alternative arrangement of the hair channel 2*b* and color channel 2*c*.

Each of FIGS. 5A and 5B are perspective front views of the hooking applicator in the open and closed positions respectively depicting another color channeling variation featuring a hook 2*a* without a color channel or hair channel. This variation includes an indentation or nozzle color channel 11*d* that is located around the aperture 5 of the applicator nozzle 11*a*. This nozzle color channel 11*d* is open to the front of the closed position as well as the front foot channel 4*c* and will serve to direct the flow of the color coated entrained section of hair 1*d* much the same way as a hook color channel 2*b*. This variation also includes a nozzle hair channel 11*e* located on the applicator nozzle 11*a* behind the nozzle color channel 11*d*. The nozzle hair channel 11*e* opens to the rear foot channel 4*i* in the closed position and is covered by the nozzle seal 11*b* in order to allow the hair to move through the closed position without the risk of color back flow though the nozzle hair channel 11*e*. The nozzle color channel 11*d*, however, is open to the front of the closed position in order to allow the liquid hair color to flow from it.

Figure 6B:
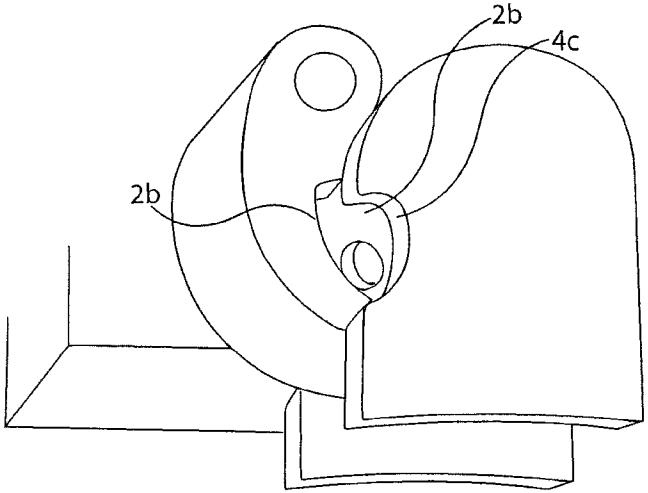
FIG. 6B is a magnified front perspective view of an alternative embodiment of the hook 2*a*, nozzle 11*a* and feet 4*a* in the closed position that illustrates yet another alternative arrangement of the hair channel 2*b* and color channel 2*c*.
Figure 6A:
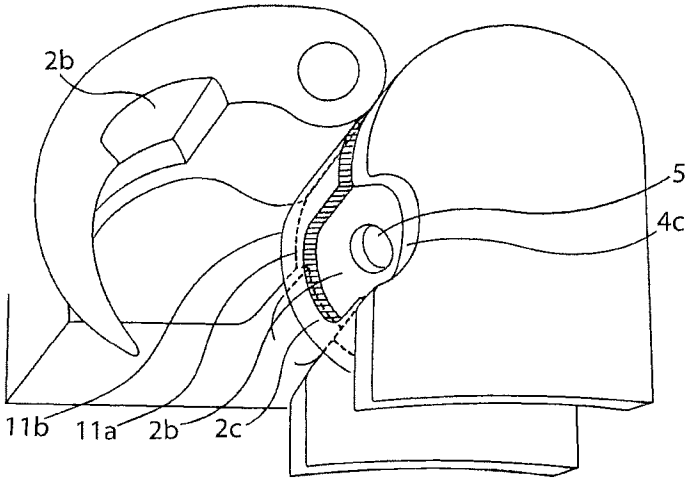
FIG. 6A is a magnified front perspective view of an alternative embodiment of the hook 2*a*, nozzle 11*a* and feet 4*a* in the open positions that illustrates yet another alternative arrangement of the hair channel 2*b* and color channel 2*c*.

FIG. 6A and FIG. 6B are front perspective views of the hooking applicator 1*a* depicting another color channeling variation combining both a color channel 2*b* located on the hook 2*a* as well as a nozzle color channel 11*d* located around the aperture 5 of the nozzle, deeper front foot channel 4*c* and nozzle hair channel 11*e*. This variation will provide the most color deposit along the entrained section of hair.

Considering all of the variations of channeling described above, the shape and dimension of the hook channel 2*b* and nozzle channel 11*d* as well as the size and shape of the aperture 5 will vary according to the viscosity of the liquid hair color as well as the desired degree of control of color flow as well as the size of color bead deposited onto the entrained section of hair 1*b*.

Figure 7B:
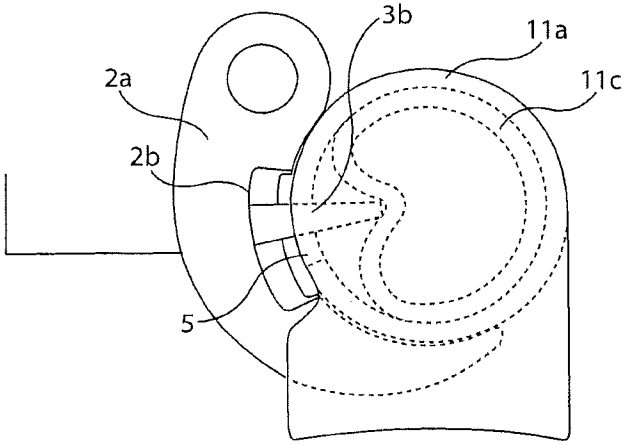
FIG. 7B is a magnified front view of an alternative embodiment of the hook 2*a*, nozzle 11*a* and feet 4*a* in the closed position that depicts an alternative arrangement of the hook 2*a* and nozzle 11*a* featuring a hook tooth 3*b* and nozzle seal 11*b*.
Figure 7A:
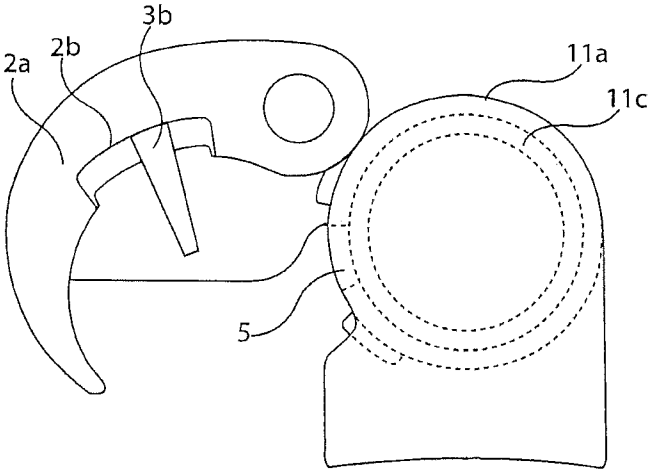
FIG. 7A is a magnified front view of an alternative embodiment of the hook 2*a*, nozzle 11*a* and feet 4*a* in the open that depicts an alternative arrangement of the hook 2*a* and nozzle 11*a* featuring a hook tooth 3*b* and nozzle seal 11*b*.

FIGS. 7A and 7B describes a small slender appendage or hook tooth 3*b* extending out from the color channel 2*b* of the hook 2*a*. As seen in FIG. 7B, the tooth 3*b* extends away from the hollow of the hook 2*a* toward the radial center of the hook 2*a* in such a way that when the hook 2*a* is in the closed position over the applicator nozzle 11*a*, the tooth 3*b* enters into the aperture 5 of the nozzle 11*a*. Since the thickness of the tooth 3*b* is smaller than the dimensions of the aperture 5, the tooth 3*b* does not obstruct the flow of color from the aperture 5. In the instance where a pressurized color container is supplying an applicator nozzle 11*a*, a rubber or silicone (or other flexible chemically resistant material) tube gasket 11*c* may be placed snuggly against the inside wall of the applicator nozzle 11*a*. This gasket 11*c* covers the nozzle 11*a* aperture 5 and prevents pressurized as well as non-pressurized color from flowing out.

Viewing FIG. 7A and FIG. 7B in series shows the hook 2*a* and the tooth 3*b* pivoting from the open to the closed position. As the hook 2*a* does this, the tooth 3*b* will push against the portion of the gasket 11*c* located in the nozzle aperture 5. As the tooth 3*b* pushes against the gasket 11*c*, pressurized color is released. As the hook 2*a* pivots back toward the open position, the tooth 3*b* will exit the aperture 5 and the cylindrical gasket 11*c* will naturally flex back to the closed position over the aperture 5 inside the nozzle 11*a* again blocking the flow of color from the aperture 5. In this manner, pressurized color may be controlled to flow onto entrained sections of hair only when the hook 2*a* brings the entrained sections to the closed position over the nozzle 11*a*.

As depicted in FIG. 1A, the applicator nozzle 11*a* features an aperture 5 as an exit for liquid hair color and a hose 12 functions as a supply line between the color container hoses and the nozzle 11*a*. The nozzle hose 12 extends upward a short distance, perpendicular to the nozzle 11*a* then turns at a right angle, extending back ending in a nozzle hose coupling 13*a*.

FIGS. 1A and 1B depict a preferred embodiment of the device involve a rack and pinion gear arrangement as mechanical means to pivot the hook 2*a*. The hook 2*a* is fixed to the distal front of an axial 9 and the rear portion of the axial 9 pivots within a gear box 6. A pinion gear 8 is fixed to the portion of the axial 9 contained within the gear box 6. A rack gear 7*a* pivots the pinion gear 8 within the gear box 6 from underneath.

Figure 8:
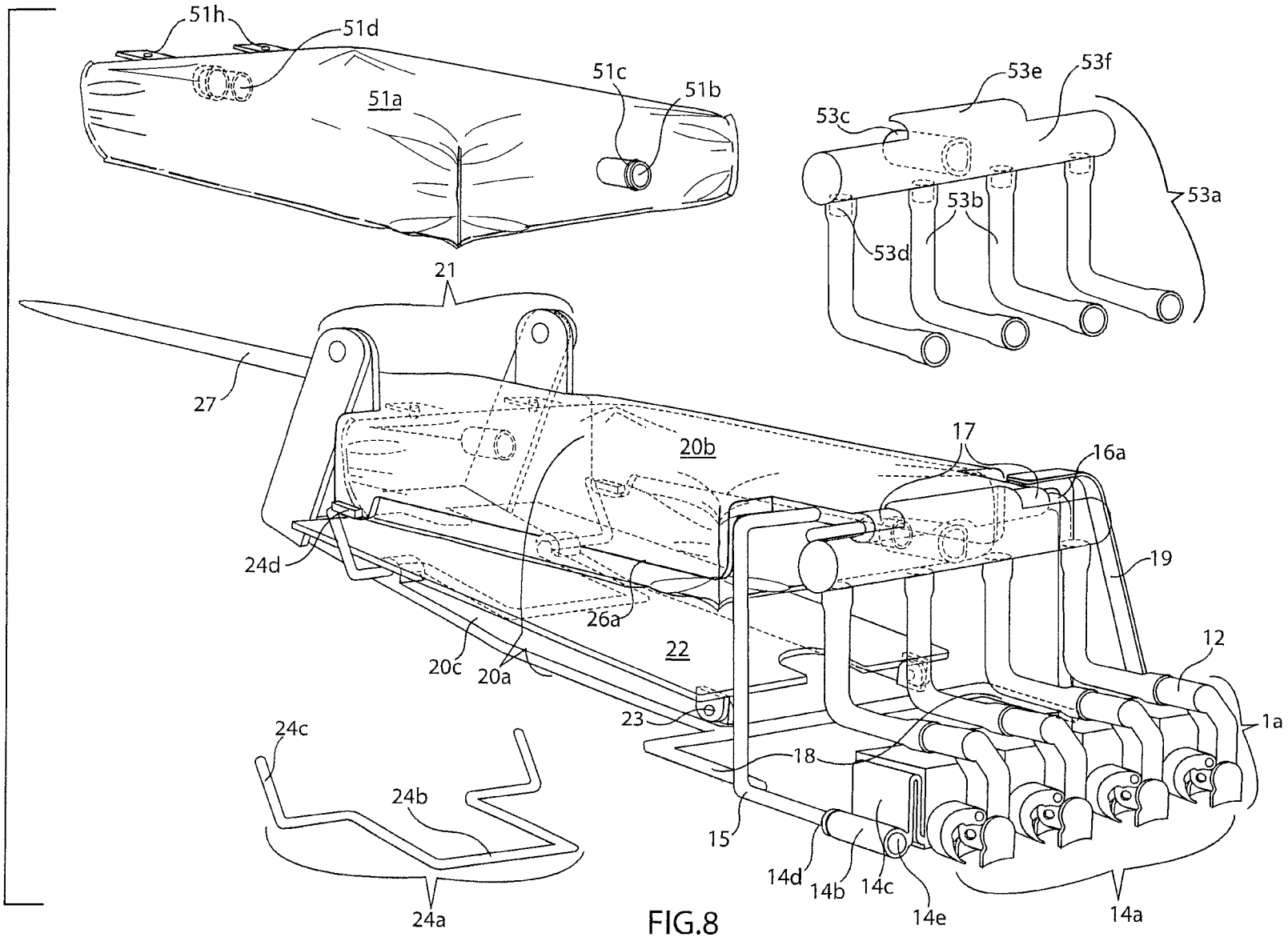
FIG. 8 is a front perspective view of the complete mechanical arrangement of the preferred embodiment. In order to provide a clearer depiction, this figure includes isolated duplicate views of three components arranged around the complete view.

As depicted in FIG. 8, the flexible head 14*a* consists of a straight row of hooking applicators 1*a* connected one to another along the bottoms of the gear boxes 6 by roller couplings 14*b*.

FIG. 8 also depicts two head mounts 15 attached to the front of the top handle section 20*b*. Each end of the head 14*a* is fixed to the distal front of each head mount 15 forming a head 14*a* attached to a handle 20*a*.

Figure 9A:
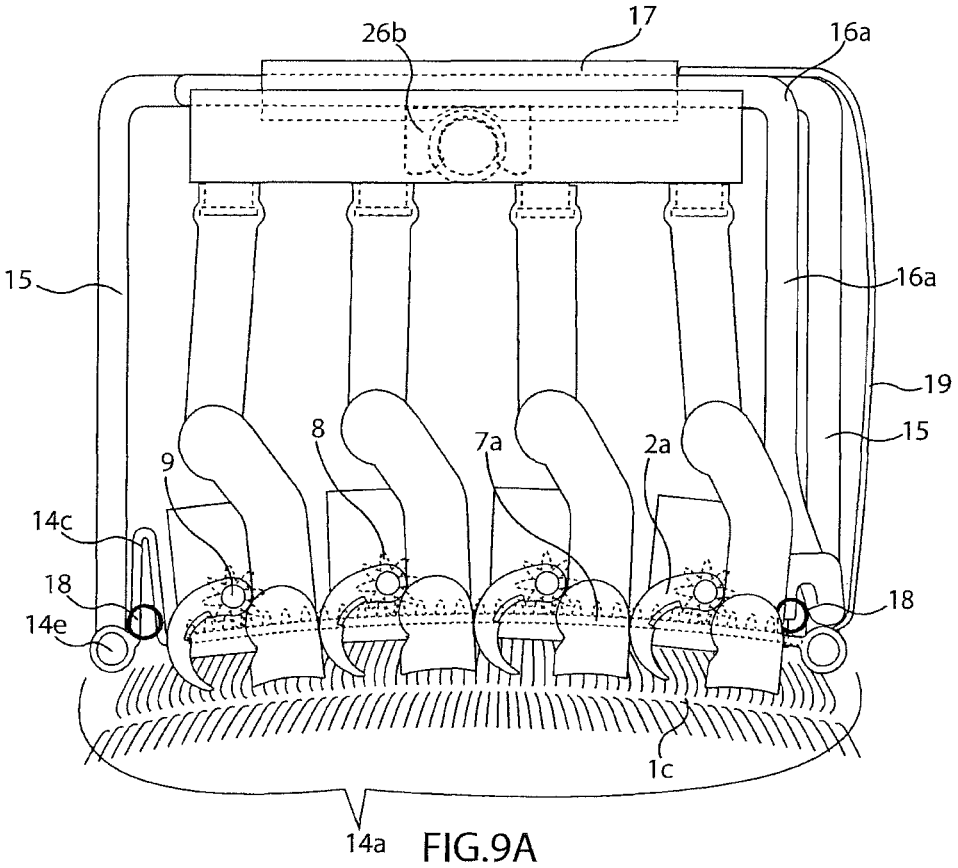
FIG. 9A is a front view of the preferred embodiment depicting, respectively, a first stage of a sequence of functional interaction of said embodiment with a parting of hair 1*c* that depicts the positions and relationships of the individual mechanisms in the first of four depicted stages of a single cycle of mechanical engagement.
Figure 9B:
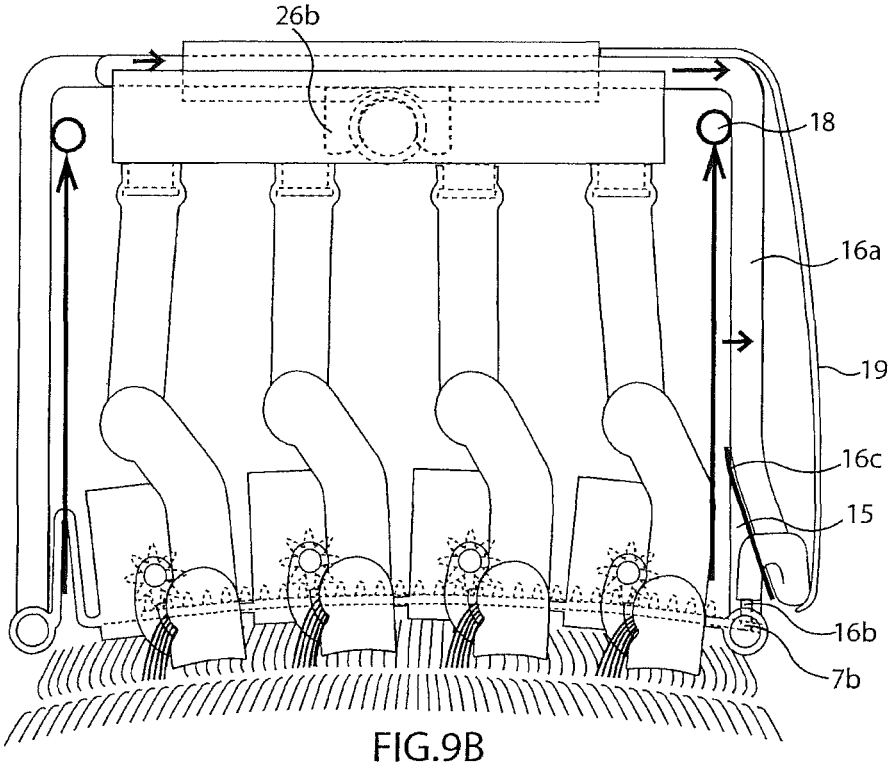
FIG. 9B is a front view of the preferred embodiment depicting, respectively, a second stage of a sequence of functional interaction of said embodiment with a parting of hair 1*c* that depicts the positions and relationships of the individual mechanisms in the second of four depicted stages of a single cycle of mechanical engagement.

FIGS. 9A and 9B depict the row of hooking applicators 1*a* sharing a single thin flexible rack gear 7*a* that extends along the inside bottom of each gear box 6 with the series of pinion gears 8 seated teeth to teeth into the rack gear 7*a*. Back and forth movement of the rack gear 7*a* causes the pinion gears 8 and therefore the axles 9 and hooks 2*a* to pivot in unison.

As seen in FIG. 9A, the head 14*a* is pressed lightly against a parting of hair 1*c* and the head 14*a* flexes into the curve of the scalp. The head 14*a* is placed against the scalp in the upright position thereby allowing each of the front foot contact points 4*b* and rear foot contact points 4*h* (not visible in FIG. 9) to make functional contact with parting of hair 1*c*.

FIG. 9A depicts the device relying on a flat spring 14*c* to allow the head 14*a* to flex. The flat spring 14*c* expands as the head 14*a* flexes into the curve of the scalp.

Figure 10A:
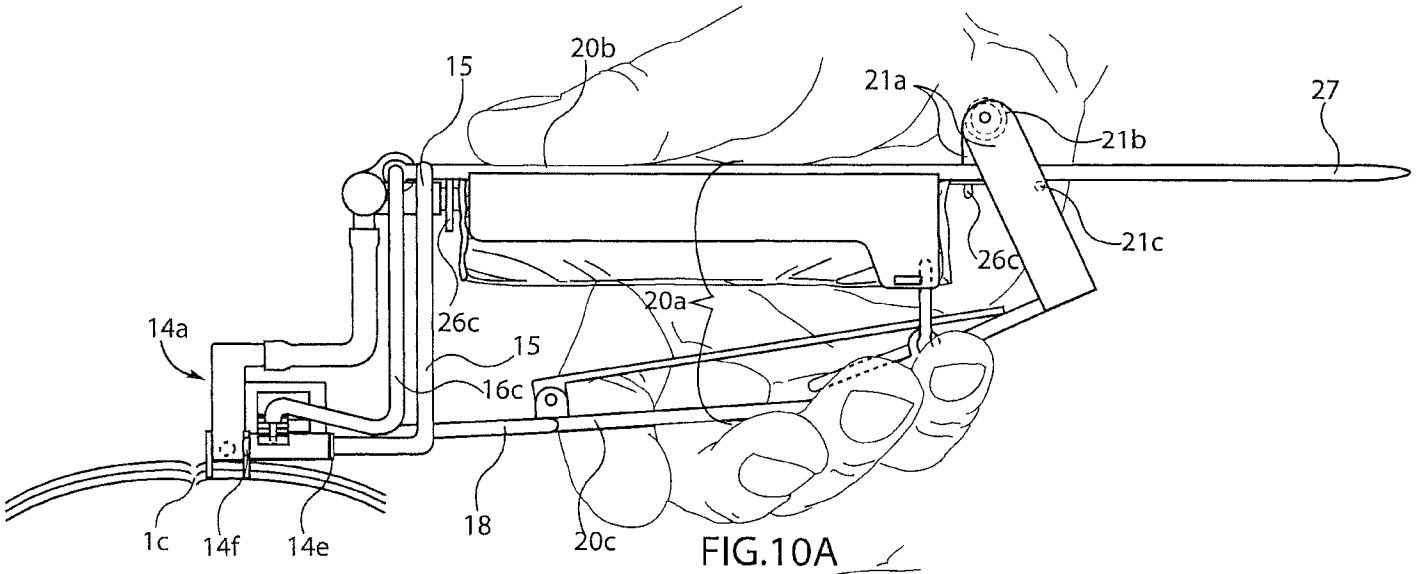
FIG. 10A is a side view of a complete assembly of the preferred embodiment depicting a sequence of functional interaction of said embodiment with a parting of hair 1*c* that illustrates the positions and relationships of the individual mechanisms in the first of four depicted stages. These four depicted stages combine to illustrate a single cycle of mechanical engagement including entrainment of hair sections and dispensing of hair color respectively. In order to demonstrate scale as well as how said embodiment may be held while in use, a hand is depicted holding said embodiment in a functional manner.

The roller coupling 14*d*, shown in FIG. 9A and FIG. 10A, is another mechanical feature to aid in the flexing ability of the head 14*a*. A roller coupling 14*d* is fixed to both ends of the head 14*a*; it is a section of tube that fits telescopically over the end of each head mount 15.

FIG. 10A depicts a lip 14*e* formed into each of the head mounts 15 at a location that is as far back from the distal end of the head mount 15 as the head 14*a* is wide. A cap 14*f* is located at the tip of each head mount 15. Each lip 14*e* and cap 14*f* prevents the roller couplings 14*d* from sliding back and forth along the ends of the head mounts 15. The inside diameter of the roller couplings 14*d* are slightly larger than the outside diameter of the cylindrical ends of the head mounts, 15 so that the roller couplings 14*d* can freely roll. As seen in FIG. 9A, each end of the head 14*a* is fixed to each of the roller couplings 14*d* and, as the head 14*a* flexes into the curve of the parting of hair 1*c*, the two hooking applicators 1*a* that are fixed to the roller couplings 14*d* are able to freely pivot over the ends of the head mounts 15. This pivoting naturally occurs when the head 14*a* flexes against the curve of the scalp and creates a smoother and more complete flexing action.

The rack slide mount 17, as viewed in FIG. 8, is a section of tube that is fixed to the front edge of the top handle section 20*b*. As viewed in FIG. 9B, one side of an upside down 'L' shaped rod or rack slide 16*a* is positioned snuggly sliding within the tube of the rack slide mount 17. The other side of the rack slide mount 17 extends straight down then bends out along the side of the head at a slight angle for a short span. The rack slide 16*a* then bends forward and finally tapers down forming the rack gear pin 16*b*. The rack gear pin 16*b* extends directly into a small hole or rack gear seat 7*b* located at the distal end of the rack gear 7*a* forming a snap-in fit between the rack gear pin 16*b* and the rack gear seat 7*b*.

In order to impart a more complete understanding of the rack slide action, it is necessary to explain in more detail the action of the handle. As seen in FIG. 10A, the handle 20*a* is composed of a top handle section 20*b*, and a bottom handle section 20*c* connected to one another at the rear of each by a handle hinge 21*a*. This salad tong type configuration is held in the open resting position by the handle hinge spring

21*b* against the handle stop 21*c*. The handle stop 21*c* is a protrusion located on the inside of the bottom handle section 20*c* of the handle hinge 21*a*. As the bottom hinge section 20*c* pivots back toward the open position, the bottom hinge section 20*c* is prevented from opening any further as the handle stop 21*c* comes into contact with the rear bottom edge of the top handle section 20*b*.

Figure 10B:
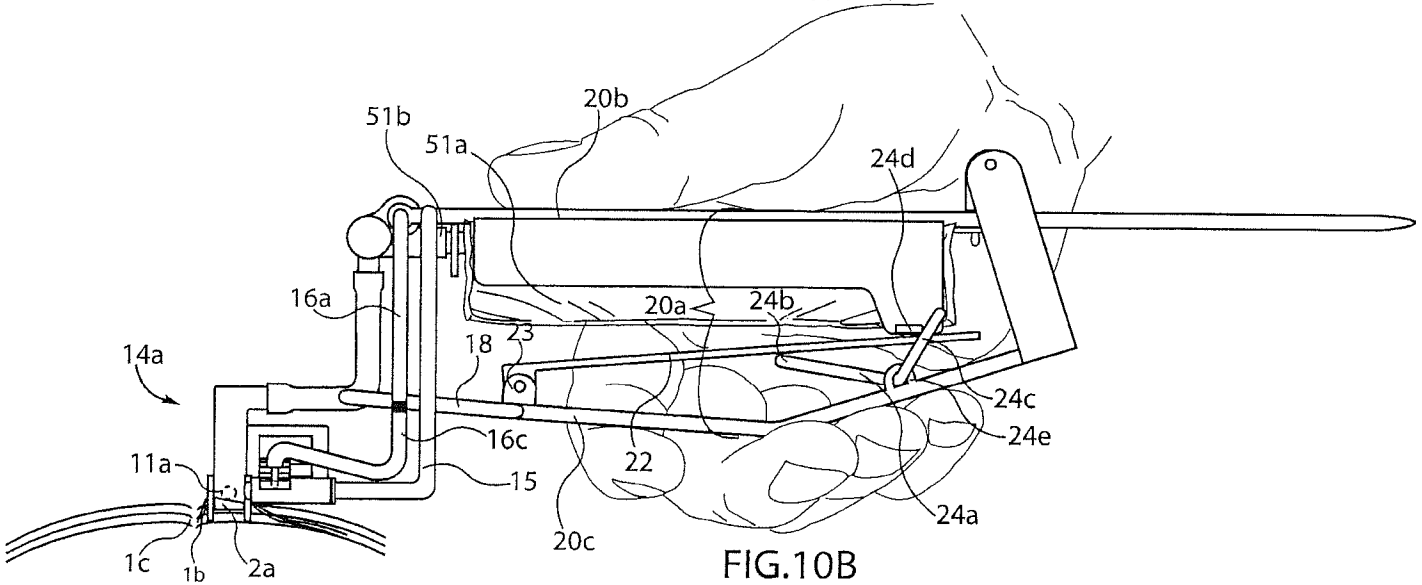
FIG. 10B is a side view of a complete assembly of the preferred embodiment depicting a sequence of functional interaction of said embodiment with a parting, of hair 1*c* that illustrates the positions and relationships of the individual mechanisms in the second of the four depicted stages.
Figure 10C:
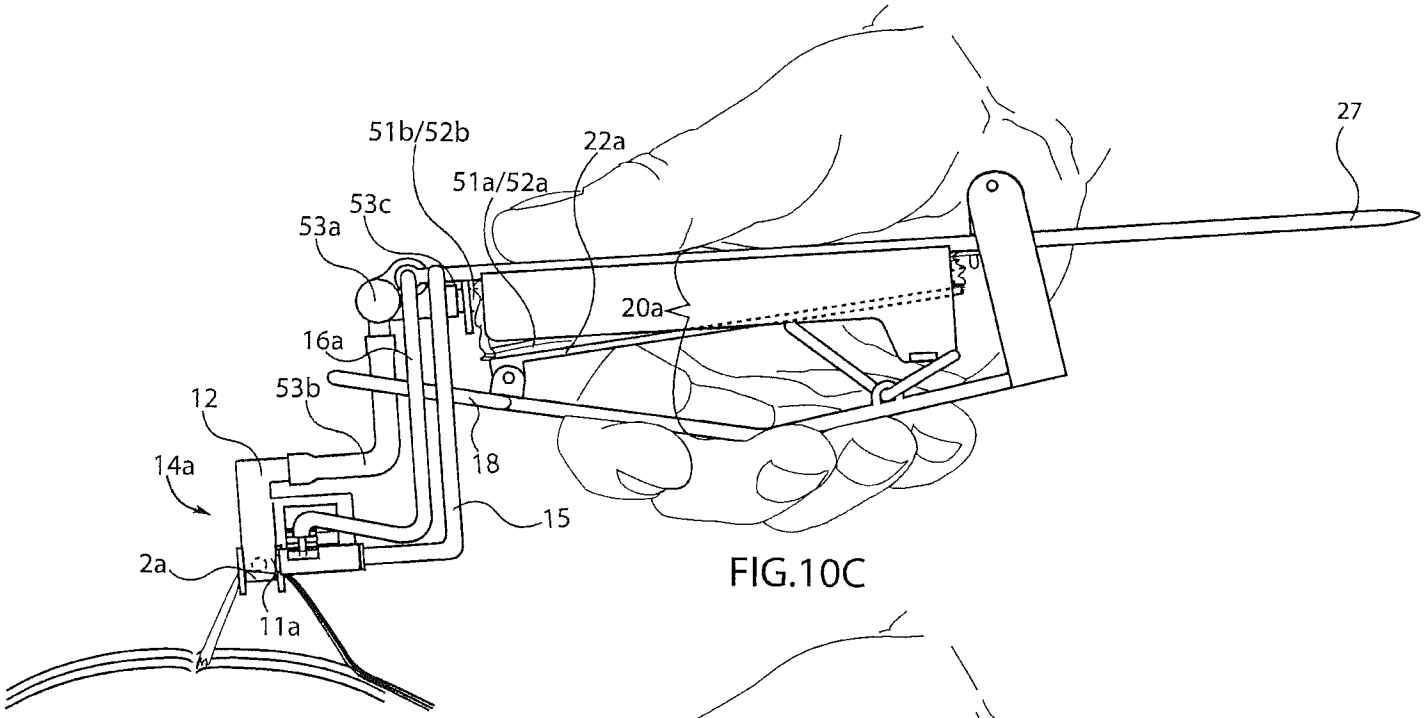
FIG. 10C is a side view of a complete assembly of the preferred embodiment depicting a sequence of functional interaction of said embodiment with a parting of hair 1*c* that illustrates the positions and relationships of the individual mechanisms in the third of the four depicted stages.
Figure 10D:
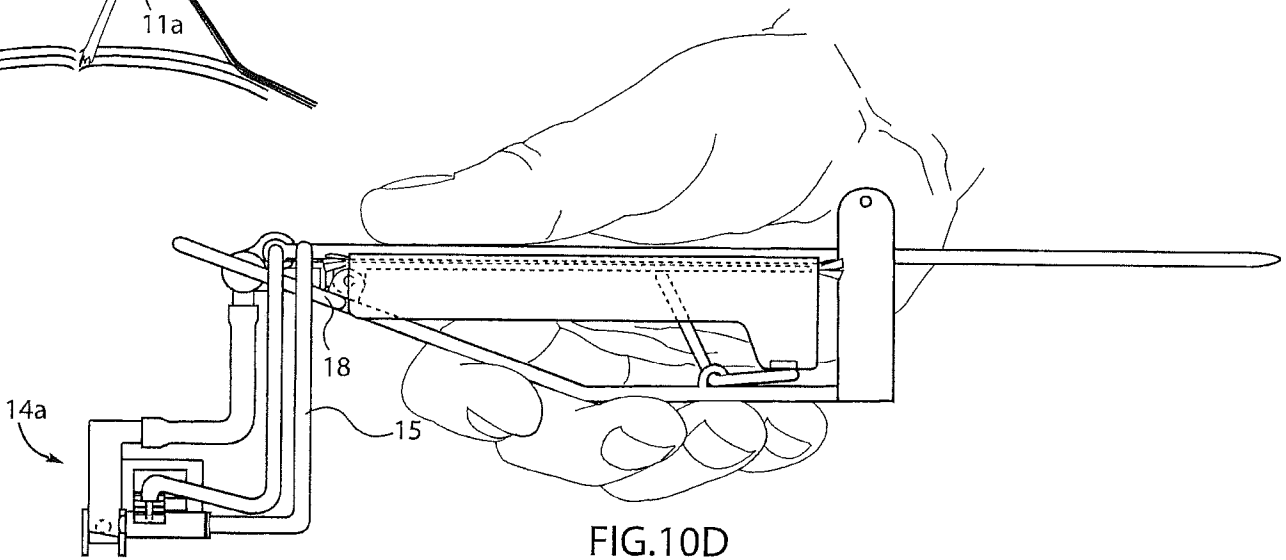
FIG. 10D is a side view of a complete assembly of the preferred embodiment depicting a sequence of functional interaction of said embodiment with a parting of hair 1*c* that illustrates the positions and relationships of the individual mechanisms in the second of the four depicted stages.

FIG. 10A-10D are side views of the hand of an operator squeezing the handle 20*a* of the device from the open position FIG. 10A to the closed position FIG. 10D with FIGS. 10B and 10C representing middle handle positions. With the device depicted in FIGS. 10A-10D shown appropriately positioned against a parting of hair 1*c*, one will notice as one views these illustrations in sequence that the top handle section 20*b* (along with the attached head mounts 15 and head 14*a*) remains stationary against a parting of hair 1*c* while the bottom handle section 20*c* is the pivotal section. As such, one will notice, while again viewing these figures in sequence, the visible actuator tine 18 (which is attached to the bottom handle section 20*c*) sliding from the bottom to the top of the head mount 15 and rack slide 16*a*.

Having established a more complete understanding of the role of the handle as it pertains to the sliding action of the actuator tines against the head mount and rack slide, one may now refer to FIG. 8. The rack slide actuator tines 18 consist of two rods extending forward from the front edge of the bottom handle section 20*c*. The tines 18 are positioned between the bottoms of the head mounts 15. The distance between the tine ends 18 is such that the tine 18 on the left is in contact with the left head mount 15 and the tine on the right 18 is in contact with the right head mount 15 as well as the rack slide 16*a*. (Refer to FIGS. 9A and 9B for the remainder of the paragraph.) With the actuator tines 18 in this position, squeezing the handle 20*a* will cause the tine 18 on the left to slide upward against the inside of the left head mount 15, and the tine 18 on the right to simultaneously slide upward against the right head mount as well as the inside of the rack slide 16*a*. As the bottom of the rack slide 16*a* is angled outward (see bold line 16*c*), the upward sliding motion of the right tine 18 against the angled section of the rack slide 16*c* causes the rack slide 16*a* to move outward stabilized by the rack slide mount 17 and head mounts 15 (see FIG. 10B). As the bottom end of the rack slide 16*a* is attached to the rack gear 7*a* by the rack gear pin 16*b*, the outward sliding motion of the rack slide 16*a* causes the rack gear 7*a* to move to the side. The rack gear 7*a* sliding to the left in this manner causes the hooks 2*a* to pivot toward the closed position over the applicator nozzles 11*a*. In this manner, when the right actuator tine 18 is in contact with the bottom of the rack slide angle 16*c*, the hooks 2*a* are in the open position (see FIG. 9A). Squeezing the handle until the right tine 18 is at the top of the rack slide angle 16*c* causes the hooks 2*a* to move to the closed position (see FIG. 9B). Releasing the handle will cause the rack slide 16*a* to return to the inward most resting position against the tension of the rack slide spring 19. The action caused by a continued squeeze of the handle 20*a* bringing the actuator tines 18 past the top of the rack slide angle 16*c* will be described later in this disclosure.

The bottom handle section 20*c* (see FIG. 8) employing only a single tine 18 on the right side against the rack slide 16*a* may also be employed as an alternative embodiment.

As described in the summary, the present invention features a single squeeze mechanism capable of, in series, entraining the hair and dispensing the liquid hair color onto entrained sections of hair. As described above, engagement of the hooks occurs during the first increment of the squeeze action applied to the handle. The second increment of squeeze action pivots the lever 24*a* so that it pushes up on the level pallet 22. (See FIG. 8 for a detailed perspective view of the level pallet 22 and lever 24*a*). As both the level pallet 22 and lever 24*a* are hinged to the top of the bottom handle section 20*c*, the upward motion of the bottom handle section 20*c* toward the top handle 20*b* section, combined with the mechanical action of the level pallet 22 and lever 24*a* facilitates the movement of the liquid hair color out of the color container 51*a* and through the channels that direct the color onto the entrained sections of hair The following is a detailed description of the second in series mechanical action (dispensing of the hair color) and how this action coordinates with the first action (entraining of hair sections) as the device is in use. The mechanical action will be described while referring to FIGS. 10A-10B. (Note: FIGS. 10A-10B depict side views of the preferred embodiment of the device depicted in FIG. 8.)

As seen in FIG. 10A, an operator functionally holds the device by the handle 20*a* as the device is in the resting position and places the head 14*a* of the device appropriately against a parting of hair 1*c*.

As seen in FIG. 10B, the operator squeezes the handle 20*a* causing the bottom handle section 20*c* to lift toward the top handle section 20*b*. Consequently, the tine 18 that is against the rack slide 16*a* moves upward to the top most point of the rack slide angle 16*c* (this point on the rack slide 16*a* appears as a bold square). This causes the hooks 2*a* to be in the closed position over the applicator nozzles 11*a* with entrained stalks of hair 1*b* between. The lifting action of the bottom handle section 20*c* toward the top handle section 20*b* also causes the button contact point 24*c* of the lever 24*a* to contact the lever button 24*d*. This contact causes the lever 24*a* to pivot on the lever hinge 24*e*, thereby, pushing the level pallet contact point 24*b* of the lever 24*a* against the bottom of the level pallet 22. This, in turn, causes the level pallet 22 to lift toward the bottom of the color container 51*a*.

FIG. 10C depicts the handle 20*a* having been squeezed to the point where the actuator tine 18 begins to slide along the section of the rack slide 16*a* that is parallel to the head mount 15. This allows the hooks 2*a* to remain in the closed position while the level pallet 22 comes into contact with and pushes up on the bottom of the color container 51*a*. The pressure of the level pallet 22 on the color container 51*a* causes the liquid color to begin to move from the color container 51*a* through the color container neck 52*b* and into the manifold intake 53*c*. Continuing through the manifold 53*a*, the liquid color flows through the manifold hoses 53*b*, into the nozzle hoses 12 and nozzles 11*a* and through the color aperture 5 onto the entrained section of hair 1*b*.

Figure 9C:
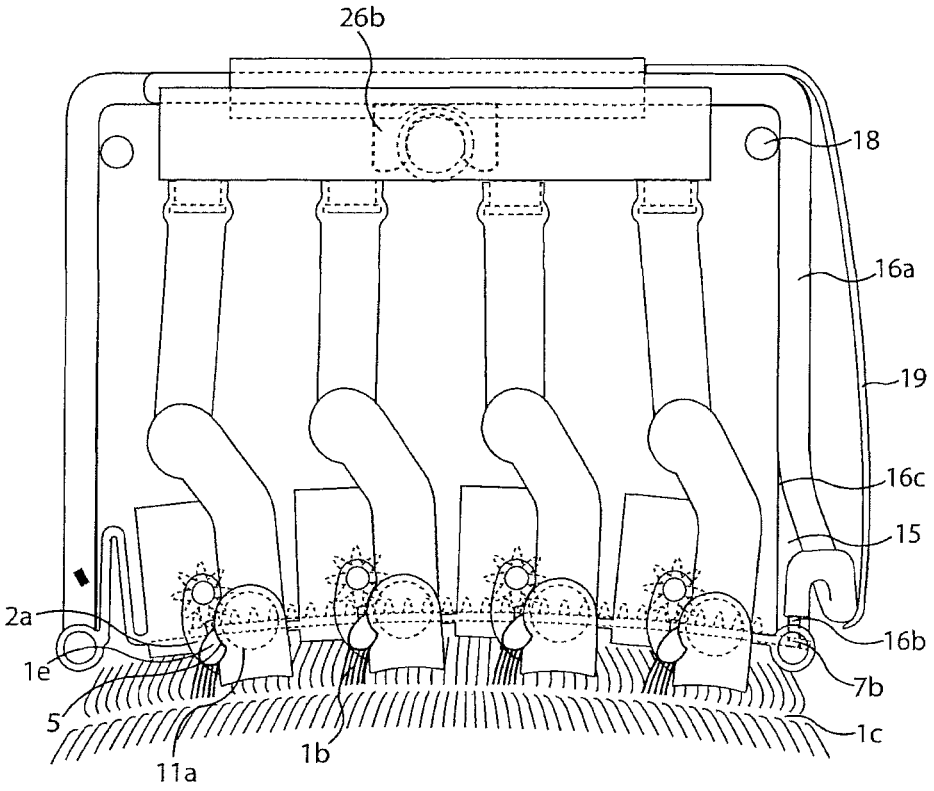
FIG. 9C is a front view of the preferred embodiment depicting, respectively, a third stage of a sequence of functional interaction of said embodiment with a parting of hair 1*c* that depicts the positions and relationships of the individual mechanisms in the third of four depicted stages of a single cycle of mechanical engagement.
Figure 9D:
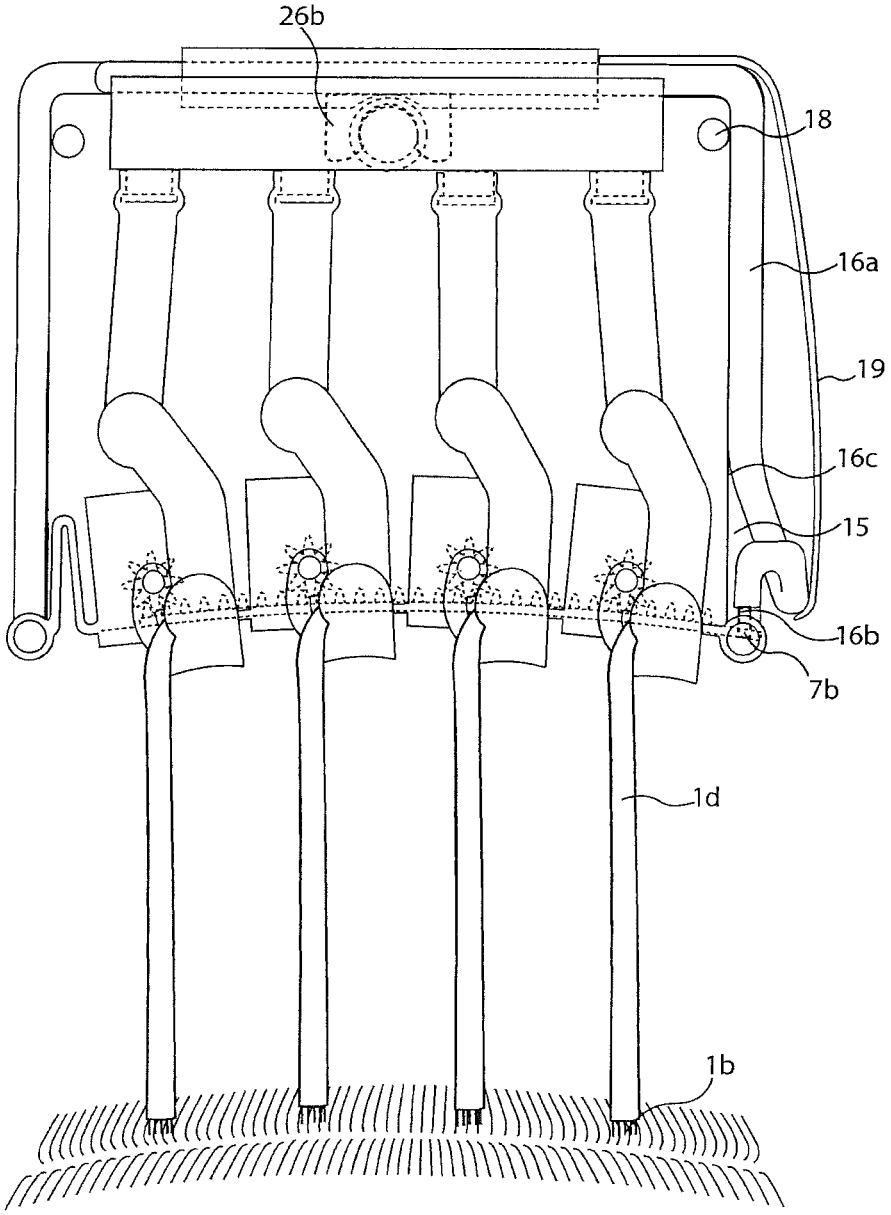
FIG. 9D is a front view of the preferred embodiment depicting, respectively, a fourth stage of a sequence of functional interaction of said embodiment with a parting of hair 1*c* that depicts the positions and relationships of the individual mechanisms in the fourth of four depicted stages of a single cycle of mechanical engagement.

The operator will continue to apply light squeeze pressure to the handle 20*a* while watching for a small bead of color 1*e* to simultaneously form at the front of each hook (see FIG. 9C). When she sees these color beads 1*e* form she will know that the hair color has exited each nozzle 11*a* aperture 5 and has surrounded the portion of each entrained section 1*b* that is within the closed position. The moment she sees the beads of color 1*e* form, she will maintain the same pressure while slowly pulling the device away from the parting of hair 1*c*. As depicted in FIG. 9D, she pulls the device away from the parting 1*c*, the constant light pressure on the handle will evenly surround the entrained sections 1*b* with hair color 1*d* as the entrained sections 1*d* pass through the closed position.

Once the operator has sufficiently coated the entrained sections of hair, she will generally proceed one of two ways: she can release pressure on the handle allowing the device to return to the resting position depicted in FIG. 10A; this approach allows the coated sections to drop back into the hair. The other option is to release the handle 20*a* only to the point where hair color stops dispensing while maintaining the entrained sections in the closed position. This occurs as the handle 20*a* is released enough for the level pallet 22 to release from the bottom of the color container 51*a* but not enough for the actuator tine 18 to slide down beyond the top of the rack slide angle 16*c*; this mechanical position is depicted in FIG. 10B (The top of the rack slide angle is depicted as a solid black square located on the rack slide). (The following description of barrier material application does not include correspondent drawings.) At this point, the entrained and coated sections are in a taut and stationary position, extending between the head of the recipient and the head of the device. The operator, while maintaining the entrained sections in this position, and having a free hand, may pick up a folded section of barrier sheet and place it over the entrained sections or perhaps place a section of cotton under the section close to the scalp; any number of barrier material types and techniques known by a person skilled in the art may be applied at this time followed by a controlled release of the barrier treated section into the rest of the hair. Finally, the operator may trace the tip of the parting stem 27 along the scalp, exposing the next parting of hair to be serviced and thereby beginning a new pass of the device along the recipient's hair (see FIG. 10A for the parting stem 27). A pass of the device through a recipient's hair, such as the entire pass described above, may be repeated the number of times deemed appropriate by the operator or until the point at which the upward motion of the level pallet 22 onto the color container 51*a* is interrupted by becoming flatly parallel and directly adjacent to the top of the color container housing 26, thereby flattening and emptying the color container 51*a* (see FIG. 10D). The color container 51*a* may then be refilled or replaced.

The following is a description of two types of disposable color containers. These color containers are pre-filled (preferably by a manufacturer), loaded into the device and are discarded when empty.

Figure 11A:
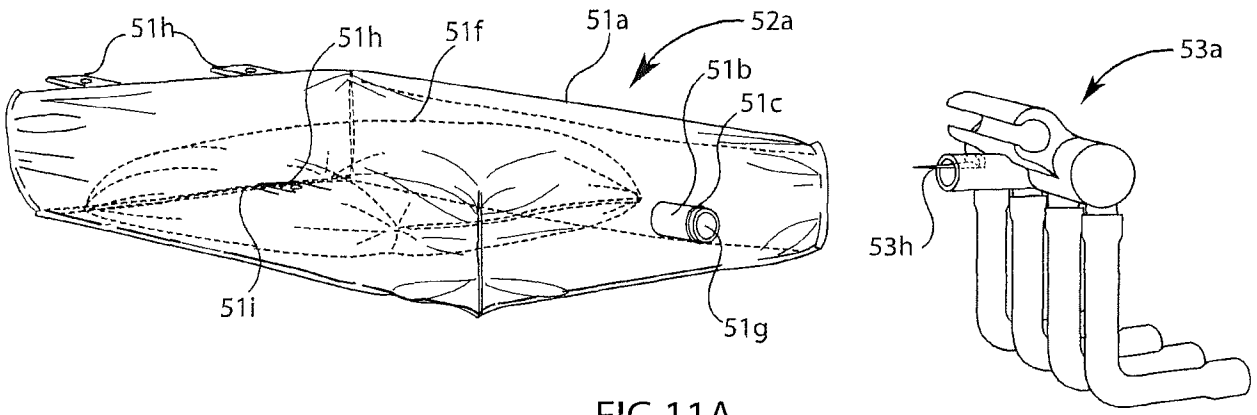
FIG. 11A is a perspective side views of a first embodiment of the color container and manifold hose system featured in the preferred embodiment depicted in FIG. 8.

Pre-packaged color containers that dispense two part oxidative color or lightener must include a means by which the two reactive components remain separate inside the container until just prior to use. FIG. 11A depicts an internal container 51*f* within an external container 52*e*, with each container accommodating one of the two hair color components. The internal container 51*f* is filled to capacity so that it is firm. The external container 52*e* is filled but not firm. In addition to the difference in firmness between the two containers, the internal container 51*f* is intentionally manufactured with a structurally weaker front seam and/or weaker plastic film than the external container 52*e*. The difference in firmness in addition to the weak film allows the operator to moderately squeeze this dual container causing the internal container 51*f* to rupture. This rupture releases the color component within, into the other color component contained within the external container 52*e*. The operator will briefly kneed the dual container thereby fully mixing the two color components. Also, the rear bottom seam 511 of the external container 52*e* and the rear seam 511 of the internal container 51*f* are sealed together so that the internal container 51*f* does not float around freely inside the external container 52*e* giving the internal container 51*f* the opportunity to move forward and block the manifold port 51*b* of the external color container 52*e* from the inside. This dual container 52*e*, 51*f* may be discarded once it is empty and replaced by a pre-filled dual container 52*e*, 51*f*. For convenience, the manifold port 51*b* may feature a puncture seal 51*g* adhered to the front. In order to accompany the puncture seal 51*g*, a puncture spike 53*h* will be affixed to the manifold intake 53*c*. This puncture feature allows the operator to mix the components without mess, opening the manifold port 51*b* only at the point where it engages the manifold intake 53*c*.

Figure 11B:
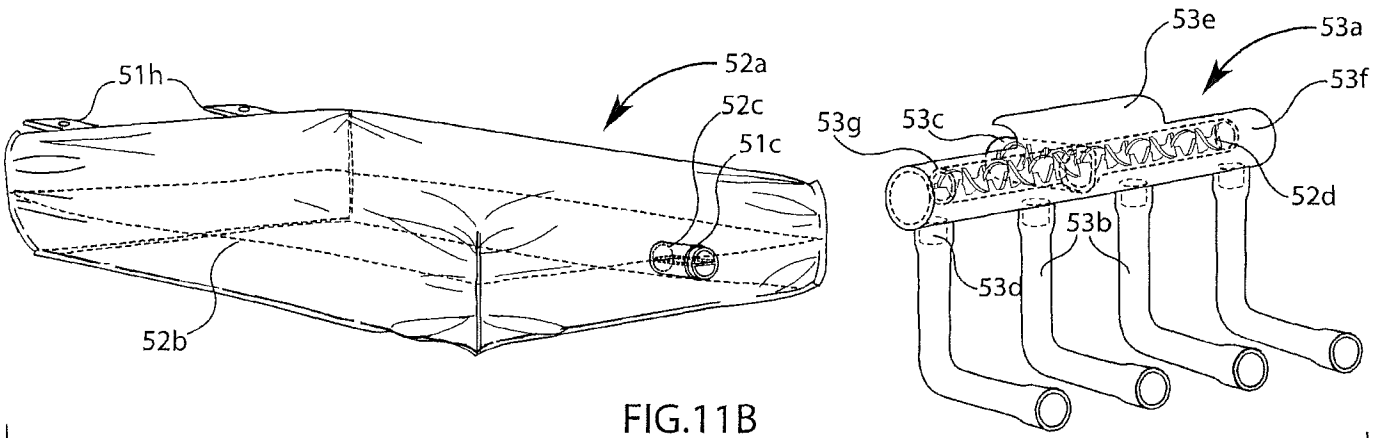
FIG. 11B is a perspective side views of a second embodiment of the color container and manifold hose system featured in the preferred embodiment depicted in FIG. 8.

FIG. 11B depicts another preferred dual color container embodiment 52*a*; the purpose of which is to keep the two components of the liquid hair color separate until the two components exit the color container 52*a*. The two (2) components of the liquid hair color are of equal texture and viscosity and are kept separate within the dual color container 52*a* by a barrier 52*b*. The barrier 52*b* essentially forms two separate color containers of equal volume arranged flatly against one another. Each side of the divided color container 52*a* opens to each side of the dual manifold port 52*c*.

When pressure is applied to this dual color container 52*a*, both hair color components enter each side of the dual manifold port 52*c*. The two components then enter the manifold intake 53*c* where they pass through a section of helical static mixer 52*d* and begin to mix. The partially mixed color then enters the inner tube 53*g* of the manifold 53*a*. The color is further mixed as it passes through the inner manifold tube 53*g* as it also contains a section of static mixer 52*d*. Fully mixed color now exits both ends of the inner manifold tube 53*g* and enters the main outer manifold tube 53*f*, then the nozzle hoses 53*b* and finally exits the nozzle aperture 5. The operator will proceed with the color service as described previously.

The following describes the process of reloading the device with color as well as cleaning the various color channels of the device.

A color container featuring a refill port 51*d* (as seen in FIG. 8) will not need to be disassembled and can be refilled using a syringe or baster type mixing container with a hollow dispensing stem. The operator mixes the two components of the hair color in the reservoir of the mixing container, secures the lid over the reservoir and injects the mixed color into the color container 51*a* through the refill port 51*d*. Having completed this stage of refilling, the operator secures the lid 51*e* onto the refill port 51*d*.

Pre-packaged color containers will need to be removed from the device when empty and replaced with one that is full. The following example will be described with a single chamber color container 51*a* (see FIG. 8), although a dual chamber color container 52*a* could be used for the explanation as well. In order to do this, the operator will release the back of the color container 51*a* from the back of the color container housing 26*a* by disengaging the fastening tabs 51*h* from the fastening pins 26*c* (see FIG. 8 and FIG. 10A). She will then disengage the manifold mounting bracket 53*e* from the rack slide mount 17, remove the manifold intake 53*c* from the manifold port 51*b* of the color container 51*a* (see FIG. 8), bend the manifold 53*a* forward which will disengage the manifold intake 53*c* from the manifold port 51*b* of the color container 51*a*. She will then disengage the manifold port 51*b* of the color container 51*a* from the manifold port bracket 26*b* (see FIGS. 9A and 10A) She will then be able to pull the empty color container 51*a* out from the color container housing 26*a*. With the manifold 53*a* still bent forward on the flexibility of the manifold hoses 53*b*, thereby exposing the frontal opening to the color container housing 26*a*, she will then slide a full and sealed color container 51*a* into the opening until the full length of the color container 51*a* occupies the full length of the color container housing 26*a*. Then she will push the manifold port 51*b* of the color container 51*a* onto the manifold port bracket 26*b* in order to secure this port 26*b* as well as the front of the color container 51*a* onto the front of the color container housing 26*a*. Next she will push the fastening tabs 51*h* onto the tab pins 26*c* thereby securing the back of the color container 51*a* to the back of the color container housing 26*a*. Finally, she will urge the manifold intake 53*c* onto the manifold port 51*b* and snap the manifold mounting bracket 53*e* onto the rack slide mount 17.

Having refilled the color container 51*a* or, having exchanging an empty single color container 51*a* or dual color container 52*a* with a full one, the operator will now prime the device by squeezing the handle 20*a* until the color exits all of the nozzle 11*a* apertures 5 (See FIGS. 10A-10B and 9C). The first squeeze with a new color container 51*a*, may cause some color to exit some apertures 5 before others; therefore, the operator will perform this operation over a cleanable surface, paper towel, sink, etc. as the hair color may drip, out of some of the nozzles 11*a* until color is exiting all nozzles 11*a*. The operator will simply wipe the excess color from the nozzles 11*a* with a paper or cloth towel and proceed with the color service.

In order to minimize the overall number of drawings in this disclosure, the following description of the cleaning procedure does not have supporting illustrations. Refer to FIG. 8 for an approximation.

In order for the operator to clean the refillable color container 51*a* and manifold 53*a*, she will disengage the color container 51*a* as described above, cap 51*e* the refill port 51*d*, inject water or cleaning fluid into the color container 51*a* through the manifold port 51*b* and place a finger over the manifold port 51*b*. Then she shakes and kneads the color container 51*a* and pours the liquid out of the refill port 51*d* and/or manifold port 51*b*. She will repeat this step until the container 51*a* is clean. In order to clean the manifold 53*a* and nozzles 11*a* she simply engages the color container 51*a* into the device following the reload procedure described earlier, and then fills the container 51*a* through the refill port 51*d* and places the cap 51*e* over the port 51*d* and squeezes the handle 20*a*. Water will jet out of the nozzle 11*a* apertures 5 thereby cleaning the nozzles 11*a* and nozzle hoses 12 as well as all of the hoses and channels of the manifold 53*a*. She may also insert a slender cleaning implement into the various hoses, ports and nozzles during the cleaning procedure.

Although an operator may rely on disposable color containers 51*a* for regular use, it is advisable for the operator to have a refillable container 51*a* available to fill with water or cleaning fluid in order to utilize the cleaning method just described.

Other types of color containers may be employed in the device such as a caulk gun type or syringe type arrangement. Also the varied types of containers may be compressed manually, compressed using an electric motor or the color may be dispensed by means of a color container that is under pressure.

The color containers 51*a*, 52*a* (see FIGS. 8, 11A and 11B) are preferably formed from polyethylene, polypropylene or other type of liquid proof and chemical resistant flexible and easily sealable film. The main tube of the manifold 53*f* (along with the hose couplings 53*d* that are molded into it) is preferably molded from one of a variety of liquid chemical resistant plastic material while the hoses 53*b* may be formed from one of several types of liquid chemical resistant rubber or silicone tubing. The hoses 53*b* may be glued or clamped to the manifold couplings 53*d*; or, all of the couplings 53*d* may be barbed allowing the hoses 53*b* to be removed from the coupling 53*d* yet, attach firmly when in use. The sections of static tube mixer 52*d* will also preferably be of the chemically resistant plastic variety and may be a separate part or formed directly into the inside geometry of the manifold 53*a*. Separate static tube mixers 52*d* may be removable through a threaded cap located on one or both ends of the main manifold tube 53*f*. Removable static tube mixers 52*d* and/or threaded access caps located on the ends of the main manifold tube 53*f* are features that make the manifold 53*a* easier to clean. Also, the sections of static tube mixer 52*d* may also be located within the manifold hoses 52*b*. Alternatively, the entire geometry of the non-mixing manifold 53*a*, including the hoses 53*b* and manifold intake 53*c* may be molded as one part from a liquid chemical resistant rubber or silicone.

When considering the functionality of the manifold 53*a*, notice the L-shaped manifold hose 53*b*. This L-shape provides a corner that acts as a weak leverage point and allows the pressurized liquid filled hose 53*b* to bend easily as the head 14*a* of the device conforms to the curve of the scalp.

Another unique feature of the device is a mechanical arrangement that gives the operator the ability to stop the flow of color to individual applicator nozzles while allowing other applicator nozzles to flow. The mechanism effectively pinches a hose closed with the push of a lever.

Figure 12A:
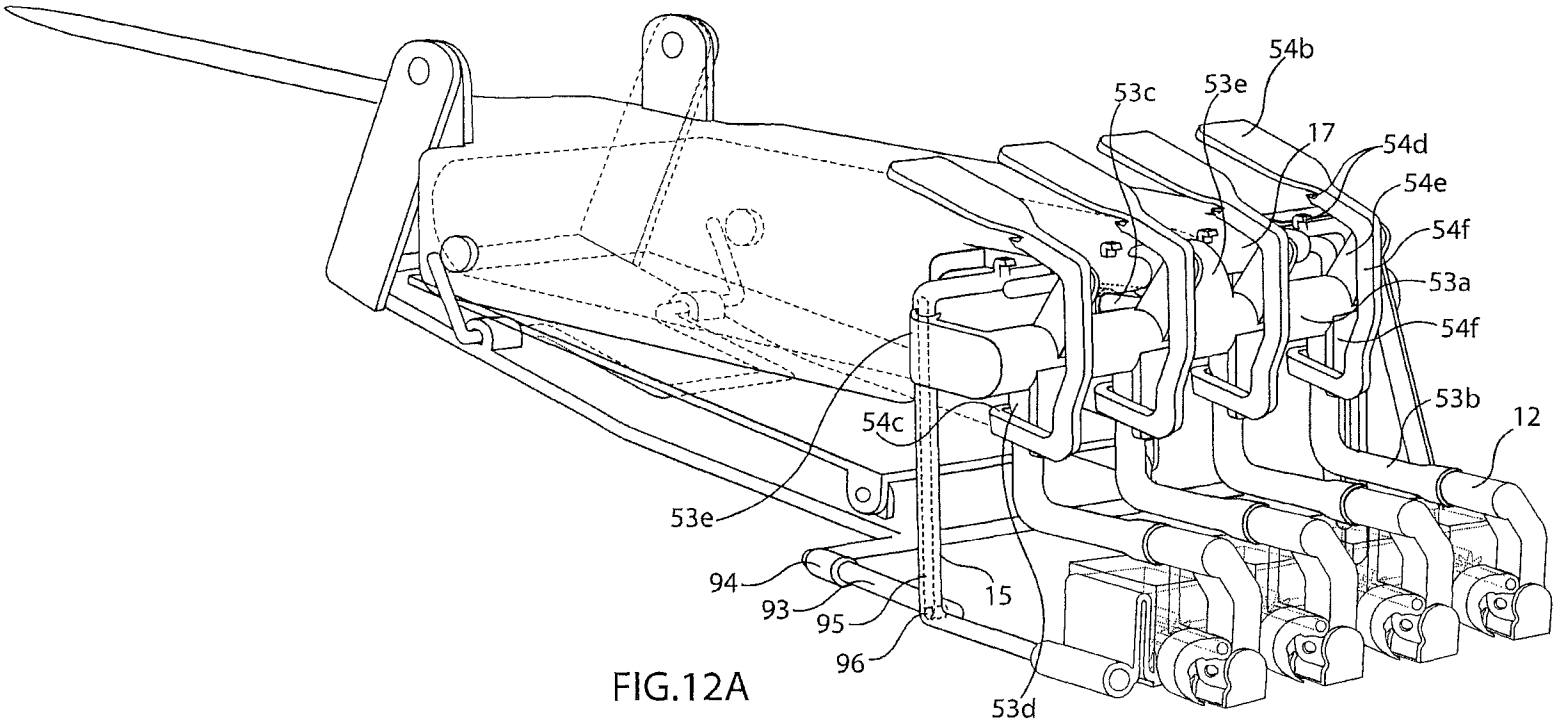
FIG. 12A is a front perspective view of a complete assembly of the preferred embodiment depicted in FIG. 8 including additional mechanical functions located at the front of the device. One additional mechanism depicted allows the operator to interrupt the flow of liquid color to one or more hoses along the manifold while allowing flow to others. The second of said functions allows the slide actuator tine/tines 93 to slide telescopically within the slide tine seat 94.
Figure 12C:
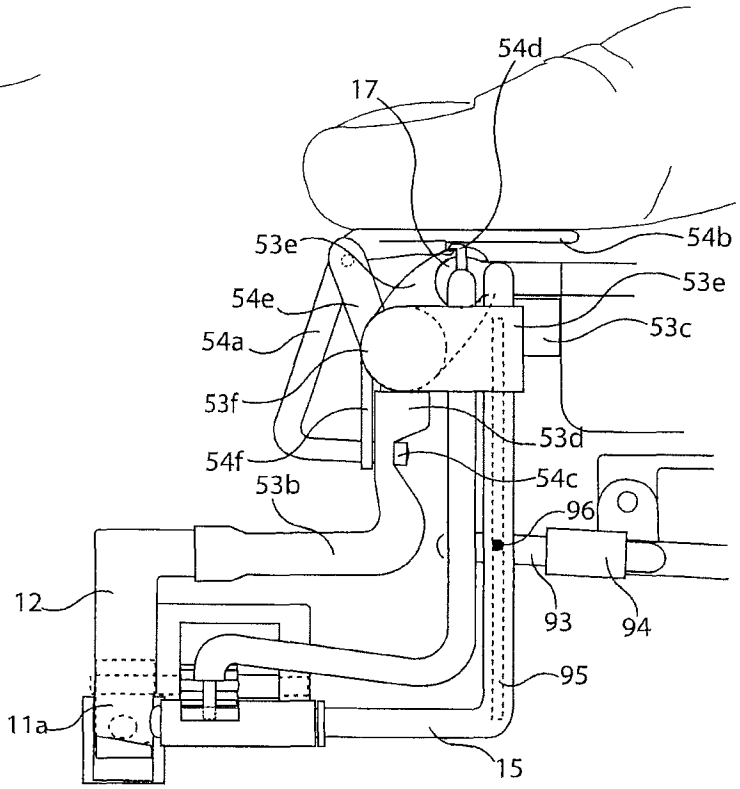
FIG. 12C is a side view of another an additional mechanical function depicted in FIG. 12A.
Figure 12B:
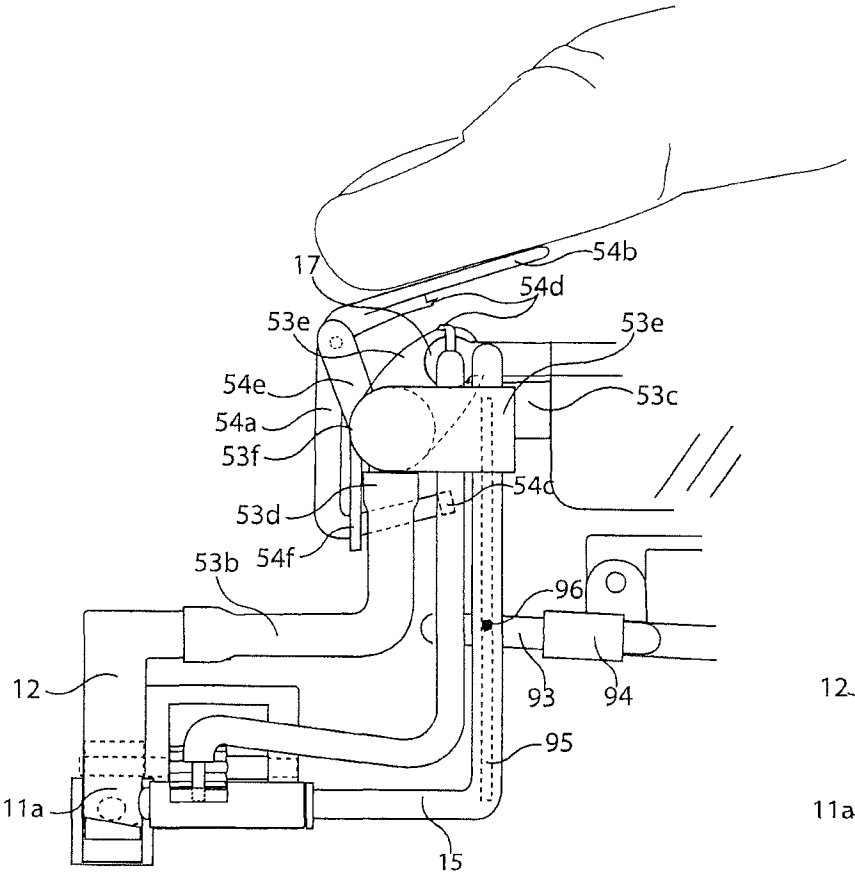
FIG. 12B is a side view of the one additional mechanical function depicted in FIG. 12A. These views illustrate the relative positions of the individual mechanisms involved in each of said additional mechanical functions as the mechanisms appear in the disengaged and engaged positions respectively.

As seen in FIG. 12A-12C, each end of the rigid plastic manifold tube 53*f* is detachably affixed against the top of each of the head mounts 15 by a manifold mounting bracket 531; one additional manifold mounting bracket 53*e* extends from the top center of the main manifold tube 53*f* and attaches to the rack slide mount 17. Fixed along the length of the manifold tube 53*f* are several short lengths of rigid tube that function as couplings 53*d* for the lengths of hose 53*b* that extend away from the manifold tube 53*f*. Fixed to the front of the manifold tube 53*f* are clamp lever mounting brackets 54*e*; one above each of the hose couplings 53*d*. Attached pivotal to each of the lever mounting brackets 54*e* is a clamp lever 54*a*. The top of the clamp lever 54*a* extends back across the top front of the handle a short distance and at a slight angle while in the resting position. This top section of the clamp lever 54*a* is flat and serves as a thumb contact 54*b*. The bottom section of the clamp lever 54*a* extends straight down to a point just below the bottom of the hose couplings 53*d*. At this point the clamp lever 54*a* makes a sharp angle back to a point where it has extended slightly behind the bottom of the hose coupling 53*d*. Now this bottom end of the clamp lever 54*a* makes a final sharp turn and crosses the back of the hose slightly below the hose coupling 53*d* forming the clamp lever hose contact 54*c*. This being the shape of the clamp lever 54*a*, when an operator places a thumb onto the thumb contact 54*b* and presses down, the bottom of the clamp lever hose contact 54 moves forward against the hose 53*b* just below the point where the hose 53*b* attaches to the coupling 53*d*. As the operator continues to press on the thumb contact 54*b*, the clamp lever hose contact 54*c* pinches the hose 53*b* forward against the pinch plate 54*f* thereby stopping the flow of color through that hose 53*b* (see FIGS. 12B and 12C side views depicting the hose clamping mechanism in the disengaged and engaged positions respectively). Once the operator presses the thumb contact 54*b* down to the farthest point, two interlocking hooks 54*d*, one on the bottom of the thumb contact 54*b* and one on the front top of the head mount 15, will lock together thereby holding the clamp lever 54*a* in the hose pinching position. The operator simply needs to move the thumb contact slightly to the side and the clamp lever lock 54*d* disengages restoring color flow to the tube 53*b*.

FIGS. 12A-12C depict a necessary variation of the actuator tines. Since it is chosen, although not necessary, to have all of the parts of the present hose clamping mechanism built onto and around the manifold in such a manner that the manifold in the present embodiment sits lower on the head mounts than in similar embodiments described; including the actuator tines, as they have previously been arranged, into the present embodiment will cause the actuator tines to run into the manifold before they have a chance to slide the functionally necessary distance up the length of the head mounts and rack slide. Therefore, depicted here are telescopic actuator tines. As viewed in FIG. 12A, the slide tine on the other side of the device, although not visible, will have all of the features of the visible slide actuator tine described in the following:

The rear end of the slide actuator tine 93 is within in a slide tine seat 94. The front end of the slide actuator tine 93 has, fixed and extending away perpendicular to the outside, a slide actuator tine channel pin 96. This channel pin 96 is seated within a channel 95 formed into the head mount 15; said channel 95 extends the entire length of said head mount 15 and is open to the inside.

The bottom handle section 20*c*, as well as the slide tine seat 94 that is fixed to it, as seen in FIG. 12B, are farther away than said parts of FIG. 12C. As the front of the bottom handle section 20*c* moves closer to the top handle section 20*b*, the front of the bottom handle section 20*c* also moves closer to the head mounts 15. This is why fixed actuator tines eventually run into the main manifold tube. The sliding actuator tine 93 overcomes this problem. FIG. 12B shows the front of the slide tine 93, with the fixed channel pin 96 seated inside the tine channel 95, (the channel pin 96 is seen as a bold dot) fully extended from the tine seat 94. FIG. 12C shows that, as the bottom handle section 20*c* moves up and gets closer to the head mounts 15, the tine channel pin 96 follows the tine channel 95 and causes the tine seat 94 to move forward over the slide tine 93. This arrangement allows the front of the tine 93 to track the length of the head mount 15 thereby remaining in the same position relative to it.

This novel actuator tine arrangement may be included in any embodiment of the device that requires actuator tines.

Another multi-hooking mechanism device embodiment of the device allows the hooking mechanisms to be positioned closer together than the multi-hooking mechanism device embodiment described previously. The previously described embodiment discloses a row of hooking applicators that are positioned side by side in such a way that the pivoting motion of the hooks are parallel to the line represented by the row of hooking applicators. This means that the more open the hook is relative to the applicator nozzle, the farther away the individual hooking applicators must be from one another. This is because the hook can only open so far as the point at which the hook makes contact with the applicator nozzle of the neighboring hooking applicator. The closer the neighboring hooking applicator, the less the hook can open. Another solution to this problem is to make the hooks smaller. This however may not be a desirable solution as this may cause the sections of hair that are entrained to be smaller than desired.

Figure 13:
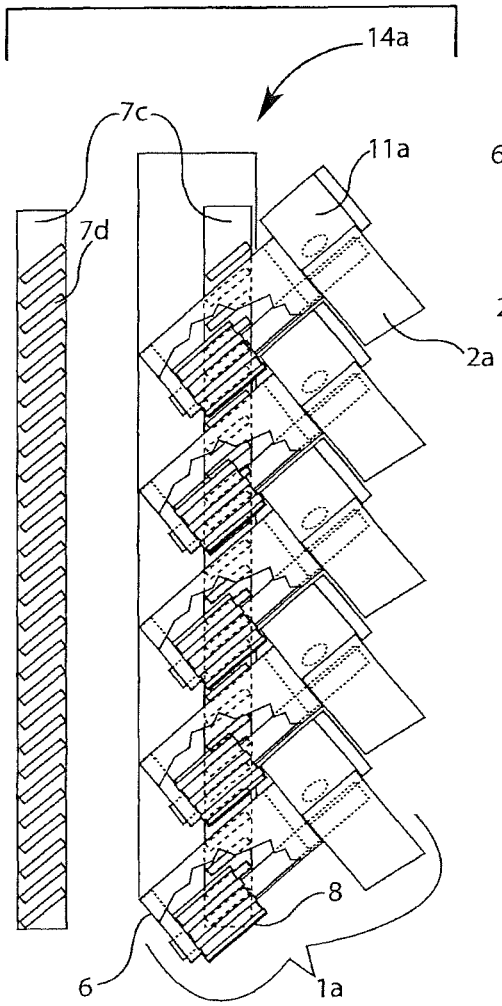
FIG. 13 depicts an alternative mechanical assembly of the head 14*a* of the preferred embodiment illustrated in FIG. 8. This assembly utilizes an angled position of each hooking applicator 1*a* along the head 14*a* of said preferred embodiment in order for the pivoting action of each hook 2*a* to avoid being interrupted by the applicator nozzle 11*a* of each adjacent hooking applicator 1*a*.

To overcome this shortcoming the present embodiment features a row of hooking mechanisms that are at an angle to one another so that when each hook is in the open position, each hook is positioned, in front of each neighboring applicator nozzle; therefore, each hook does not bump into each neighboring applicator nozzle. One way to accomplish this is depicted in FIG. 13. This figure depicts a top view of a row of hooking applicators 1*a* arranged side by side and angled as described above. This row of hooking applicators 1*a* is arranged as a device head 14*a*; yet, this head 14*a* is depicted without the rest of the device. The rest of the device is omitted as no further mechanical change is required of the device in order to accommodate the head 14*a* arrangement described below. FIG. 13 shows the tops of the gear box 6 cut away to expose a rack gear 7*c* with angled teeth 7*d* seated against an angled pinion gear 8 arrangement. In addition to depicting the angled pinion gear 8 position and angled rack 7*a* gear teeth 7*d*, FIG. 13 also depicts the hooks 2*a* in the open position in front of the adjacent nozzle 11*a* rather than against the nozzle 11*a* as per the previously described device head 14*a* arrangement; therefore, this angled hooking applicator 1*a* embodiment solves the above stated shortcoming by allowing the hooks 2*a* to remain the same size while positioning the hooking applicators 1*a* closer together.

As an alternative to the previously described rack and pinion gear means, the following describes an embodiment of the device that utilizes a mechanical lever action as a means to pivot the hooks. As per the device head embodiment described immediately prior, this device head embodiment likewise features a series of hooking applicators that are arranged in an angled configuration so that the hook axles are at an angle relative to the parting of hair, thereby, allowing the hooks to pivot in front of the adjacent nozzles. Although the present embodiment features hooking applicators that are arranged in said manner, this lever action embodiment may also be arranged such that the pivotal relation of the hook axles to the parting may also be approximately perpendicular as per the first device head configuration described in this disclosure.

It is necessary to state the following at this time; the many parts of the device that are not mentioned in the following description will be assumed to function in like manner to the first embodiment of the device described in this disclosure. This, in order to avoid redundant descriptions.

Figure 14A:
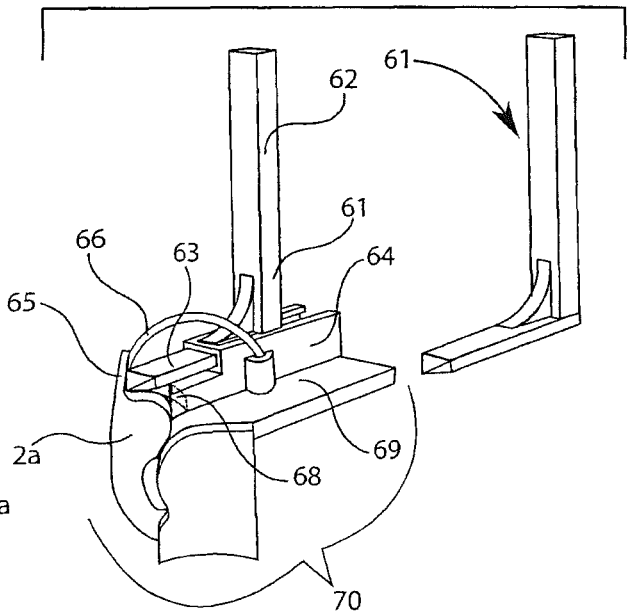
FIG. 14A depicts one alternative mechanical arrangement of the hooking applicator 1*a* depicted in FIG. 1A 1B. This hooking applicator 70 embodiment utilizes a hook slide 61 and hook lever 65 arrangement as a mechanical means to pivot the hook 2*a*.
Figure 14B:
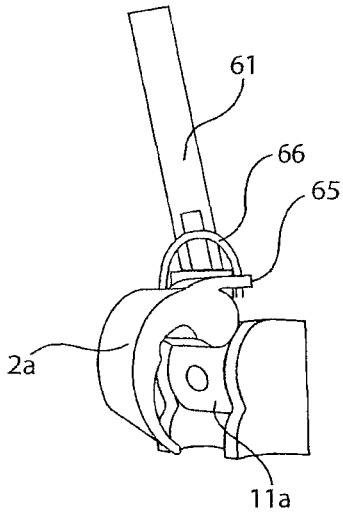
FIG. 14B depicts another alternative mechanical arrangement of the hooking applicator 1*a* depicted in FIG. 1A 1B.

As seen in the two different angles of front view (FIGS. 14A and 14B) depicting the lever action hooking applicator 70, the present embodiment features a hooking applicator 70 with a hook 2*a* that pivots on a hook seat 68, said hook seat 68 being located at the top front of the hooking applicator body 69. The hook 2*a* features a lever 65 that extends away from the back of the hook 2*a*. The hook 2*a* pivots as the hook slide 61, and therefore, the hook slide tip 63 slides forward, guided within the hook slide bracket 64. As the hook slide 61 moves forward, it slides underneath the hook lever 65 causing the lever 65 and therefore the hook 2*a* to pivot. The hook slide tip 63 will slide forward against the hook lever 65 until the hook 2*a* closes over the nozzle 11*a*. Conversely, as the hook slide 61 backs away from the hook lever 65, the hook 2*a* pivots back to the open position, pulled as such by the tension of the hook spring 66.

Having described the mechanical action of the individual lever action hooking applicator 70, the following is the series of mechanical actions that occur in order to simultaneously pivot all of said type of hooks along a device head comprised of multiple lever action hooking mechanisms.

Figure 15A:
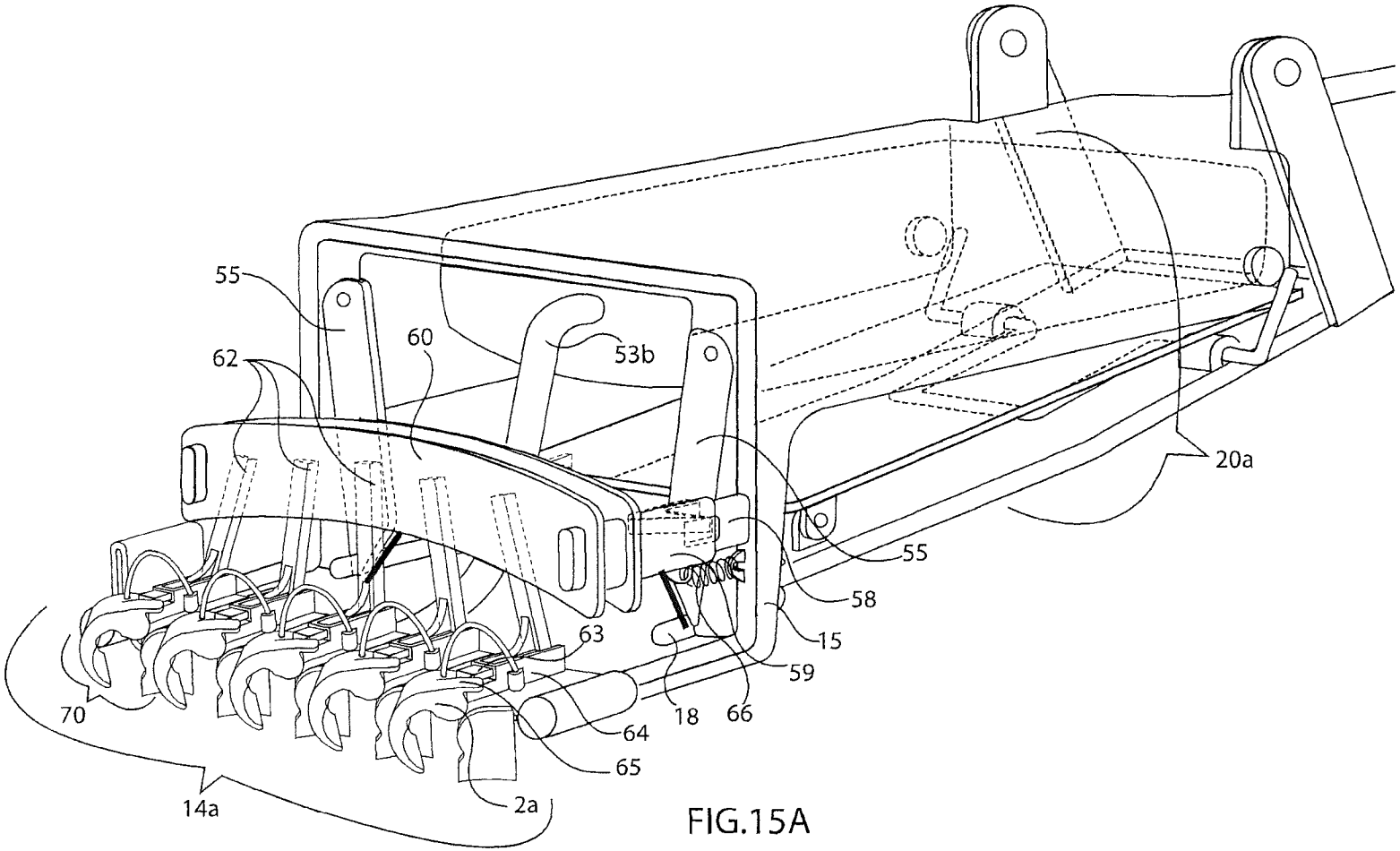
FIG. 15A illustrates a complete embodiment of the device while providing an alternative assembly to the preferred embodiment depicted in FIG. 8 showing one position of operation. This alternative embodiment possesses an identical functional action as the FIG. 8 embodiment while utilizing an alternative mechanical means that integrates a device head 14*a* comprised of a row of lever action hooking applicators 70 described in FIGS. 14A-14B.
Figure 15B:
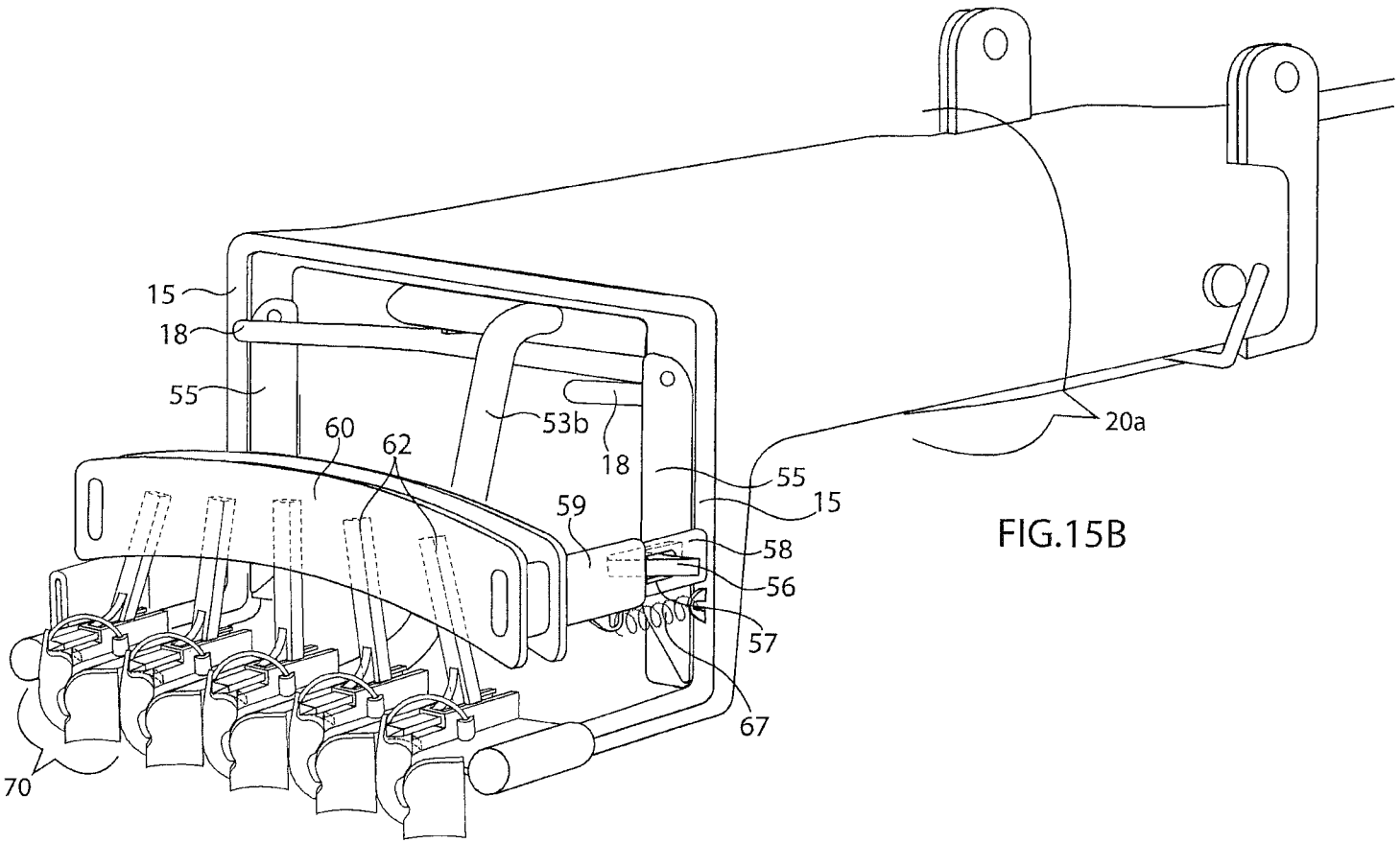
FIG. 15B shows the device of FIG. 15A in another position of operation.

As viewed in FIGS. 15A and 15B, the handle 20*a* of the device compresses and the actuator tines 18 begin to slide up against the angled bottom section 55*b* of each slide rack lever 55*a*. (The angled bottoms of the slide rack levers 55*a* are indicated in FIG. 15A by two bold black lines.) As the actuator tines 18 continue to slide upward against the rack slide lever angles 55*b*, the slide rack levers 55*a* begin to close against the head mounts 15. As seen in FIG. 15B, the inward closure of the slide rack levers 55*a* against the head mounts 15 cause the slide rack actuators 56 (which are fixed to the outside of the slide rack levers 55*a*) to begin to enter the actuator channels 57; these channels 57 are openings located on the slide rack mounts 58. Each slide rack mount 58 is fixed to each head mount 15. As the slide rack actuators 56 continue to enter the actuator channels 57, the angled fronts of the slide rack actuators 56 cause the slide rack seats 59 and the slide rack 60*a* on which they are attached to move forward.

Sandwiched between the two slide rack plates 60*b* of the slide rack 60*a* are the top sections 62 of the hook slides 61. Continuing to view FIG. 15B, the bottom sections of these hook slides 61 are fixed to and extend forward perpendicular to the top sections 62 forming the 'L' shaped hook slide 61. The hook slide tips 63 move back and forth in the hook slide seats 64. While the rack slide 60*a* moves forward, the top sections of the 'L' shaped hook slides 62 and therefore the hook slide tips 63 also begin to move forward. As the hook slide tips 63 move forward within the hook slide brackets 64, the hook slide tips 63 push forward on the hook levers 65 causing the hooks 2*a* to move from the open to the closed position. As the operator releases the handle 20*a* the above mechanical process reverses, the hooks 2*a* return to the open position by the tension of the hook springs 66 and the rack slide 60*a* returns to the resting position by the tension of the rack slide spring 67.

Figure 16A:
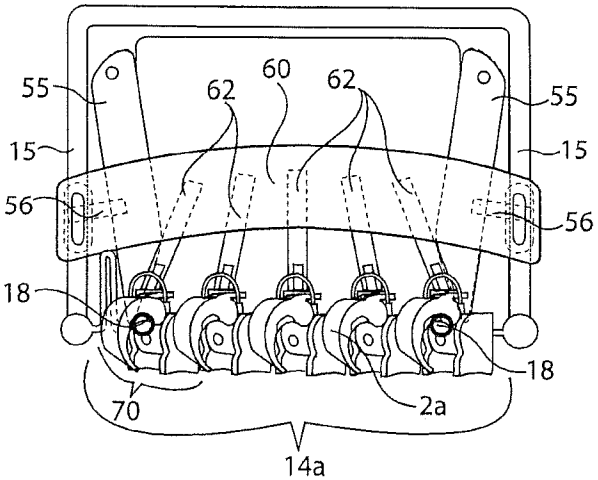
FIG. 16A depicts a front view of the lever action hooking applicator embodiment depicted in FIGS. 15A-15B and provides a view of the action of the individual mechanisms located at the front of the device as they function in a first sequence to pivot the hooks.
Figure 16B:
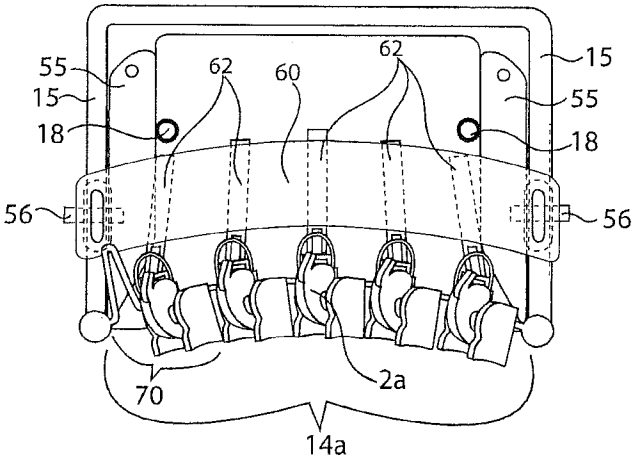
FIG. 16B shows the device of FIG. 16A in a second sequence.

The next mechanical operation of this lever action hooking applicator embodiment to be described is the curvature conformation feature (refer to FIGS. 16A and 16B). As described above, the mechanical relationship between the slide rack 60*a* and top sections of the hook slides 62 are responsible for the pivoting action of the hook 2*a*. In addition to this function, the top sections of the hook slides 62 and slide rack 60*a* also give the device the ability to conform to the curve of the head. In order for the head 14*a* of the device to curve, the individual hooking mechanisms 70 must be able to move up and down a short distance relative to the head mounts 15 as well as pivot to the side slightly. The contiguous way in which the top sections of the hook slides 62 are positioned within the slide rack 60*a* allow the top portions of the hook slides 62 to move up and down as well as pivot side to side radially. Now, when the head 14*a* of the device is urged against the scalp, each hooking applicator 70 moves from the resting position to the position it must assume in order for it to cooperate with the other attached hooking mechanisms 70 in assuming the particular degree of curvature. As each hooking applicator 70 moves, so does the top portion of each hook slide 62 sandwiched within the slide rack 60*a*. Now as the top portion of each hook slide 62 changes position pivotally from side to side as well as up and down differently from the other top portions of the hook slides 62, they do not change position pivotally from front to back as the slide rack 60*a* prevents this front to back pivoting. So, the slide rack 60*a* can move forward and back, thereby causing the hooks 2*a* to pivot from the open to closed position in unison even as the individual hooking mechanisms 70 pivot from side to side as well as move up and down differently from one another.

The final difference that will be described is a variation of position and shape of the color manifold. Considering an embodiment of the device which employs a rack and pinion gear arrangement to pivot the hooks, this gear driven embodiment eliminates the option of positioning the manifold hoses so that they extend from the manifold directly to the applicator nozzles through the area where the rack and pinion gears are positioned thereby eliminating the applicator hose. A mechanical arrangement that allows the manifold hoses to run straight to the back of the applicator nozzle renders a device head with less plumbing and therefore easier cleaning. In addition to a head with less plumbing, the manifold hoses can be shorter, and therefore, take up less space.

Figure 17:
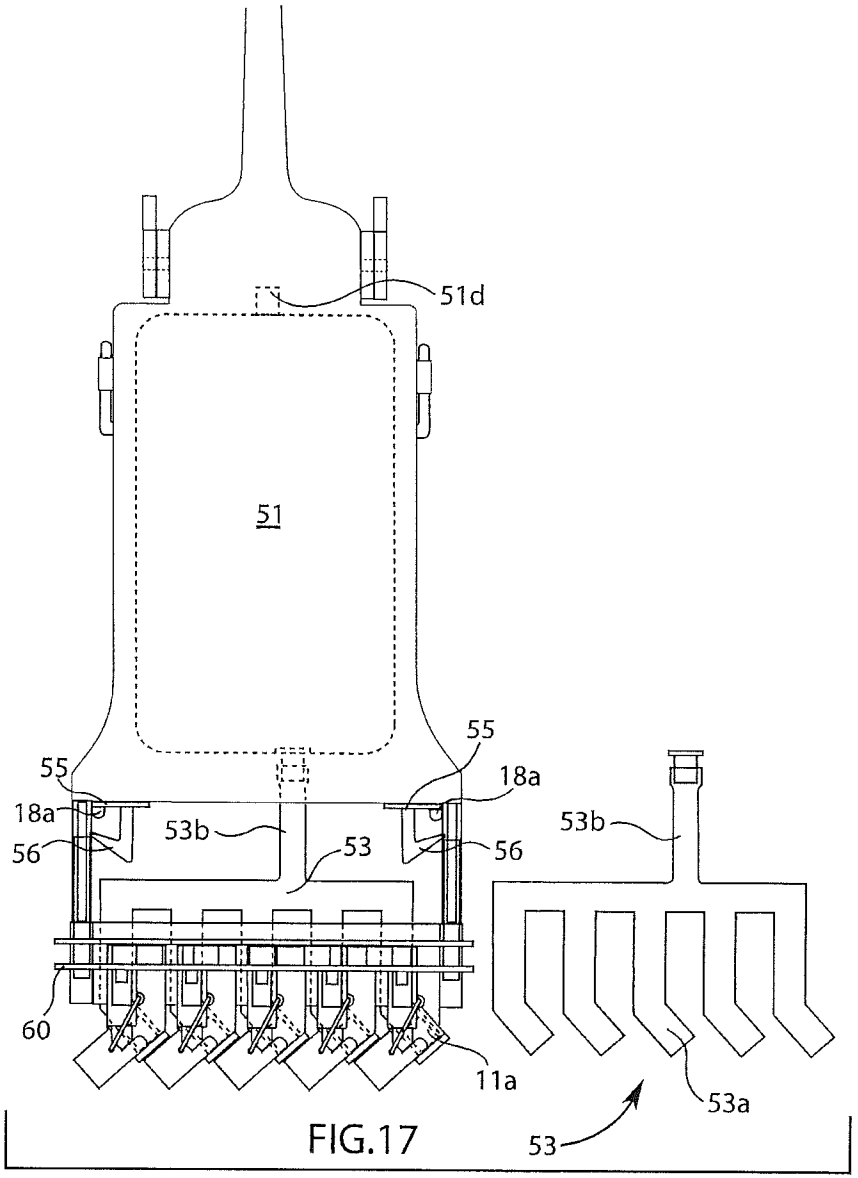
FIG. 17 is a top view of the device illustrated in FIGS. 15A 15B. This view provides a more complete description of the mechanical function described in FIGS. 14, 15 and 16.

As seen in FIG. 17, the present lever action hook embodiment features a low manifold color container 52*f* with a single hose 52*g* (see also FIG. 15A) that extends from the front, extending down to the low manifold 52*h* located level with and in back of the applicator nozzles 11*a*. Also, the low manifold hoses 521*i* extend forward away from the manifold 52*h* a short distance and connect to the applicator nozzles 11*a*.

Hose connectors as well as any other pertinent part not described in this low manifold color container 52*h* arrangement may be adapted to here from previously described color container arrangements.

Figure 18:
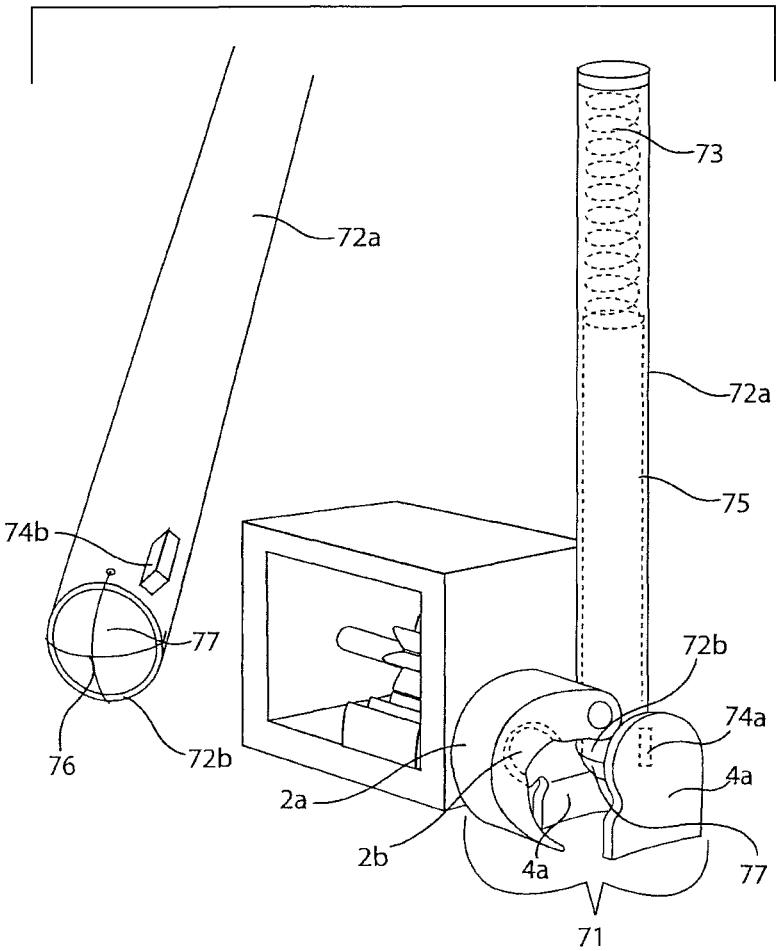
FIG. 18 depicts an alternative mechanical arrangement of the hooking applicator described in FIGS. 1A-1B. This hooking applicator illustration describes the mechanical means necessary to render an embodiment of the device capable of dispensing a stick or sticks of hair color chalk, mascara, etc. onto an entrained section/sections of hair.

Any embodiment of the hooking applicator may substitute liquid color application onto entrained sections of hair for the application of hair color chalk, mascara or any other type of hair color or hair treatment that can be formed into a solid or semi solid stick. As depicted in FIG. 18, this embodiment of the hooking applicator 71 features a spring 73 loaded tube 72*a* that is positioned open end 72*b* down between the front foot 4*a* and rear foot 4*g* of the hooking applicator 71 so that the open end 72*b* of the tube 72*a* will be centered within the hollow of the hook 2*a* in the closed position. This tube 72*a* is positioned in such a way that it may be fixed or detachable to the front foot 4*a* and rear foot 4*g*. If it is detachable, the spring 73 loaded tube 72*a* will have a tab 74*b* fixed to opposite sides of the tube's open end 72*b*. The upper portion of the front foot 4*a* and rear foot 4*g* will have a tab seat 74*a* indented centered on the upper inside. Now, the tabs 74*b* of the spring loaded tube 72*a* will snap securely into and out of the tab seats 74*a*. A stick of hair treatment 75 is positioned between the compressed spring 73 and the bottom of the tube 72*b*. The stick of hair treatment 75 is held from springing out of the opened end of the tube 72*b* by two flexible, thin, intersecting cross members 76. These cross members 76 are attached to the open end of the tube 72*b* and intersect at or near the center of the opening of the tube 72*b*. Alternatively, the cross members 76 may be substituted for one or more tiny flexible tabs attached to the edge of the tube open end 72*b* in such a way that they face toward the center of the tube open end 72*b* and may or may not connect as they may radiate only partially toward the center.

The viscosity or hardness of the stick of hair treatment 75 must be such that it is soft enough to wear away easily from the stick 75 onto the section of hair that passes over the exposed tip 77 of said stick 75 yet the stick of hair treatment 75 must be of the viscosity or hard enough so that, as the stick of hair treatment 75 is being pushed against the cross members 73 by the spring, the stick 75 will not extrude through the cross members 76 while the device is not in use.

The hollow of the hook, features an indentation 2*b* that is the diameter and shape of the section of the rounded tip 77 of the stick of hair treatment 75 that is protruding from the open end 72*b* of the tube 72*a*. Now, as the hook 2*a* closes over the tip 77 of the stick of hair treatment 75, the tip of the stick 77 seats accurately into the indentation 2*b* in the hollow if the hook. As the hook 2*a* entrains a section of hair, the front foot 4*a* and rear foot 4*g* center the entrained section of hair over the indentation 2*b* located in the hollow of the hook 2*a*. Once the hook 2*a* has closed over the tip 77 of the stick of hair treatment 75 with the entrained section of hair, the hair will move through the closed position and will be coated with the hair treatment. As the tip 77 of the stick of hair treatment 75 wears away with repeated runs of entrained sections of hair it will be continually fed to the tip 72*b* of the tube 72*a* against the tension of the spring 73. The intersecting cross members 76 hold the tip 77 of the hair treatment stick 75 in place at the end of the tube 72*b* and allows the tip 77 of the stick hair treatment 75 to wear away evenly as the cross members 76 are able to move slightly during repeated runs preventing un-worn away ridges from forming on the tip 77 of the stick of hair treatment 75 directly under the cross members 76.

The operator will feel the need to adapt the way she uses the device to better accommodate the various needs and requests of the patrons seeking hair color variegation services. The operator has the option to vary the distance between the rows of color treated hair. This allows the recipient to choose within a range of more or less color treated sections placed in the overall color service. In addition to this, the recipient may choose within a range of thick or fine individual color treated sections. If the operator places the head of the device close to a parting of hair, the device will entrain and therefore treat finer sections of hair. The farther away the operator places the head of the device from the parting of hair the thicker the entrained and treated section will be. While keeping the head of the device parallel to the parting, the operator may also slightly stagger the successive placements of treated rows from side to side. By adjusting the three technical variables described above, various aspects of the final appearance of the color service may be changed by using a single device head. However, far more variation in the final appearance is possible with a device that has multiple device heads to choose from. Detachable and interchangeable device head embodiments will now be described and illustrated.

A wide range of varied head types may be embodied by creating a range of hook/hooking applicator sizes and arranging them at various distances from one another onto heads of different widths. A larger hook/hooking applicator will entrain a wider/larger section of hair and, conversely, a smaller hook/hooking applicator will entrain a narrower/smaller section of hair. Also, a head with hooks that are spaced farther apart or closer together will render each entrained section along the row of entrained sections farther apart or closer together from one another. Obviously then, a wider head will render a wider row of entrained sections.

Figure 19A:
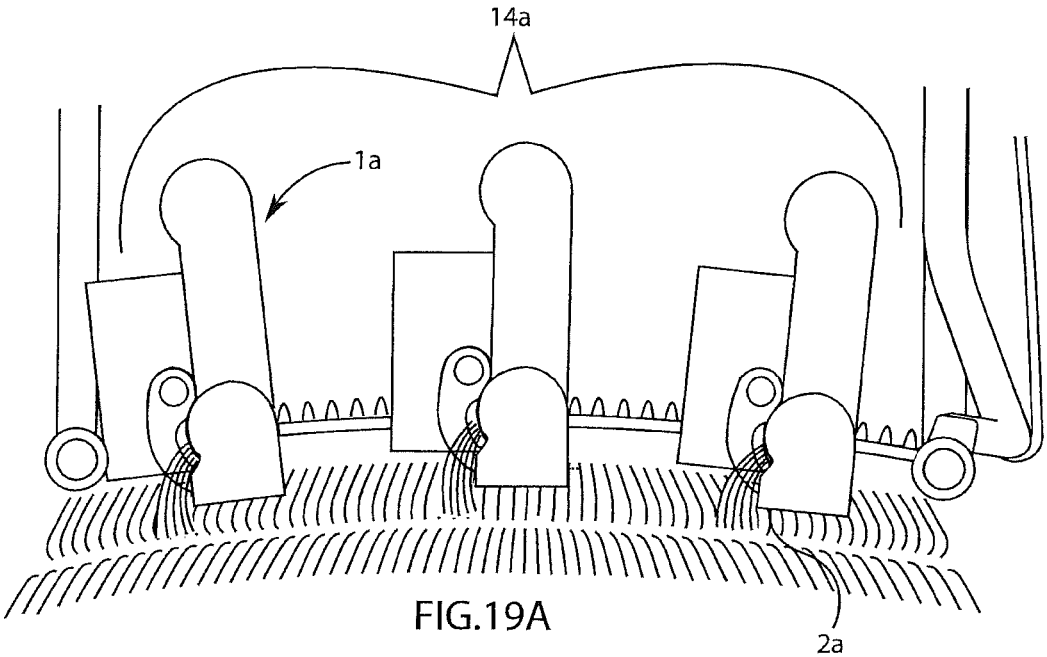
FIG. 19A depicts a first of five of the many possible head arrangements that may be assembled in order to give the operator various options for the final hair color variegation appearance. These figures combine various hook/hooking applicator sizes with varying distances between the hooks/hooking applicators to give the operator the opportunity to provide the hair color variegation service recipient with choices pertaining to the size of the sections being treated (by varying the size of the hook) and the distance between the treated sections (by varying the distance between the treated sections).
Figure 19B:
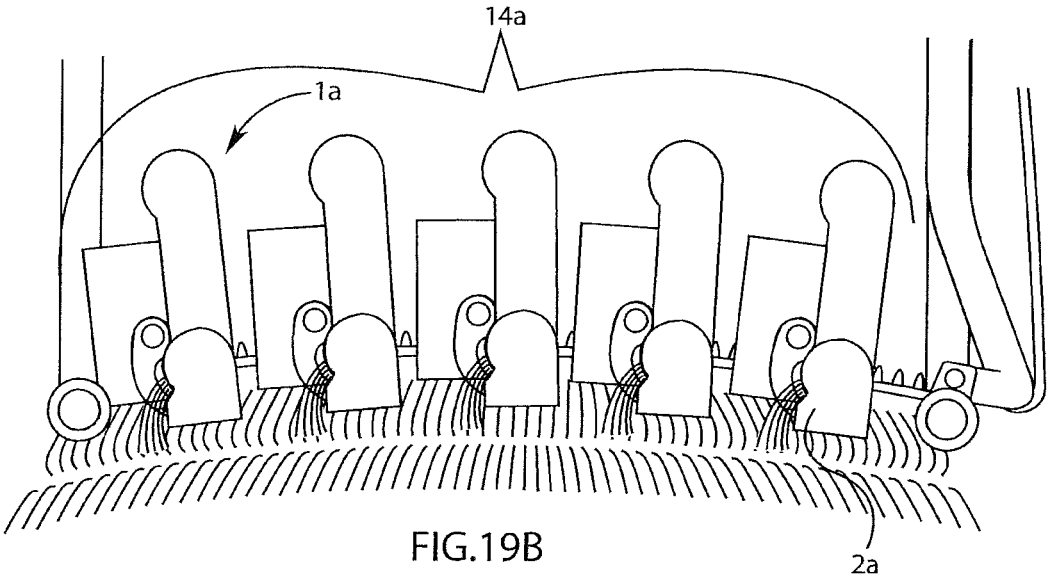
FIG. 19B depicts a second head arrangement.
Figure 19C:
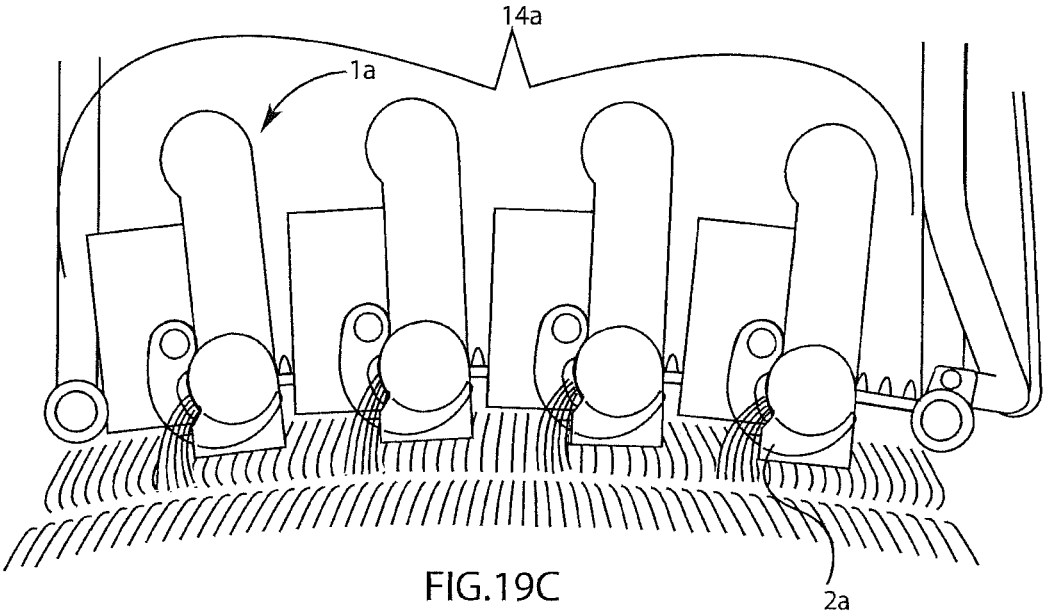
FIG. 19C depicts a third head arrangement.
Figure 19D:
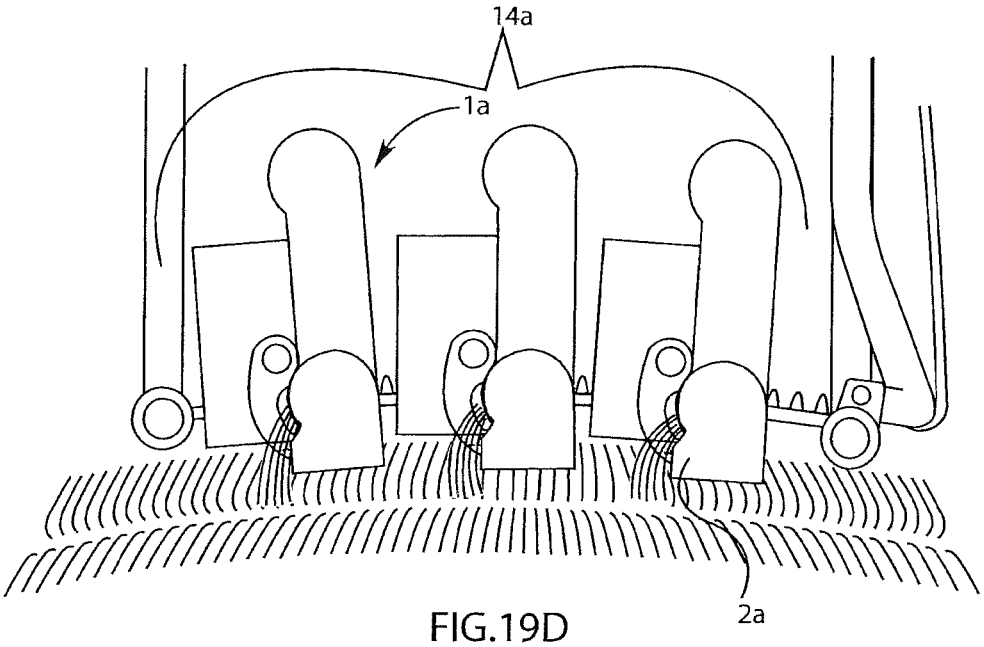
FIG. 19D depicts a fourth head arrangement.
Figure 19E:
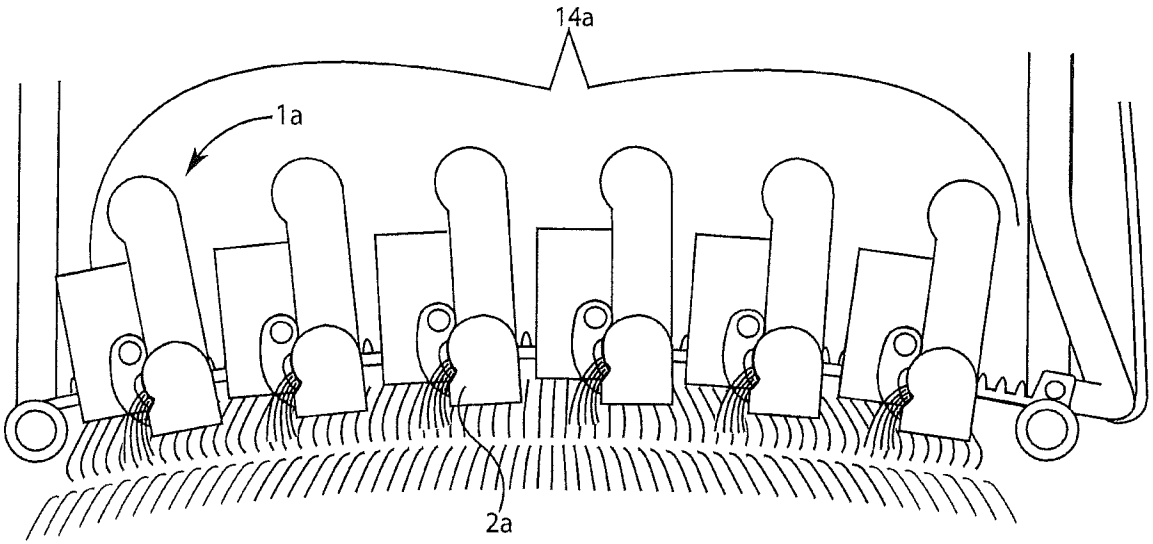
FIG. 19E depicts a fifth head arrangement.

FIG. 19A depicts a device head 14*a* with three larger hooks 2*a* arranged at a greater distance from one another comprising a head 14*a* of perhaps medium width. FIG. 19B depicts a device head 14*a* with five smaller hooks 2*a* arranged at a closer distance to one another forming a head 14*a* of perhaps medium width. FIG. 19C is also perhaps a medium width device head 14*a* with four larger hooks 2*a* arranged closer to one another. FIG. 19D is a device head 14*a* of three larger hooks 2*a* positioned close to one another comprising a head 14*a* of narrower width. FIG. 19E depicts six smaller hooks 2*a* positioned close to one another along a wide head 14*a*. There are many more head variations possible and may it suffice to state that all will occur as obvious in light of what has thus far been disclosed.

Figure 20A:
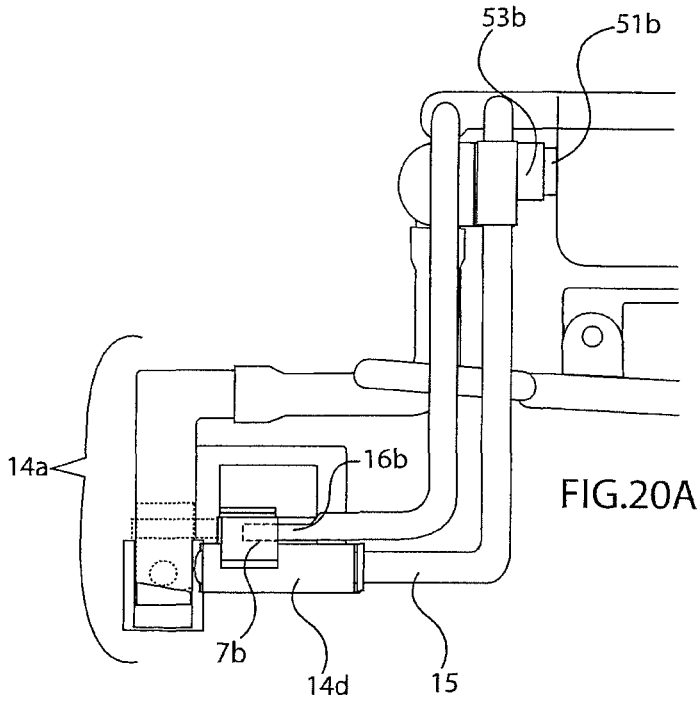
FIGS. 20A-20B as well as FIGS. 21A-21C and FIGS. 22A-22F depict mechanical assemblies of varied sophistication, thereby, providing a range of opportunity for embodiments with such a feature.
Figure 20B:
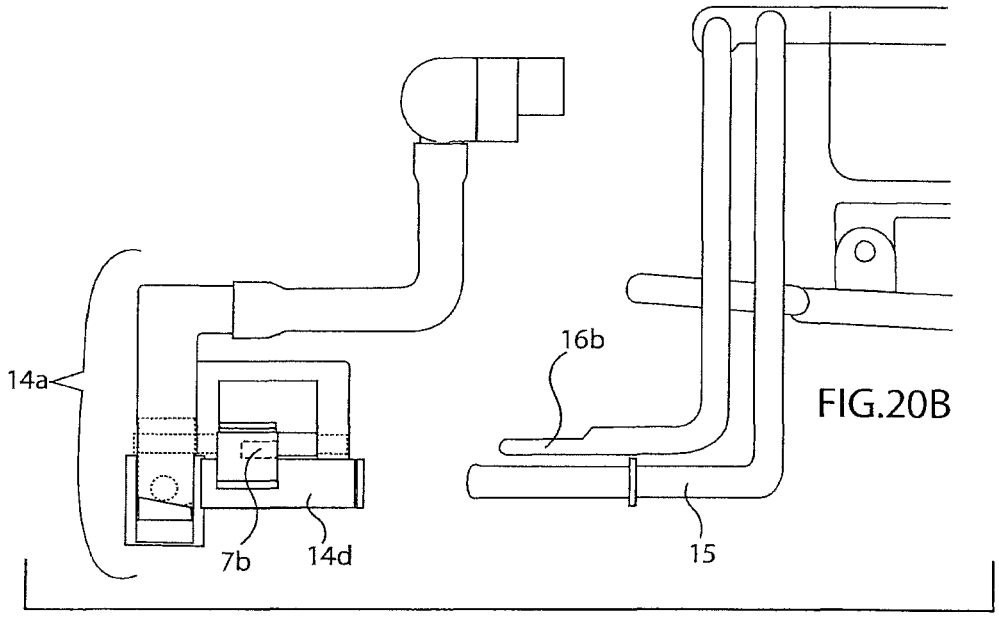

There are numerous mechanical arrangements that may be employed to create a head that quickly and easily detaches and reattaches to the body of the device. One preferred embodiment of the detachable head is depicted in FIGS. 20A and 20B. These figures describe a head 14*a* that includes roller couplings 14*d* that pull away from the head mounts 15 as well as a manifold intake 53*b* that pulls away from the color container coupling 51*b* and a rack gear pin 16*b* that pulls away from rack slide seat 7*b*. Re-attaching the head in this instance simply requires the operator to re-attach what has been detached.

Figures 21A, 21B, 21C:
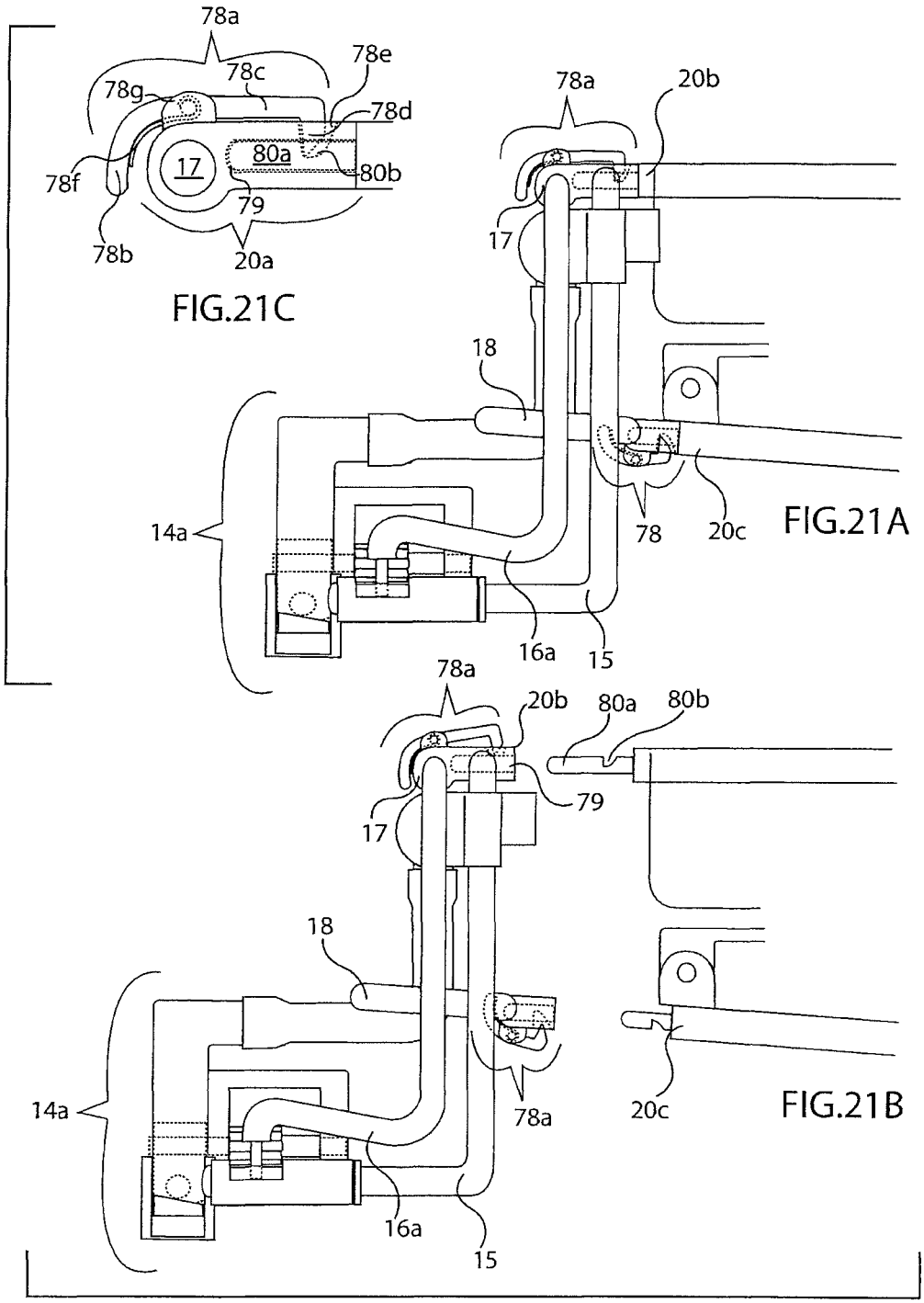
FIG. 21A depicts a head, manifold, head mount and rack slide assembly that detaches from the top hinge section of said device. In addition to the detachable head, this figure shows actuator tines removable from the bottom hinge section and shows a side view this arrangement in the attached position.
FIG. 21B shows the device of FIG. 21A in a detached position
FIG. 21C shows a side view of the device of FIG. 21A in terms of removability.

Another detachable head embodiment is depicted in FIG. 21A-21C. These figures describe an embodiment of the device featuring a detachable arrangement where the head 14*a* of the device as well as the head mounts 15 and actuator tines 18 detach. This arrangement allows the width of the head 14*a* to vary from one detachable head to another. The FIG. 20 detachable head arrangement alone does not.

The FIG. 21A-21C embodiment utilizes small spring loaded release levers (78*a* and 78*h*). FIG. 21C is included in order to provide a magnified view of the type of release lever (78*a* and 78*h*) used. The head release lever 78*a* allows the front portion of the top hinge plate 20*b* to detach. In this manner, the head 14*a*, head mounts 15, rack slide mount 17 and rack slide 16*a* detach from the device with one press of the head release lever 78*a* trigger 78*b*. An actuator release lever 78*h* allows the front portion of the bottom hinge plate 20*c* and therefore the actuator tines 18 to detach. Actuator tines 18 that are detachable are necessary because a wider head mount 15 requires actuator tines 18 that are wider.

As mentioned above, a head release lever 78*a* is positioned on the front of the top handle section 20*b*. The trigger 78*b* side of the lever 78*a* is curved down following the contour of the distal front of the top handle section 20*b* and the latch side 78*c* extends straight back and then ends at a short right angle bend forming the latch pin 78*d*. In the resting position, the latch pin 78*d* rests in a small hole or latch pin eyelet 78*e*. The eyelet 78*e* opens on the inside to the hollow insert seat 79 of the detachable front of the top handle section 20*b*. The insert seat 79 of the detachable front of the top handle section 20*b* is open at the back and fits over the insert tab 80*a* attached to the distal front of the top handle section 20*b* as it is in the detached state. An indentation or pin seat 80*b* is located on the top surface of the insert tab 80*a*. The pin seat 80*b* lines up with the pin eyelet 78*e* when the insert tab 80*a* is the fully engaged position over the insert seat 79. This allows the latch pin 78*d* to seat through the eyelet 78*e* and into the pin seat 80*b* thereby locking the detachable front of the device onto the body of the device with the tension of the elbow type latch spring 78*f* holding the latch pin 78*d* in the pin seat 80*b*. In order to detach the front of the device from the body, the operator simply presses down on the trigger 78*b* of the lever 78*a* causing the trigger side 78*b* and latch side 78*c* to pivot on the hinge 78*g*. As the trigger side 78*b* of the lever 78*a* pivots down, the latch pin 78*d* pivots up and out of the pin seat 80*b* against the tension of the latch spring 78*f*. With the latch pin 78*d* lifted out of the pin seat 80*b*, the operator simply pulls forward on the detachable front of the device and it simply slides off (FIG. 21B depicts the detachable head in the detached position). As the latch pin 78*d* is angled on the back, the operator simply slides the insert seat 79 over the insert tab 80*a* and the latch pin 78*d* lifts as it slides over the tab 80*a* and then clicks down into place within the latch pin seat 80*b* urged by the tension of the latch spring 78*f*.

Also depicted in FIGS. 21A and 21B, the actuator tines 18 detach from and reattach to the front of the bottom handle section 20*c* utilizing the actuator release lever 78*h*. See the description of the action of head release lever 78*a* above for the action of the actuator release lever 78*h*.

Another preferred detachable head embodiment is depicted in FIG. 22A-22F. This embodiment utilizes a dial with a spiral thread to adjust the width of both the head mounts and the rack slide actuator. The dial adjustable head mounts will be described first followed by a description of the dial adjustable rack slide actuator. It is important to note while considering the following dial adjustable head mount mechanical arrangement that the rack slide 16*a*, rack slide mount 17 and rack slide spring 19 are appropriately attached to one of the head mounts.

Figure 22A:
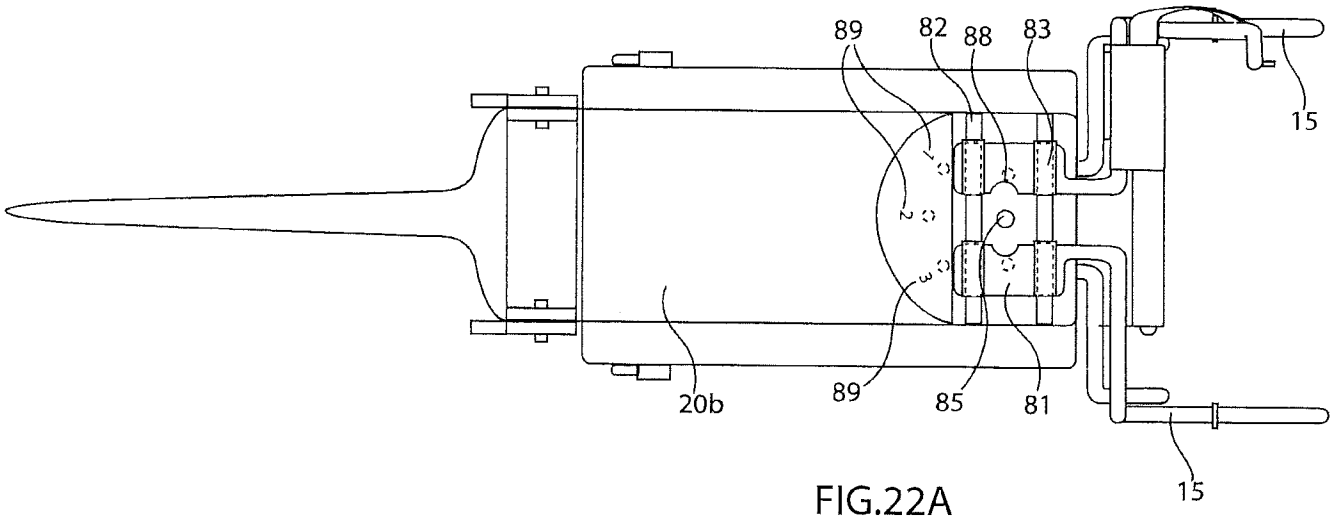
FIG. 22A illustrates a top view of said device including the mechanical assemblies that allow the head mounts, rack slide and actuator tine assemblies to be adjustable rather than removable while the head and manifold remain removable in a first position.
Figure 22B:
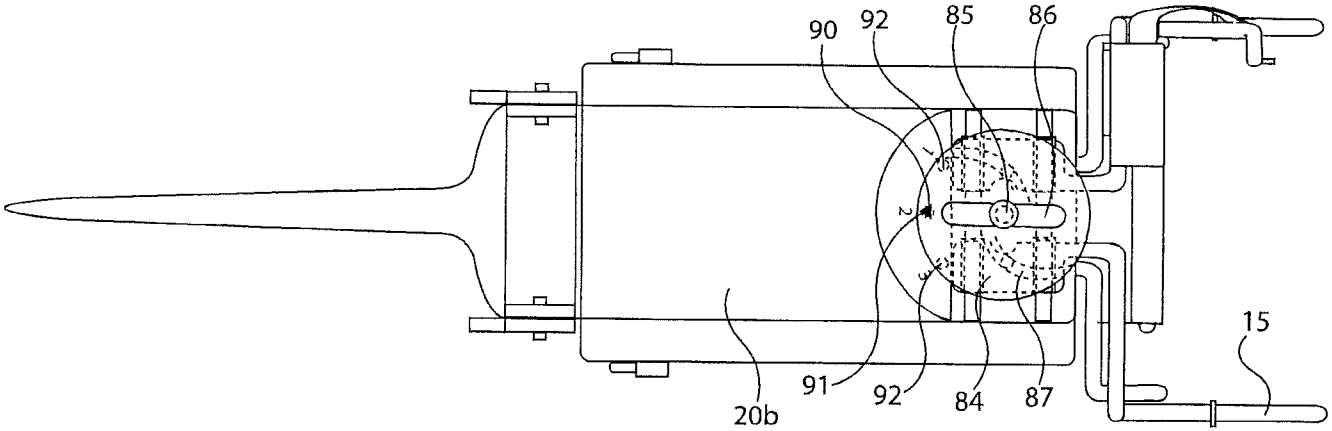
FIG. 22B shows the device of FIG. 22A in one operational position.

FIG. 22A shows each of the two head mounts 15 consists of a slide plate 81 and a head mount 15. Each slide plate 81 is mounted separately onto the front of the top handle section 20*b*. Fixed to the top front of the top handle section 20*b* are two slide rails 82 that run parallel to and are a short distance from one another. Each slide plate 81 has two slide rail fittings 83 formed into it. Each fitting 83 tightly surrounds each slide rail 82 on three sides but not so tight as to prevent each fitting 83 from sliding along each rail 82. This slide arrangement confines the movement of each slide plate 81 as well as the head mount 15 fixed to it to a side to side slide. FIGS. 22A and 22B show a single dial 84 is positioned over both slide plates 81 as they are fitted onto both slide rails 82. The dial 84 is mounted over the slide plates 81 by an axle 85 that is fixed to the top handle section 20*b*. The dial 84 is positioned in such a way that the dial 84 presses down firmly onto the rail fittings 83 yet the dial 84 can turn. A knob 86 or more preferably a key slot 86 will be positioned at the center of the dial 84 so that the operator can easily turn the dial 84. A key slot 86 is more preferable because the dial 84 is also the thumb rest for the operator; therefore, a key slot 86 will be less obstructive for this purpose. The device will also include a key that is similar in dimension to a coin so that the operator may also use a coin to turn the dial 84.

Radiating from the axle 85 along the bottom of the dial 84 to the outside edge of the dial 84 are two threads 87. These threads 87 are curved thin grooves that form a spiral across the bottom of the dial 84. Fixed to and protruding from the top surface of the each slide plate 81 is a short small and perhaps cylinder thread insert 88. As the name implies, the thread insert 88 seats into the thread 87 of the dial 84. Now, as the operator turns the dial 84, each thread insert 88 will move back and forth along each thread 87 in turn causing each slide plate 81 and head mount 15 to slide back and forth along each slide rail 82.

There are numbered dial positions 89 aligned with the back of the dial 84. The area where the numbers are located is raised to the same level as the slide rail fittings 83. There may be any number of dial positions 89 indicated but preferably the number of positions will be the same as the number of head widths available to the device. Our preferred dial embodiment has three positions.

A setting indicator 90 mark is positioned on the back edge of the top surface of the dial 84. Positioned on the bottom of the dial 84 directly under the setting indicator 90 is a small protrusion 91. Positioned along the raised numbered area of the top handle section 20*b* are indentations 92. There is one indentation 92 positioned under the dial 84 directly in front of each dial position 89. Also, each indentation 92 is in line with the dial protrusion 91; so, as the operator turns the dial 84, the protrusion 91 will snap into the indentations 92. Each snap-in, numbered dial position 89 corresponds to a specific width of a particular detachable head.

Figure 22C:
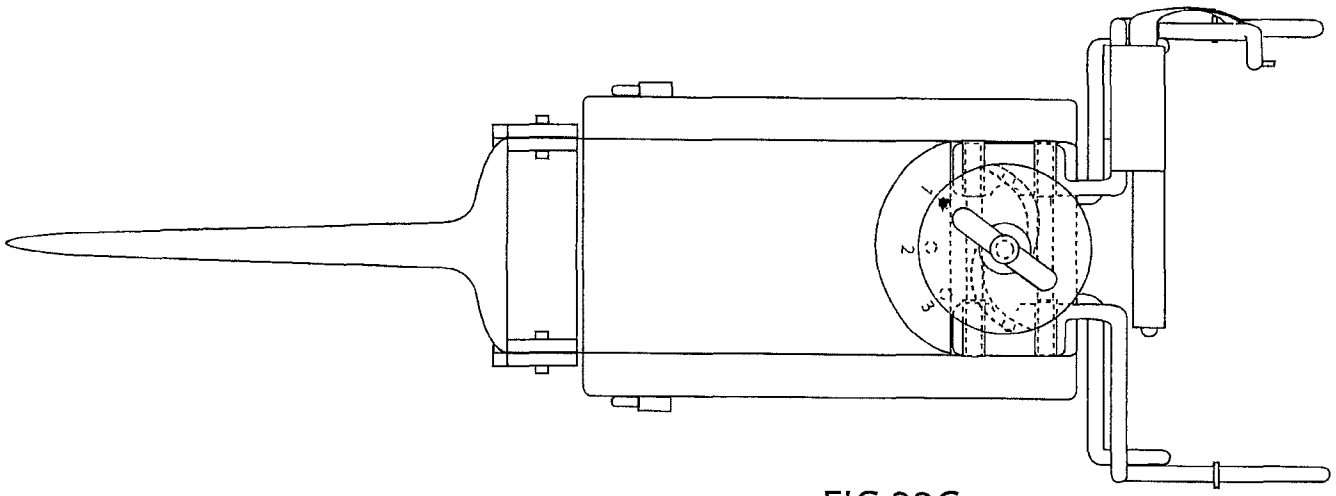
FIG. 22C shows the device of FIG. 22A in a different operational position.
Figure 22D:
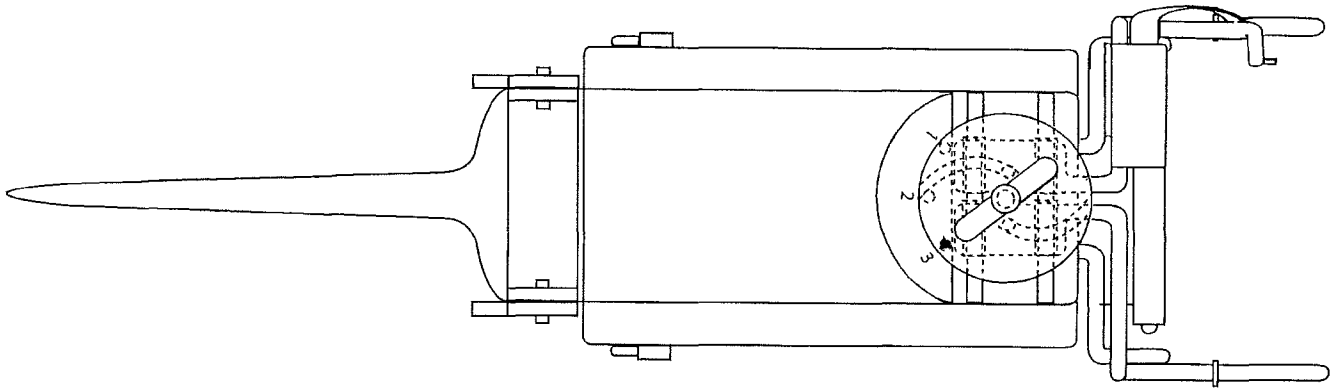
FIG. 22D shows the device of FIG. 22A in yet a different position.
Figure 22E:
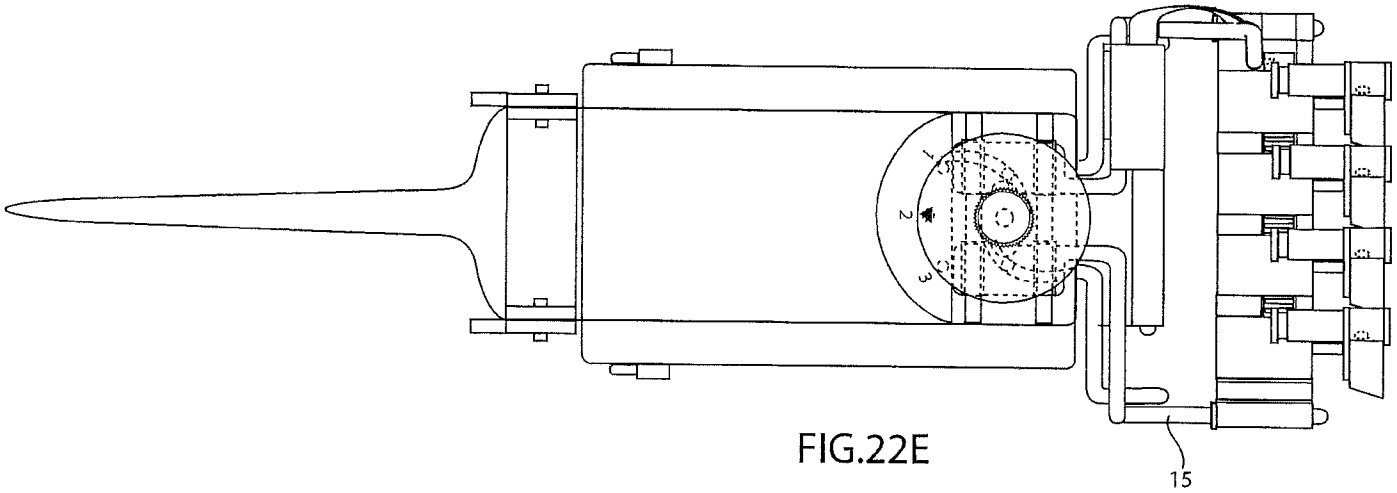
FIG. 22E shows the device of FIG. 22A in still another operational position.

FIGS. 22B, 22C and 22D are all depictions of three dial 84 positions as well as each corresponding head mount 15 position. FIG. 22E depicts the dial adjustable head mount embodiment including the head 14*a*.

Figure 22F:
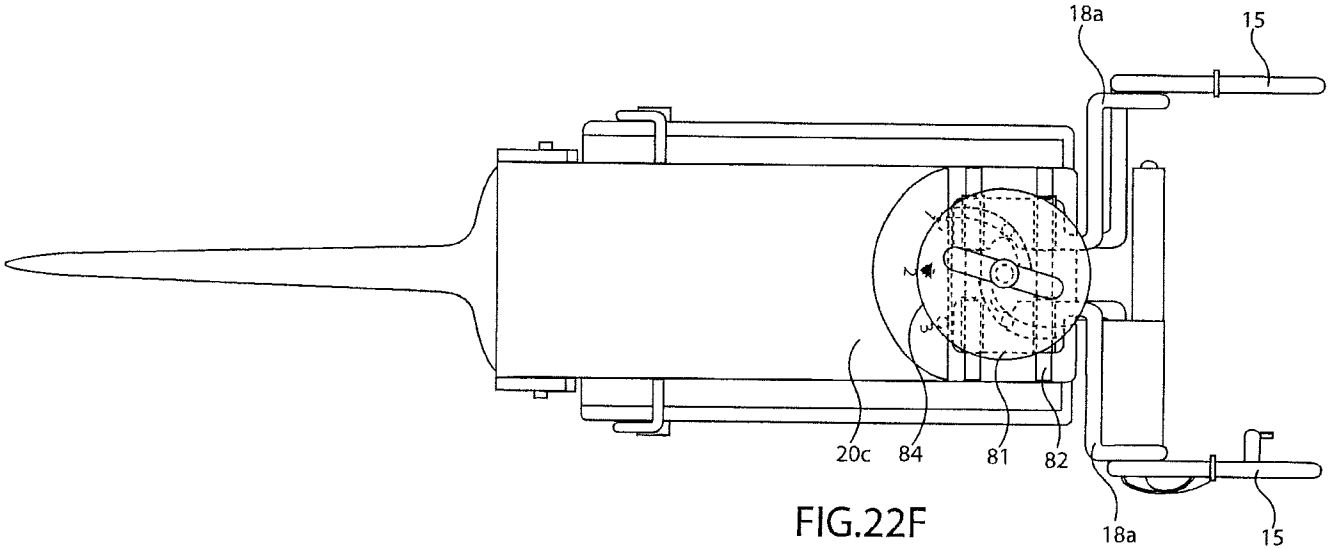
FIG. 22F illustrates a bottom view of said device illustrating an adjustable actuator tine assembly.

FIG. 22F depicts a bottom view of the device showing the actuator tines 18*a* with the same dial 84 controlled adjustability feature as the head mounts 15. Each of the two actuator tines 18*a* consists of a slide plate 81 and an actuator tine 18*a*. Each slide plate 81 is mounted separately onto the bottom front of the bottom handle section 20*c*. Fixed to the bottom front of the bottom handle section 20*c* are two rails 82 that run parallel to and are a short distance from one another. All other mechanical aspects of the dial controlled adjustability feature of the actuator tines are identical to the mechanical aspects of the dial controlled adjustability feature of the head mounts described previously.

Figure 23A:
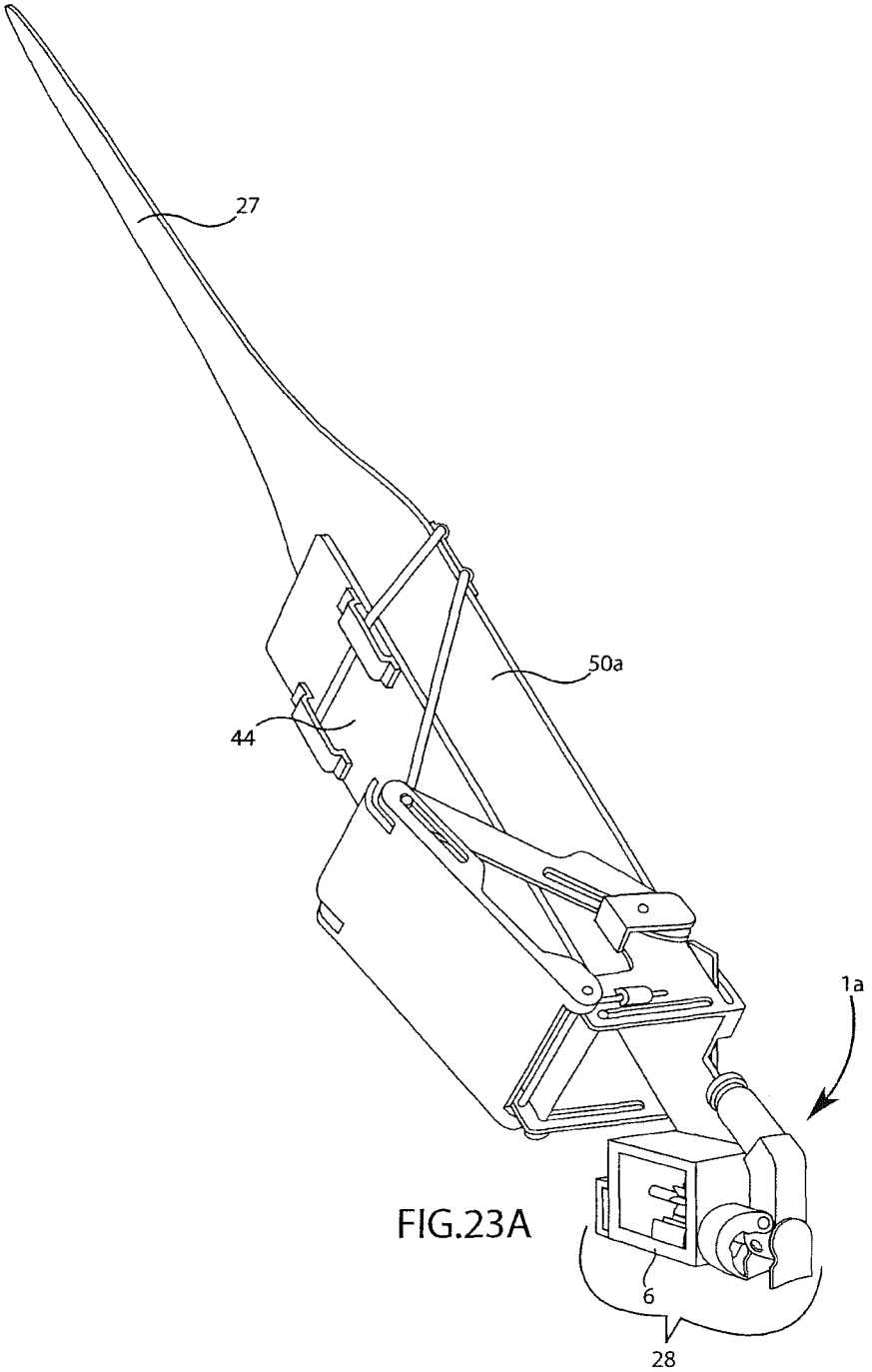
FIG. 23A depict a preferred embodiment of the hair color variegation device in the form of a compact, single hooking applicator, pen or marker like appliance and depicts a perspective side view of a complete assembly of said device.

FIG. 23A depicts a preferred pen or marker type embodiment of the device that is more compact and less complicated to use than the previous embodiments. This embodiment may be the most likely, of all of the embodiments presented so far, to be directed to the consumer market as it features only a single hooking applicator 1*a* making it more possible for consumers to use the such a device on one another; or, on him or herself.

In general, FIG. 23A depicts a single hooking applicator or head 28 of the device fixed to a body plate 50*a* along the side of the gear box 6. Extending away from the rear of the body plate is a parting stem 27. A squeeze plate 44, approximately the same dimensions as the body plate 50*a*, is positioned a distance from and face to face to the body plate 50*a*.

Although the present embodiment features a single hooking applicator, this embodiment may also maintain nearly the same ease of use and mechanical configuration while featuring two or more hooking applicators as the head of the device. For instance, the present embodiment may feature a head comprised of two or three hooking applicators that are joined to one another level and side by side. This head may also have a body plate fixed to the side of one of the gear boxes, and so on, including all of the mechanical features described in the following. Furthermore, like the single hooking applicator head, this two or three hooking applicator head does not require a head conformation feature as does the four or more hooking applicator head described previously. This is because the span of the two or three hooking applicator head is narrow enough that a certain fixed orientation of said head will overcome the need for the head to bend or flex into the varied curvature of the scalp.

An illustrated description of the hooking applicator has been presented earlier in this disclosure; therefore, a description of the hooking applicator in the following will occur in a cursory manner in order to coordinate it with the detailed illustrated description of the mechanisms involved in hook engagement and liquid hair color discharge.

The present single hooking applicator head embodiment features a similar sequential hair entraining and color dispensing trigger function to the previously described multiple hooking applicator head embodiment. The mechanism responsible for this will be described below.

Figure 23C:
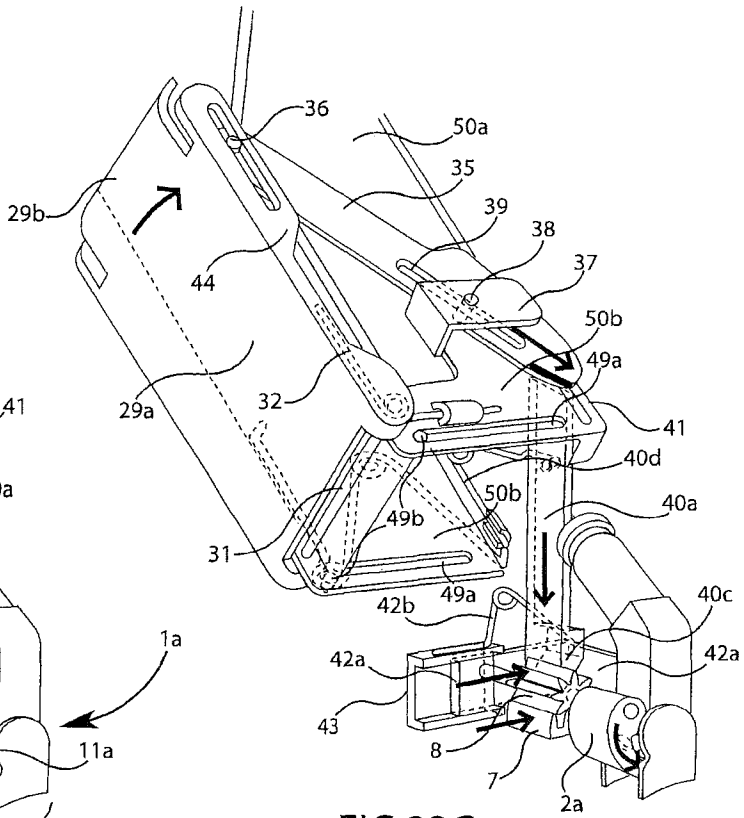
FIG. 23C shows another close-up front perspective view depicted to describe the mechanical assemblies involved in the pivoting of the hook from the open to closed position respectively.
Figure 23B:
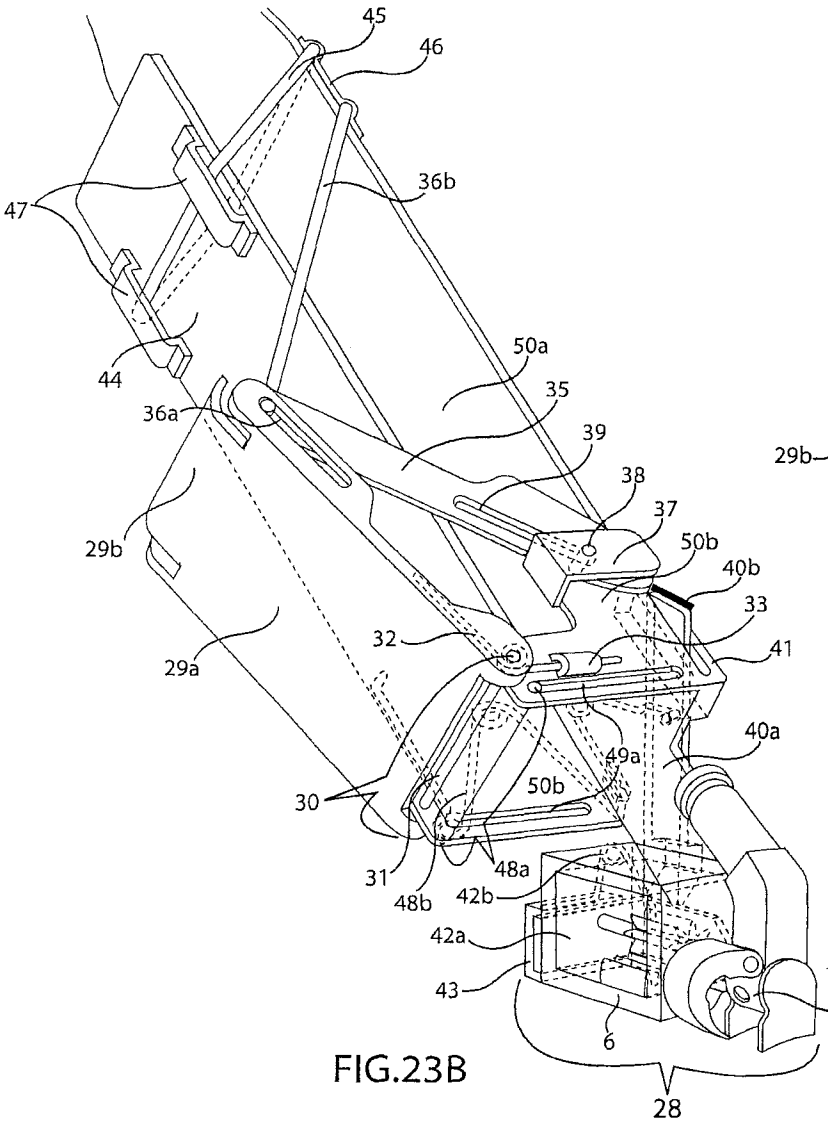
FIG. 23B shows one close up front perspective view depicted to describe the mechanical assemblies involved in the pivoting of the hook from the open to closed position respectively.

As seen in FIG. 23B, a single trigger 29*a* is hinged 30 to the front of the body plate 50*a* to both body plate wings 50*b*. As the trigger 29*a* moves from the open resting position, it does so against the resistance of the trigger spring 32. The wound pivotal section of the spring 32 is positioned with the trigger hinge pin 31 running through it. The trigger spring 32 is leveraged on one end to the trigger 29 and on the other end to the top body plate wing 50*b* by the trigger spring eyelet 33.

As seen in FIG. 23C, the trigger 29*a* pivots on the trigger hinge 30 toward the squeeze plate 44 causing the hook 2*a* to pivot from the open toward the closed position facilitated by a series of coordinated lever and slide hinge mechanisms that originate at the trigger 29*a*. The following is a detailed description of this mechanical operation.

While viewing FIGS. 23B and 23C in sequence (also, see FIGS. 24A and 24B in sequence), the trigger 29*a* pivots from the resting position toward the squeeze plate 44 causing the trigger slide 35 to pivot on the trigger slide hinge 36*a* while being pushed forward on the trigger slide hinge 36*a* by the trigger slide push rod 36*b*. This slide forward of the hinged back of the trigger slide 35 occurs as the push rod 36*b* is hinged to both the trigger slide 35 as well as the trigger slide hinge 36*a* on one side while being hinged to the back of the body plate 50*a* by the squeeze plate stabilizer hinge 46 on the other side; therefore, it is the coordinated hinged slide lever action of the push rod 36*b* and the trigger 29*a* that pushes the trigger slide 35 at an angle forward through the trigger slide guide 37.

As the trigger slide 35 moves forward, sandwiched between the trigger slide guide 37 and the top wing 50*b* of the body plate 50*a*, the front of the trigger slide 35 is confined to a specific angled forward path as the trigger slide channel 39 moves with the fixed trigger slide guide pin 38 positioned within. As the distal front of the trigger slide moves forward, it encounters the contact angle 40*b* (indicated by the single short bold line) of the slide wedge 40*a*. The movement of the front of the trigger slide 35 over the slide wedge contact angle 40*b* causes the slide wedge 40*a* to slide downward against the tension of the slide wedge spring 40*d*, guided as it is sandwiched between the body plate 50*a* and the slide wedge bracket 41. This downward motion of the slide wedge 40*a* causes the wedge section 40*c* to wedge between the front of the body plate 50*a* and the rack gear slide 42*a*. As the rack gear slide 42*a* is fixed to the rack gear 7*a*, the rack gear 7*a* slides to the side. This motion of the rack gear 7*a* causes the pinion gear 8 to turn thereby bringing the hook 2*a* to the closed position over the applicator nozzle 11*a*. Squeezing the trigger 29*a* to the point where the hook 2*a* becomes closed over the applicator nozzle 11*a* causes the trigger squeeze plate contact point 29*b* to come into contact with the squeeze plate 44. Continuing to squeeze the trigger 29*a* maintains the hook 2*a* in the closed position as the trigger slide 35 simply continues to move forward over the fully engaged slide wedge contact angle 40*b*, while the trigger squeeze plate contact point 29*b* continues to push the squeeze plate 44 toward the body plate 50*a*.

As seen in FIG. 23B, the movement of the squeeze plate 44 is confined to a face to face approach toward the body plate 50*a* by two (2) slide mechanisms: a squeeze plate slide hinge 48*a* positioned at the front of the body plate 50*a* and a squeeze plate slide stabilizer 45 positioned at the back of the body plate 50*a*. The squeeze plate slide hinge 48*a* guides this end of the squeeze plate 44 to slide back and forth face to face toward the body plate 50*a* along the squeeze plate slide hinge channels 49*a*. The squeeze plate slide stabilizer 45 also guides the movement of the squeeze plate 44 to a back and forth face to face slide at the back of the squeeze plate 44; however, this rectangular shaped rod 45, as it is hinged to the body plate 50*a* on one side and hinged slidable to the squeeze plate 44 on the other side within the squeeze plate stabilizer slide brackets 47, allows the squeeze plate 44 to approach the body plate 50*a* along the same axis (x) as the trigger 29*a* pivots with little wobbling edge to edge along the y axis.

Figure 24D:
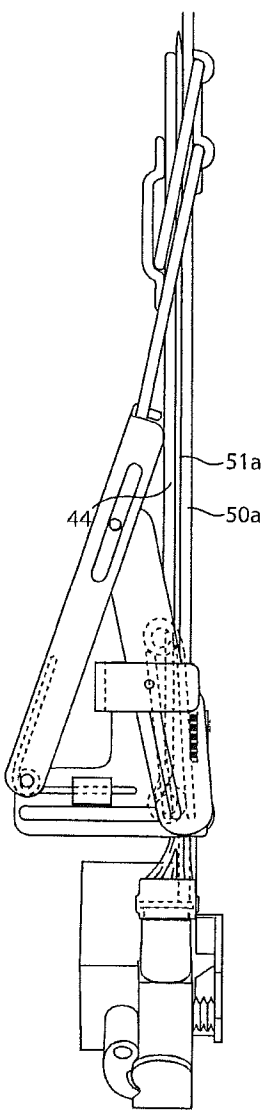
FIG. 24D shows the device of FIG. 24A in a fourth step in the series of operations.
Figure 24C:
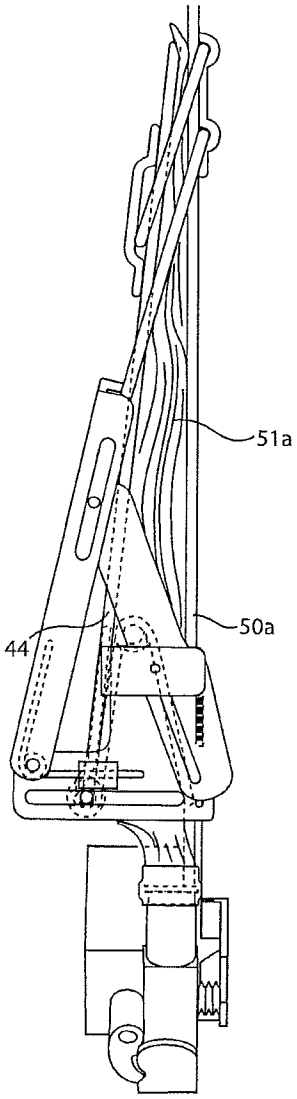
FIG. 24C shows the device of FIG. 24A in a third step in the series of operations.
Figure 24B:
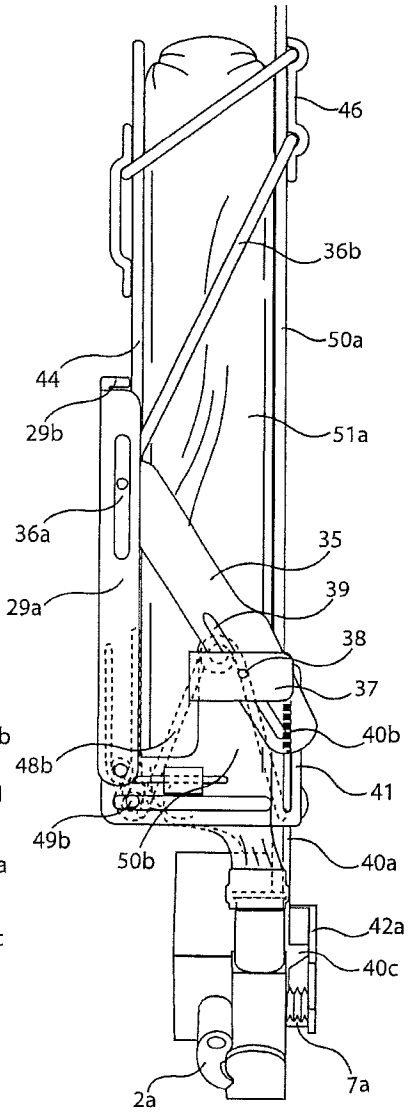
FIG. 24B shows the device of FIG. 24A in a second step in the series of operations.
Figure 24A:
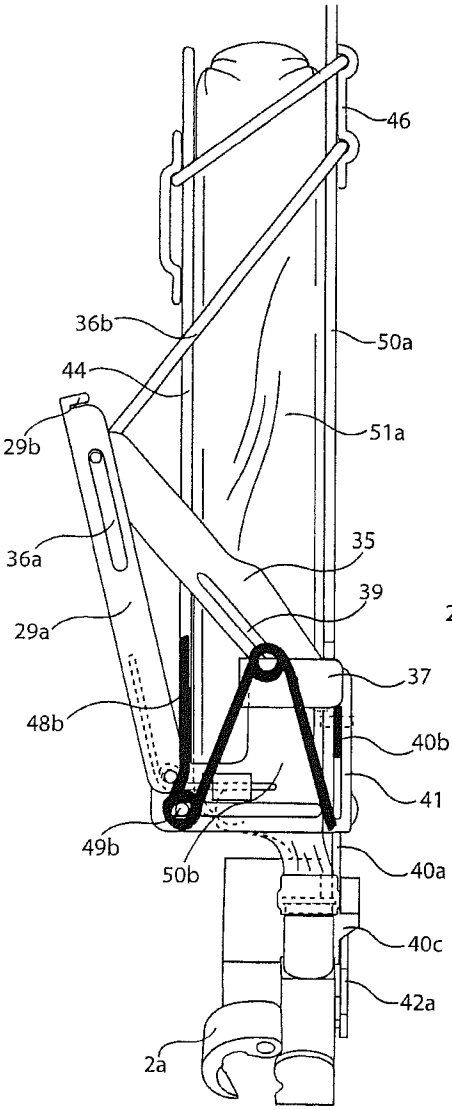
FIG. 24A represents a top view of a complete assembly of the device including the means for liquid hair color application and a first in a series of mechanical operations causing the hook to pivot and the color to dispense respectively.

As seen in FIGS. 24A-24D, the approach of the squeeze plate 44 toward the body plate 50*a* occurs against the tension of the dual elbow squeeze plate spring 48*b* located along the bottom front of the device (In order to provide further clarity, the dual elbow spring 48*b*, although it is positioned along the bottom of the device, is shown in bold black in FIG. 24A). As the squeeze plate 44 approaches the body plate 50*a* it does so preferably at an angle back relative to the body plate 50*a* so that the back of the squeeze plate 44 comes into contact with the back of the body plate 50*a* first (as seen in FIG. 24C) followed by an angled forward approach of the front of the squeeze plate 44 toward the front of the body plate 50*a* until the full length of the squeeze plate 44 is in full face to face contact with the body plate 50*a* (as seen in FIG. 24D). This approach of the squeeze plate 44 toward the body plate 50*a* is preferred in order that, when a full color container 51*j*, such as the preferred type depicted in FIG. 24A, is loaded functionally into the device, the color container 51*j* is gradually, through successive runs of the device through a head of hair, emptied from back to front. In practice, each of said individual runs will begin as the squeeze plate 44 and body plate 50*a* appear in the position depicted in FIG. 24A and will gradually follow, through successive individual runs, the entire FIG. 24 mechanical sequence until the squeeze plate 44 and body plate 50*a* meet face to face as depicted in FIG. 24D having emptied the color container 51*j*.

This back to front emptying process of the color container 51) is assured as the dual elbow spring 48*b* is located at, and therefore, creates tension between the front of the squeeze plate 44 and the front of the body plate 50*a*, thereby, tensioning the front of each of the two plates away from one another to the open most position. This tension is maintained as one elbow of the dual elbow spring is attached on one side to the body plate 50*a* and on the other side to the squeeze plate slide hinge pin 49*b*. The attachment between the spring and the front of the squeeze plate is maintained as the bottom squeeze plate slide hinge pin 49*b* extends through the center of one of the two spring 48*b* coils. This spring 48*b* coil attachment is also the pivot point of a second preferred squeeze plate 44 tension. This front pivotal tension urges the back of the squeeze plate 44 to the open most position away from the back of the body plate 50*a* when the trigger 29*a* is released. Since both of the outward tensions described above are located at the front of the two plates, inward pressure applied to the middle of the squeeze plate 44 by the contact point 29*b* of the trigger 29*a* will, through successive runs of the device through a head of hair, cause the back of the squeeze plate 44 to move toward and contact the back of the body plate 50*a* first, followed by the approach of the front of the squeeze plate 44 toward the front of the body plate 50*a*.

As seen in FIGS. 23B and 24A, the point in each individual run where the trigger 29*a* is released causes the trigger 29*a* to pivot out to the open position with the tension of the trigger spring 32. Said mechanical action causes the squeeze plate 44 to move away from the body plate 50*a*, thereby, returning the squeeze plate to the open resting position against the tension of the dual elbow squeeze plate spring 48*b*. Concurrently, the trigger slide 35 returns to the resting position and, in doing so, slides off of the slide wedge contact angle 40*b*. This release of the slide wedge contact angle 40*b* causes the slide wedge 40*a* to slide upward with the tension of the slide wedge spring 40*d*, which, in turn, raises the wedge section 40*c* of the slide wedge 40*a* out from between the rack slide 42*a* and the side of the gear box 6. The rack slide 42*a* is then released to slide inward, guided by the rack slide seat 43 in which it is slidably seated, toward the side of the gear box 6 with the tension of the rack slide spring 42*b*. Finally, as one side of the rack gear 7 is attached to the rack gear slide 42, the inward motion of the rack gear slide 42*a* causes the rack gear 7 to move back to the resting position along with the pinion gear 8 and therefore the hook 2*a*.

The color container valve, neck and coupling are the same as the color containers described in the multi-hooking applicator embodiment described earlier in this disclosure only embodied in the singular.

I claim:

1. In a device for selectively entraining hair strands from the scalp having at least one hooking applicator, the at least one hooking applicator employing a hook that rotates to entrain the hair strands, a hair color container having hair color therein and a way to apply the hair color to the entrained hair stands, the improvement comprising:

a) the at least one hooking applicator is configured to form a channel between a surface of the hook and a surface of a body portion of the at least one hooking applicator having a hair color outlet therein to better accommodate high viscosity liquid hair color;

b) the at least one hooking applicator include a pair of spaced apart feet, each foot having a scalp contacting surface of continuous and flat length, the hook positioned between the spaced apart feet;

the hook is positioned with respect to the spaced apart feet to form a scissors action between the hook and the spaced apart feet when the hook rotates for entraining hair strands;

c) wherein the hook and/or the at least one hooking applicator includes a recess to hold entrained hair and permit hair color to fill the recess be applied to entrained hair; and d) a trigger mechanism that first rotates the hook to entrain hair strands and then squeezes and compresses the hair color container to apply hair color to the entrained hair via the at least one hooking applicator.

2. The device of claim 1, wherein the trigger mechanism further comprising a plate, the plate being parallel or angled with respect to the hair color container and adapted to be pressed against the hair color container for squeezing and to apply hair color to the entrained hair via the hooking applicator.

3. The device of claim 1, the hair color container comprising one of:

dual chambers, each chamber containing a different hair color, and further comprising a mixer to mix the different hair colors together after being squeezed from the hair color container and prior to application of the hair color to the entrained hairs; or one chamber containing a hair color and a rupturable pouch, the rupturable pouch containing another hair color, the trigger mechanism capable of rupturing the rupturable pouch to permit the hair colors to be mixed.

4. The device of claim 1, wherein the body portion is fixed to a frame of the device and does not move with respect to the frame while the hook rotates.

5. The device of claim 1, further comprising a plurality of hooking applicators.

6. The device of claim 1, wherein a width of the spaced apart feet approximates a width of the at least one hook applicator to allow an operator of the device to better see rotation of the hook and hair entrainment.

7. In a method of entraining hair for coloring hair, wherein hair strands are entrained from the scalp using at least one hooking applicator, the at least one hooking applicator employing a hook that rotates to entrain the hair strands, and a step of applying hair color from a hair color container to the entrained hair stands, the improvement comprising using the device of claim 1 for coloring hair.

8. The method of claim 7, further comprising applying the hair color using a plurality of hooking applicators.

9. The method of claim 7, wherein the spaced apart feet have a width approximate a width of the hook applicator to allow an operator of the device to better see rotation of the hook and hair entrainment.

10. The device of claim 1, wherein a distal end of the hook has a point and the point is on either lateral end of the hook or in a middle of the distal end of the hook.

11. The device of claim 1, wherein each foot has a hair access indentation channel for supporting the entrained hair.

12. The device of claim 1, further comprising a layer of foam configured to surround a periphery of the hair color outlet.

13. The device of claim 1, further comprising a tooth on the hook and a gasket positioned against an inside surface of the body portion at the hair color outlet, the tooth positioned to push against the gasket when the hook rotates to allow hair color to exit the hair color outlet.

14. The device of claim 5, wherein each hooking applicator has a supply line for hair color and each supply line has a mechanism to stop flow of hair color through the supply line so that hair color application can be individually controlled for each hooking applicator.

15. The device of claim 2, wherein the hooking applicators are positioned along a lateral axis of the device, the hooking applicators angled with respect to the lateral axis.

16. The device of claim 1, wherein the body portion is configured to dispense a solid or semi-solid hair color on the entrained hair.

17. The device of claim 4, further comprising a plurality of hooking applicators, and wherein an end of the frame includes a roller coupling and/or a spring to allow the plurality of hooking applicators to flex and curve during use.

18. The device of claim 2, wherein each hooking applicator has a supply line, each supply line connected to a manifold, the manifold adapted to be connected to the hair color container.

19. The device of claim 1, wherein the trigger mechanism further comprises a rack and pinion mechanism or a rotating lever mechanism to rotate the hook for hair entrainment mechanism.

20. The device of claim 15, wherein the trigger mechanism further comprises a rotating lever mechanism to rotate the hook for hair entrainment mechanism.

21. The device of claim 20, wherein the rotating lever mechanism allows the hooking applications to conform to a curve of a scalp.

22. The device of claim 1, further comprising a head assembly that includes a manifold that connects to the at least one hooking applicator, the at least one hooking applicator, and a portion of the trigger mechanism that allows for rotation of the hook, the head assembly being detachable from the device.

23. The device of claim 22, further comprising a plurality of hooking applicators.

24. The device of claim 1, further comprising a bridge between the feet, the feet and bridge forming a space to receive an end portion of the hook.

* * * * *